US012123337B2

(12) United States Patent
Chiruta et al.

(10) Patent No.: US 12,123,337 B2
(45) Date of Patent: Oct. 22, 2024

(54) AFTERTREATMENT SYSTEMS

(71) Applicant: Cummins Emission Solutions Inc., Columbus, IN (US)

(72) Inventors: Mihai Chiruta, Madison, WI (US); Isabel Valborg Montgomery, Stoughton, WI (US); Lindsey R. Henry, Fort Worth, TX (US)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 17/695,580

(22) Filed: Mar. 15, 2022

(65) Prior Publication Data

US 2022/0298949 A1 Sep. 22, 2022

Related U.S. Application Data

(60) Provisional application No. 63/162,836, filed on Mar. 18, 2021.

(51) Int. Cl.
*F01N 3/28* (2006.01)
*F01N 3/20* (2006.01)

(52) U.S. Cl.
CPC ..... *F01N 3/2892* (2013.01); *F01N 3/2066* (2013.01); *F01N 2240/20* (2013.01); *F01N 2570/14* (2013.01); *F01N 2610/08* (2013.01)

(58) Field of Classification Search
CPC .. F01N 3/2892; F01N 3/2066; F01N 2240/20; F01N 2570/14; F01N 2610/08
USPC ..... 60/324
See application file for complete search history.

(56) References Cited

U.S. PATENT DOCUMENTS 1,104,963 A 7/1914 Coanda
3,699,407 A 10/1972 Gurtler et al.
4,424,777 A 1/1984 Klomp
6,444,177 B1 9/2002 Muller et al.
(Continued)

FOREIGN PATENT DOCUMENTS

CN 1864835 A 11/2006
CN 101501308 A 8/2009
(Continued)

OTHER PUBLICATIONS

Coanda effect, https://en.wikipedia.org/w/index.php?title=Coand%C4%83_effect&oldid=1000333406 (last visited Mar. 12, 2021).
(Continued)

*Primary Examiner* — Kenneth J Hansen
*Assistant Examiner* — Kelsey L Stanek
(74) *Attorney, Agent, or Firm* — Foley & Lardner LLP

(57) ABSTRACT

An aftertreatment system includes an exhaust gas conduit, a mixer, and a mixing flange. The exhaust gas conduit includes an inner surface. The exhaust gas conduit has a conduit diameter $d_c$. The mixer includes a mixer body and an upstream vane plate. The upstream vane plate has a plurality of upstream vanes. At least one of the plurality of upstream vanes is coupled to the mixer body. The mixing flange is disposed downstream of the mixer. The mixing flange includes a mixing flange opening having a mixing flange opening diameter $d_{mf}$, $0.30*d_c \leq d_{mf} \leq 0.95*d_c$.

21 Claims, 9 Drawing Sheets

(56) References Cited

U.S. PATENT DOCUMENTS 7,127,884 B2 10/2006 Worner et al.
7,581,387 B2 9/2009 Bui et al.
7,793,490 B2 9/2010 Amon et al.
7,836,688 B2 11/2010 Woerner et al.
7,866,143 B2 1/2011 Buhmann et al.
8,033,101 B2 10/2011 Amon et al.
8,230,678 B2 7/2012 Aneja et al.
8,375,708 B2 2/2013 Forster et al.
8,460,610 B2 6/2013 Silver et al.
8,607,555 B2 12/2013 Kaiser et al.
8,615,984 B2 12/2013 Kornherr et al.
8,695,330 B2 4/2014 Davidson et al.
8,776,509 B2 7/2014 Wikaryasz et al.
8,789,363 B2 7/2014 Iverson et al.
9,021,794 B2 5/2015 Goss et al.
9,133,744 B2 9/2015 Birkby et al.
9,248,404 B2 2/2016 Brunel et al.
9,266,075 B2 2/2016 Chapman et al.
9,267,417 B2 2/2016 Baldwin et al.
D757,919 S 5/2016 Kimura
9,328,640 B2 5/2016 Iverson et al.
9,346,017 B2 5/2016 Greber
9,352,276 B2 5/2016 Sampath
9,453,444 B2 9/2016 Fischer et al.
9,464,546 B2 10/2016 Perrot et al.
9,504,960 B2 11/2016 Park
9,581,067 B2 2/2017 Guilbaud et al.
D781,071 S 3/2017 Callif et al.
9,605,573 B2 3/2017 Solbrig et al.
9,644,516 B1 5/2017 Chiruta et al.
9,664,081 B2 5/2017 Rusch et al.
9,714,598 B2 7/2017 Alano et al.
D794,100 S 8/2017 McDonald et al.
9,726,064 B2 8/2017 Alano
9,737,908 B2 8/2017 Hornback et al.
9,776,135 B2 10/2017 Boeshans et al.
D809,577 S 2/2018 McDonald et al.
D816,010 S 4/2018 Rike
9,995,193 B2 6/2018 Alano et al.
10,024,217 B1 7/2018 Johnson et al.
10,030,564 B2 7/2018 Cossard et al.
10,174,658 B2 1/2019 Dimpelfeld et al.
10,190,465 B2 1/2019 Alano et al.
D840,908 S 2/2019 Rike
10,215,075 B2 2/2019 Chapman et al.
10,247,081 B2 4/2019 Niaz
10,273,853 B2 4/2019 Golin
10,273,854 B1 4/2019 Abbassi et al.
D849,662 S 5/2019 Rike
10,287,948 B1 5/2019 Moulieres et al.
10,287,954 B2 5/2019 Chapman et al.
10,294,843 B2 5/2019 Alano et al.
10,316,721 B1 6/2019 Moulieres et al.
D855,090 S 7/2019 McDonald et al.
10,337,379 B2 7/2019 Dimpelfeld et al.
10,337,380 B2 7/2019 Willats et al.
10,422,268 B2 9/2019 Niaz
10,533,478 B2 1/2020 Alano
10,577,995 B2 3/2020 Ker et al.
10,612,443 B2 4/2020 Li et al.
10,632,430 B1 4/2020 Liu et al.
10,731,536 B1 8/2020 Chenoweth et al.
10,787,946 B2 9/2020 Rohde et al.
10,808,587 B2 10/2020 Ottaviani et al.
10,823,032 B2 11/2020 Willats et al.
10,907,522 B2 2/2021 Poinsot et al.
10,914,218 B1 2/2021 Chapman et al.
10,920,635 B2 2/2021 Kozakiewicz
10,920,642 B2 2/2021 Wang et al.
10,933,387 B2 3/2021 Cvelbar
10,967,329 B2 4/2021 Alano et al.
11,085,346 B2 8/2021 Tucker et al.
11,105,241 B2 8/2021 Tucker et al.
11,143,084 B2 10/2021 Wahlstrom
11,193,412 B2 12/2021 Cvelbar et al.
11,230,958 B2 1/2022 Tucker et al.
11,242,788 B2 2/2022 Kinnaird
11,242,790 B2 2/2022 Chapman et al.
11,268,424 B2 3/2022 Kimura et al.
11,300,028 B2 4/2022 Meunier
11,313,266 B2 4/2022 Tucker et al.
11,459,927 B2 10/2022 Rajashekharaiah et al.
11,459,929 B2 10/2022 Dimpelfeld et al.
11,506,101 B2 11/2022 Levato et al.
11,591,943 B2 2/2023 Hornback
11,746,684 B2 9/2023 Wahlstrom
11,761,365 B2 9/2023 Liu et al.
2002/0023435 A1 2/2002 Woerner et al.
2004/0112883 A1 6/2004 Bowden et al.
2004/0237511 A1 12/2004 Ripper et al.
2005/0172615 A1 8/2005 Mahr
2005/0262843 A1 12/2005 Monty
2006/0150614 A1 7/2006 Cummings
2006/0153748 A1 7/2006 Huthwohl et al.
2006/0191254 A1 8/2006 Bui et al.
2006/0260104 A1 11/2006 Himi
2006/0266022 A1 11/2006 Woerner et al.
2006/0283181 A1 12/2006 Crawley et al.
2007/0144126 A1 6/2007 Ohya et al.
2007/0163241 A1 7/2007 Meingast et al.
2007/0245718 A1 10/2007 Cheng et al.
2007/0283683 A1 12/2007 Bellinger
2007/0289294 A1 12/2007 Werni et al.
2008/0087013 A1 4/2008 Crawley et al.
2008/0121179 A1 5/2008 Park et al.
2008/0127635 A1 6/2008 Hirata et al.
2008/0314033 A1 12/2008 Aneja et al.
2009/0000283 A1 1/2009 Endicott et al.
2009/0019843 A1 1/2009 Levin et al.
2009/0031717 A1 2/2009 Blaisdell
2009/0049829 A1 2/2009 Kaiser et al.
2009/0084094 A1 4/2009 Goss et al.
2009/0145119 A1 6/2009 Farrell et al.
2009/0158717 A1 6/2009 Kimura et al.
2009/0158721 A1 6/2009 Wieland et al.
2009/0158722 A1 6/2009 Kojima et al.
2009/0180937 A1 7/2009 Nohl et al.
2009/0229254 A1 9/2009 Gibson
2009/0272106 A1 11/2009 Werni et al.
2010/0083641 A1 4/2010 Makartchouk et al.
2010/0146942 A1 6/2010 Mayr et al.
2010/0146948 A1 6/2010 Dacosta et al.
2010/0187383 A1 7/2010 Olsen et al.
2010/0251719 A1 10/2010 Mancini et al.
2010/0319329 A1 12/2010 Khadiya
2011/0005232 A1 1/2011 Williams et al.
2011/0079003 A1 4/2011 Sun et al.
2011/0094206 A1 4/2011 Liu et al.
2011/0099978 A1 5/2011 Davidson et al.
2011/0146237 A1 6/2011 Adelmann et al.
2011/0146253 A1 6/2011 Isada et al.
2011/0194987 A1 8/2011 Hodgson et al.
2012/0003955 A1 1/2012 Gabriel
2012/0124983 A1 5/2012 Hong
2012/0204541 A1 8/2012 Li et al.
2012/0204542 A1 8/2012 Norris et al.
2012/0204544 A1 8/2012 Uhrich et al.
2012/0216513 A1 8/2012 Greber et al.
2013/0067891 A1 3/2013 Hittle et al.
2013/0097819 A1 4/2013 Kojima
2013/0333363 A1 12/2013 Joshi et al.
2014/0033686 A1 2/2014 Fischer et al.
2014/0230418 A1 8/2014 Perrot et al.
2014/0260209 A1 9/2014 Goss et al.
2014/0325967 A1 11/2014 Kimura
2014/0373721 A1 12/2014 Sandou et al.
2015/0000389 A1 1/2015 Runde et al.
2015/0016214 A1 1/2015 Mueller
2015/0089923 A1* 4/2015 Henderson, IV ..... F01N 13/10 60/299
2015/0110681 A1 4/2015 Ferront et al.
2015/0121855 A1 5/2015 Munnannur et al.
2015/0218996 A1 8/2015 Brandl et al.
2015/0224870 A1 8/2015 Shin et al.

(56) References Cited

U.S. PATENT DOCUMENTS

| | | | |
|---|---|---|---|
| 2015/0233276 | A1 | 8/2015 | Cassity et al. |
| 2015/0360176 | A1 | 12/2015 | Bui et al. |
| 2016/0061090 | A1 | 3/2016 | Anand et al. |
| 2016/0069239 | A1 | 3/2016 | Freeman et al. |
| 2016/0083060 | A1 | 3/2016 | Kassianoff |
| 2016/0090887 | A1 | 3/2016 | Mitchell et al. |
| 2016/0115847 | A1 | 4/2016 | Chapman et al. |
| 2016/0138454 | A1 | 5/2016 | Alano et al. |
| 2016/0158714 | A1 | 6/2016 | Li et al. |
| 2016/0175784 | A1 | 6/2016 | Harmon et al. |
| 2016/0194991 | A1 | 7/2016 | Clayton et al. |
| 2016/0243510 | A1 | 8/2016 | Denton et al. |
| 2016/0251990 | A1 | 9/2016 | Dimpelfeld et al. |
| 2016/0326931 | A1 | 11/2016 | Freeman et al. |
| 2016/0332126 | A1* | 11/2016 | Nande ..... B01F 23/21 |
| 2016/0361694 | A1* | 12/2016 | Brandl ..... F01N 13/0097 |
| 2016/0376969 | A1 | 12/2016 | Zhang et al. |
| 2017/0067387 | A1 | 3/2017 | Khaled |
| 2017/0089246 | A1 | 3/2017 | Greber et al. |
| 2017/0107882 | A1 | 4/2017 | Chiruta et al. |
| 2017/0152778 | A1 | 6/2017 | Li et al. |
| 2017/0327273 | A1 | 11/2017 | Lee et al. |
| 2017/0361273 | A1 | 12/2017 | Zoran et al. |
| 2017/0370262 | A1 | 12/2017 | Zoran et al. |
| 2018/0078912 | A1 | 3/2018 | Yadav et al. |
| 2018/0087428 | A1 | 3/2018 | Barr |
| 2018/0142604 | A1 | 5/2018 | Niaz |
| 2018/0266300 | A1 | 9/2018 | Liu et al. |
| 2018/0306083 | A1 | 10/2018 | Sampath et al. |
| 2018/0313247 | A1 | 11/2018 | Bauknecht et al. |
| 2019/0063294 | A1 | 2/2019 | Johnson et al. |
| 2019/0107025 | A1 | 4/2019 | Brinkmeyer |
| 2019/0323397 | A1 | 10/2019 | Pill et al. |
| 2020/0102873 | A1 | 4/2020 | Ramolivo et al. |
| 2020/0123955 | A1* | 4/2020 | Liu ..... F01N 3/2892 |
| 2020/0325811 | A1 | 10/2020 | Levin et al. |
| 2020/0332696 | A1 | 10/2020 | Chapman et al. |
| 2021/0039056 | A1* | 2/2021 | De Rudder ..... F01N 3/2066 |
| 2021/0095587 | A1* | 4/2021 | Cvelbar ..... F01N 3/2066 |
| 2021/0301704 | A1 | 9/2021 | Hornback |
| 2021/0301710 | A1 | 9/2021 | Cvelbar et al. |
| 2021/0363907 | A1 | 11/2021 | Poinsot et al. |
| 2021/0404367 | A1 | 12/2021 | Alano et al. |
| 2022/0065148 | A1 | 3/2022 | Sudries et al. |
| 2022/0090532 | A1 | 3/2022 | Degner et al. |
| 2022/0099121 | A1 | 3/2022 | Kumar |
| 2022/0162975 | A1 | 5/2022 | Cvelbar et al. |
| 2022/0162976 | A1 | 5/2022 | Alano et al. |
| 2022/0178296 | A1 | 6/2022 | Hogan |
| 2022/0184567 | A1 | 6/2022 | Geant |
| 2022/0316382 | A1 | 10/2022 | De Rudder |
| 2022/0349330 | A1 | 11/2022 | Chapman et al. |
| 2022/0379272 | A1 | 12/2022 | Alano |
| 2023/0003159 | A1 | 1/2023 | Mittapalli et al. |
| 2023/0141549 | A1 | 5/2023 | Kalyanshetti |

FOREIGN PATENT DOCUMENTS

| | | | |
|---|---|---|---|
| CN | 101815851 | A | 8/2010 |
| CN | 102242662 | A | 11/2011 |
| CN | 103429864 | A | 12/2013 |
| CN | 105143628 | A | 12/2015 |
| CN | 105612325 | A | 5/2016 |
| CN | 105715340 | A | 6/2016 |
| CN | 205559030 | U | 9/2016 |
| CN | 106321199 | A | 1/2017 |
| CN | 106377919 | A | 2/2017 |
| CN | 206144632 | U | 5/2017 |
| CN | 206144633 | U | 5/2017 |
| CN | 106968765 | A | 7/2017 |
| CN | 107435576 | A | 12/2017 |
| CN | 108194176 | A | 6/2018 |
| CN | 108252771 | A | 7/2018 |
| CN | 108708781 | A | 10/2018 |
| CN | 109477413 | | 3/2019 |
| CN | 208982145 | U | 6/2019 |
| CN | 106014560 | B | 7/2019 |
| CN | 209179849 | U | 7/2019 |
| CN | 209586479 | U | 11/2019 |
| CN | 209855888 | U | 12/2019 |
| CN | 110761876 | A | 2/2020 |
| CN | 210195855 | U | 3/2020 |
| CN | 210686097 | U | 6/2020 |
| CN | 210858906 | U | 6/2020 |
| CN | 211082028 | U | 7/2020 |
| CN | 211116205 | U | 7/2020 |
| CN | 211573625 | U | 9/2020 |
| CN | 111810276 | A | 10/2020 |
| CN | 212130586 | U | 12/2020 |
| CN | 212130587 | U | 12/2020 |
| CN | 212296579 | U | 1/2021 |
| CN | 112483224 | | 3/2021 |
| CN | 212744129 | U | 3/2021 |
| CN | 214304014 | U | 9/2021 |
| CN | 214836650 | U | 11/2021 |
| CN | 214887318 | U | 11/2021 |
| CN | 215109110 | U | 12/2021 |
| CN | 215719044 | U | 2/2022 |
| CN | 215719045 | U | 2/2022 |
| CN | 216157745 | U | 4/2022 |
| CN | 216617626 | U | 5/2022 |
| CN | 217872989 | U | 11/2022 |
| DE | 10021166 | A1 | 11/2001 |
| DE | 10131803 | A1 | 5/2003 |
| DE | 10312212 | A1 | 11/2003 |
| DE | 10 2004 043 931 | A1 | 3/2006 |
| DE | 10 2010 014 037 | A1 | 11/2010 |
| DE | 11 2009 000 650 | T5 | 1/2011 |
| DE | 11 2010 002 589 | T5 | 11/2012 |
| DE | 10 2014 101 889 | A1 | 8/2015 |
| DE | 10 2014 102 798 | A1 | 9/2015 |
| DE | 10 2016 222 743 | A1 | 5/2017 |
| DE | 10 2016 115 030 | A1 | 2/2018 |
| DE | 10 2018 127 387 | A1 | 5/2019 |
| DE | 10 2007 051 510 | B4 | 2/2021 |
| DE | 10 2020 121 659 | A1 | 3/2021 |
| EP | 1 716 917 | A1 | 11/2006 |
| EP | 2 769 762 | A1 | 8/2014 |
| EP | 2 551 482 | B1 | 1/2015 |
| EP | 2 546 488 | B1 | 4/2015 |
| EP | 2 551 481 | B1 | 8/2015 |
| EP | 3 085 913 | A1 | 10/2016 |
| EP | 3 085 915 | A1 | 10/2016 |
| EP | 3 085 916 | A1 | 10/2016 |
| EP | 2 570 178 | B1 | 4/2017 |
| EP | 2 522 822 | B1 | 6/2017 |
| EP | 2 796 684 | B1 | 1/2018 |
| EP | 3 425 180 | A1 | 1/2019 |
| EP | 3 699 407 | A1 | 8/2020 |
| EP | 3 775 514 | A1 | 2/2021 |
| FR | 2965011 | A1 | 3/2012 |
| FR | 3010134 | A1 | 3/2015 |
| FR | 2984953 | B1 | 4/2015 |
| FR | 2977913 | B1 | 6/2015 |
| FR | 3020835 | A1 | 11/2015 |
| FR | 3020834 | B1 | 6/2016 |
| FR | 3020835 | B1 | 6/2016 |
| FR | 3098854 | B1 | 7/2021 |
| FR | 3097775 | B1 | 5/2022 |
| FR | 3102683 | B1 | 6/2022 |
| FR | 3111664 | B1 | 7/2022 |
| FR | 3110634 | B1 | 9/2022 |
| GB | 2 385 545 | A | 8/2003 |
| GB | 2 558 311 | A | 7/2018 |
| IN | 201921025624 | A | 1/2021 |
| JP | 2003-056274 | A | 2/2003 |
| JP | 2009-156077 | A | 7/2009 |
| JP | 2010-180863 | A | 8/2010 |
| JP | 2013-133774 | A | 7/2013 |
| WO | WO-2009/024815 | A2 | 2/2009 |
| WO | WO-2009/024815 | A3 | 2/2009 |
| WO | WO-2010/146285 | A1 | 12/2010 |
| WO | WO-2011/110885 | A1 | 9/2011 |
| WO | WO-2012/110720 | A1 | 8/2012 |

(56) References Cited

FOREIGN PATENT DOCUMENTS

| | | | |
|---|---|---|---|
| WO | WO-2012/123660 | A1 | 9/2012 |
| WO | WO-2016/082850 | A1 | 6/2016 |
| WO | WO-2016/111701 | A1 | 7/2016 |
| WO | WO-2018/017164 | A1 | 1/2018 |
| WO | WO-2018/075061 | A1 | 4/2018 |
| WO | WO-2018/226626 | A1 | 12/2018 |
| WO | WO-2019/029880 | A1 | 2/2019 |
| WO | WO-2019/143373 | A1 | 7/2019 |
| WO | WO-2020/009713 | A1 | 1/2020 |
| WO | WO-2021/050819 | A1 | 3/2021 |
| WO | WO-2021/112826 | A1 | 6/2021 |
| WO | WO-2021/113246 | A1 | 6/2021 |
| WO | WO-2021/173357 | A1 | 9/2021 |
| WO | WO-2021/225824 | | 11/2021 |

OTHER PUBLICATIONS

Examination Report for U.K. Patent App. No. 1413056.1 dated Sep. 21, 2017, 5 pages.
Examination Report for U.K. Patent App. No. 1805598.8 dated Apr. 24, 2018, 4 pages.
Examination Report issued for UK Patent Application No. GB 1917608.0 issued Sep. 6, 2021, 3 pages.
First Examination Report for Indian Patent Application No. 201947050068, issued Jan. 13, 2021,.
First Office Action issued for Chinese Patent Application No. 201880001223.6, issued Dec. 17, 2020, 9 pages.
Foreign Action other than Search Report on IN 201947050068 Dtd Jan. 13, 2021.
G. Comes, "Theoretical Modeling, Design and Simulation of an Innovative Diverting Valve Based on Coanda Effect", Fluids 2018, 3, 103, (2018).
International Search Report & Written Opinion for PCT/US2012/022582 dated Oct. 25, 2012, 6 pages.
International Search Report and Written Opinion for PCT App. No. PCT/IB2019/054988 dated Jan. 29, 2020, 12 pages.
International Search Report and Written Opinion issued for PCT Application No. PCT/US2021/017551 issued Apr. 28, 2021,8 pages.
International Search Report from corresponding PCT Application No. PCT/US2018/035959, dated Oct. 19, 2018, pp. 1-4.
Non-Final Office Action on U.S. Appl. No. 15/657,941 Dtd Aug. 6, 2019.
Non-Final Office Action on U.S. Appl. No. 16/618,716 Dtd Feb. 23, 2021.
Search Report issued for UK Patent Application No. GB 2101393.3, issued Feb. 22, 2021, 2 pages.
Search Report Letter issued for UK Patent Application No. GB 2101393.3, issued Feb. 22, 2021, 2 pages.
U.S. Office Action on U.S. Appl. No. 14/372,810 Dtd Mar. 8, 2017.
U.S. Office Action on U.S. Appl. No. 14/372,810 Dtd May 25, 2016.
U.S. Office Action on U.S. Appl. No. 16/618,716 Dtd Jan. 4, 2021.
Written Opinion from corresponding PCT Application No. PCT/US2018/035959, dated Oct. 19, 2018, pp. 1-8.
Combined Search and Examination Report issued in British Application No. GB2205057.9, dated May 5, 2022, 6 pages.
First Examination Report in Indian Application No. 202147057999, dated Mar. 14, 2022.
International Search Report and Written Opinion issued in PCT Application No. PCT/US2022/014781 issued Apr. 25, 2022, 14 pages.
Non-Final Office Action in U.S. Appl. No. 17/400,567 Dtd May 23, 2022.
Extended European Search Report is European Patent Application No. 19955166.4 issued Jul. 10, 2023.
Non-Final Office Action in U.S. Appl. No. 18/033,021 issued Jul. 18, 2023.
Examination Report in UK Patent Application No. GB2305850.6 issued May 26, 2023.
Final US Office Action in U.S. Appl. No. 13/837,446 issued Jan. 5, 2015.
First Examination Report in Indian Patent Application No. IN 202247030005, issued Jul. 13, 2022.
Office Action in German Patent Application No. DE 102014002750.3, issued Jan. 24, 2022.
International Search Report and Written Opinion in International Patent Application No. PCT/US2020/062718 issued Feb. 19, 2021.
International Search Report and Written Opinion in PCT Application No. PCT/US2021/029282 issued Jul. 27, 2021.
Non-Final Office Action in U.S. Appl. No. 17/923,804 issued Mar. 16, 2023.
Office Action in Chinese Patent Application No. 2021800162220 issued Mar. 17, 2023.
Office Action in Chinese Patent Application No. 202210283795.6, issued Mar. 20, 2023.
Office Action issued for German Patent Application No. DE 11 2012 005 741.4 issued Dec. 7, 2022, 9 pages, included translation.
Search Report and Written Opinion issued for PCT Application No. PCT/US2019/064232 issued Feb. 12, 2020.
U.S. Office Action issue in U.S. Appl. No. 13/837,446 issued Aug. 29, 2014.
Office Action in German Patent Application No. 11 2021 005 606.9 issued Dec. 14, 2023.
International Search Report and Written Opinion in PCT Application No. PCT/US2020/050318 issued Dec. 8, 2020.
Non-Final Office Action in U.S. Appl. No. 29/835,755 issued Oct. 4, 2023.
Non-Final Office Action in U.S. Appl. No. 29/835,777 issued Oct. 4, 2023.
Office Action in Chinese Patent Application No. 202180064965.5 issued Sep. 13, 2023.

* cited by examiner

AFTERTREATMENT SYSTEMS

CROSS-REFERENCE TO RELATED PATENT APPLICATION

The present application claims the benefit of, and priority to, U.S. Provisional Patent Application No. 63/162,836, filed Mar. 18, 2021. The contents of this application are hereby incorporated by reference in their entireties.

TECHNICAL FIELD

The present disclosure relates generally to an aftertreatment system for an internal combustion engine.

BACKGROUND

For an internal combustion engine system, it may be desirable to treat exhaust gas produced by a combustion of fuel by an internal combustion engine. The exhaust gas can be treated using an aftertreatment system. One approach that can be implemented in an aftertreatment system is to dose the exhaust gas with a reductant and pass the exhaust gas and reductant through a catalyst member. It may desirable to cause the exhaust gas and the reductant to swirl upstream of the catalyst member so as to increase mixing of the exhaust gas and the reductant. However, this swirling may not be capable of independently facilitating desirable mixing the exhaust gas and the reductant in some applications.

SUMMARY

In one embodiment, an exhaust gas aftertreatment system includes an exhaust gas conduit, a mixer, and a mixing flange. The exhaust gas conduit includes an inner surface. The exhaust gas conduit has a conduit diameter $d_c$. The mixer includes a mixer body and an upstream vane plate. The upstream vane plate has a plurality of upstream vanes. At least one of the plurality of upstream vanes is coupled to the mixer body. The mixing flange is disposed downstream of the mixer. The mixing flange includes a mixing flange opening having a mixing flange opening diameter $d_{mf}$. $0.30*d_c \leq d_{mf} \leq 0.95*d_c$.

In another embodiment, an exhaust gas aftertreatment system includes an exhaust gas conduit, a mixer, and a mixing flange. The exhaust gas conduit is centered on a conduit center axis. The mixer includes a mixer body, an endcap, and a mixer outlet. The mixer body has a mixer inlet configured to receive an exhaust gas. The mixer outlet extends through the endcap. The mixer outlet is configured to provide the exhaust gas. The mixer outlet is centered on an outlet center axis that is offset from the conduit center axis. The mixing flange is disposed downstream of the mixer. The mixing flange includes a mixing flange opening. The conduit center axis and the outlet center axis extend through the mixing flange opening.

BRIEF DESCRIPTION OF THE DRAWINGS

The disclosure will become more fully understood from the following detailed description, taken in conjunction with the accompanying Figures, wherein like reference numerals refer to like elements unless otherwise indicated, in which.

It will be recognized that the Figures are schematic representations for purposes of illustration. The Figures are provided for the purpose of illustrating one or more implementations with the explicit understanding that the Figures will not be used to limit the scope or the meaning of the claims.

DETAILED DESCRIPTION

Following below are more detailed descriptions of various concepts related to, and implementations of, methods, apparatuses, and for providing a mixing flange for an exhaust gas aftertreatment system (or simply "aftertreatment system") of an internal combustion engine. The various concepts introduced above and discussed in greater detail below may be implemented in any of a number of ways, as the described concepts are not limited to any particular manner of implementation. Examples of specific implementations and applications are provided primarily for illustrative purposes.

I. Overview

In order to reduce emissions, it may be desirable to treat exhaust gas using an aftertreatment system that includes at least one aftertreatment component. This may be done using a treatment fluid. Treatment of the exhaust gas may be enhanced by increasing a uniformity of distribution of the treatment fluid in the exhaust gas.

Various devices may be used in order to increase the uniformity of distribution of the treatment fluid in the exhaust gas. For example, a device may be used to cause swirling of the exhaust gas. However, it may be possible to further increase the uniformity of distribution of the treatment fluid in the exhaust gas by providing additional mechanisms for causing swirling of the exhaust gas.

Implementations herein are directed to an aftertreatment system that includes a mixing flange which is located downstream of a mixer. After the mixer causes swirling of the exhaust gas and treatment fluid, the exhaust gas flows against the mixing flange. The mixing flange includes a mixing flange opening through which the exhaust gas and the treatment fluid may pass. The mixing flange opening is configured to cause the mixing flange and the exhaust gas to experience the Coandă effect downstream of the mixing flange. The Coandă effect creates vortices downstream of the mixing flange, and these vortices create additional swirling of the exhaust gas and the treatment fluid.

II. Overview of First Example Aftertreatment Systems

Figure 1:
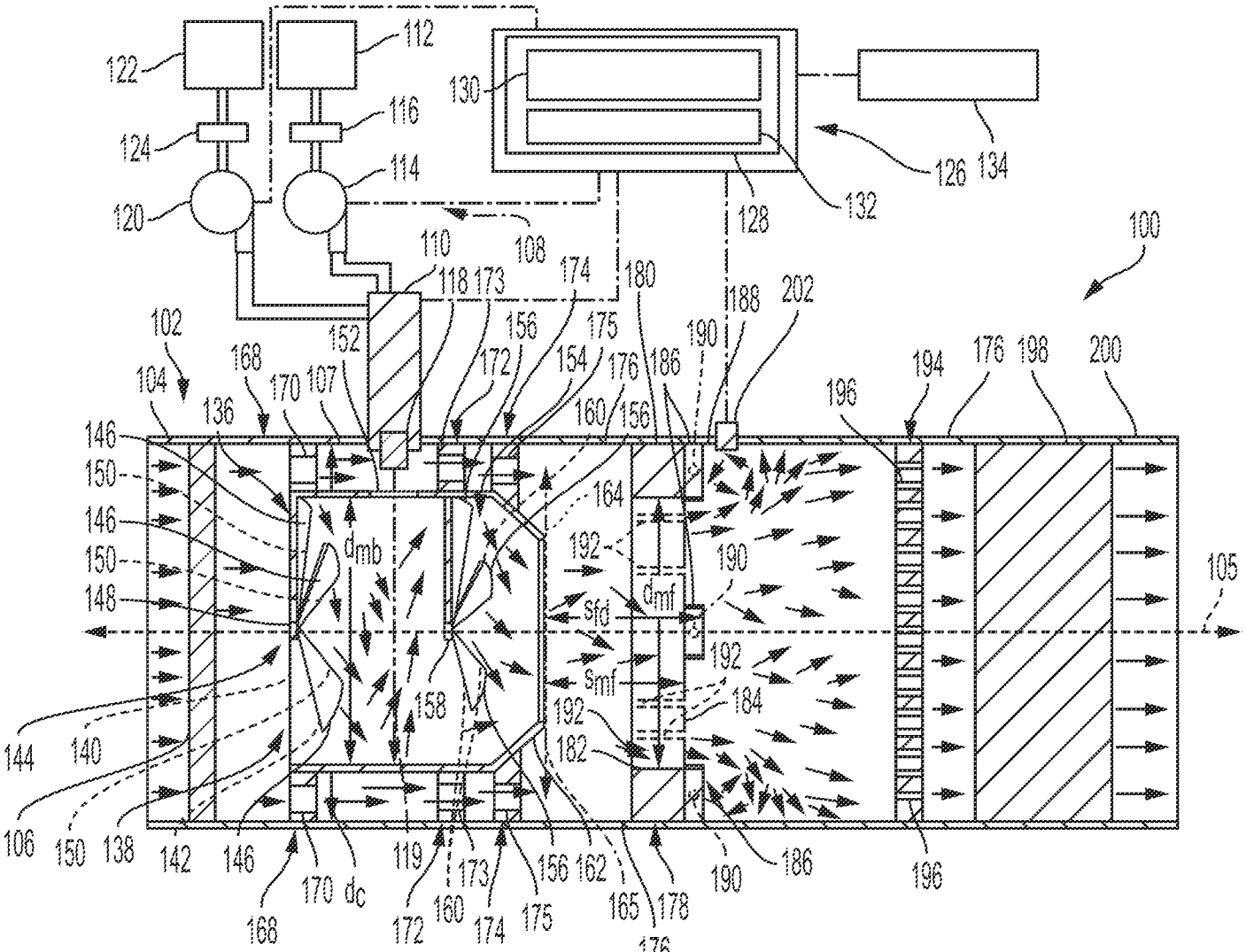
FIG. 1 is a cross-sectional view of a portion of an example aftertreatment system including a mixing flange.

FIG. 1 depicts an aftertreatment system 100 (e.g., treatment system, etc.) for treating exhaust gas produced by an internal combustion engine (e.g., diesel internal combustion engine, gasoline internal combustion engine, hybrid internal combustion engine, propane internal combustion engine, dual-fuel internal combustion engine, etc.). As is explained in more detail herein, the aftertreatment system 100 is configured to facilitate treatment of the exhaust gas. This treatment may facilitate reduction of emission of undesirable components (e.g., nitrogen oxides ($NO_x$), etc.) in the exhaust gas. This treatment may also or instead facilitate conversion of various oxidation components (e.g., carbon monoxide (CO), hydrocarbons, etc.) of the exhaust gas into other components (e.g., carbon dioxide ($CO_2$), water vapor, etc.). This treatment may also or instead facilitate removal of particulates (e.g., soot, particulate matter, etc.) from the exhaust gas.

The aftertreatment system 100 includes an exhaust gas conduit system 102 (e.g., line system, pipe system, etc.). The exhaust gas conduit system 102 is configured to facilitate routing of the exhaust gas produced by the internal combustion engine throughout the aftertreatment system 100 and to atmosphere (e.g., ambient environment, etc.).

The exhaust gas conduit system 102 includes an inlet conduit 104 (e.g., line, pipe, etc.). The inlet conduit 104 is fluidly coupled to an upstream component (e.g., header on the internal combustion engine, exhaust manifold on the internal combustion engine, the internal combustion engine, etc.) and is configured to receive exhaust gas from the upstream component. In some embodiments, the inlet conduit 104 is coupled (e.g., attached, fixed, welded, fastened, riveted, adhesively attached, bonded, pinned, etc.) to the upstream component. In other embodiments, the inlet conduit 104 is integrally formed with the upstream component. The inlet conduit 104 is centered on a conduit center axis 105 (e.g., the conduit center axis 105 extends through a center point of the inlet conduit 104, etc.). As used herein, the term "axis" describes a theoretical line extending through the centroid (e.g., center of mass, etc.) of an object. The object is centered on this axis. The object is not necessarily cylindrical (e.g., a non-cylindrical shape may be centered on an axis, etc.).

The aftertreatment system 100 also includes a filter 106 (e.g., diesel particulate filter (DPF), filtration member, etc.). The filter 106 is disposed within the inlet conduit 104 and is configured to remove particulates from the exhaust gas. For example, the filter 106 may receive exhaust gas (e.g., from the inlet conduit 104, etc.) having a first concentration of the particulates and may provide the exhaust gas (e.g., to the inlet conduit 104, etc.) having a second concentration of the particulates, where the second concentration is lower than the first concentration. In some embodiments, the aftertreatment system 100 does not include the filter 106.

The exhaust gas conduit system 102 also includes an introduction conduit 107 (e.g., decomposition housing, decomposition reactor, decomposition chamber, reactor pipe, decomposition tube, reactor tube, hydrocarbon introduction housing, etc.). The introduction conduit 107 is fluidly coupled to the inlet conduit 104 and is configured to receive exhaust gas from the inlet conduit 104 (e.g., after flowing through the filter 106). In various embodiments, the introduction conduit 107 is coupled to the inlet conduit 104. For example, the introduction conduit 107 may be fastened (e.g., using a band, using bolts, using twist-lock fasteners, threaded, etc.), welded, riveted, or otherwise attached to the inlet conduit 104. In other embodiments, the introduction conduit 107 is integrally formed with the inlet conduit 104. As utilized herein, the terms "fastened," "fastening," and the like describe attachment (e.g., joining, etc.) of two structures in such a way that detachment (e.g., separation, etc.) of the two structures remains possible while "fastened" or after the "fastening" is completed, without destroying or damaging either or both of the two structures. In some embodiments, the inlet conduit 104 is the introduction conduit 107 (e.g., only the inlet conduit 104 is included in the exhaust gas conduit system 102 and the inlet conduit 104 functions as both the inlet conduit 104 and the introduction conduit 107). The introduction conduit 107 is centered on the conduit center axis 105 (e.g., the conduit center axis 105 extends through a center point of the introduction conduit 107, etc.). The introduction conduit 107 has a conduit diameter $d_c$. The conduit diameter de may be selected so as to tailor the aftertreatment system 100 for a target application. As utilized herein, the term "diameter" connotes a length of a chord passing through a center point of a shape (e.g., square, rectangle, hexagon, circle, pentagon, triangle, etc.).

The aftertreatment system 100 also includes a treatment fluid delivery system 108. As is explained in more detail herein, the treatment fluid delivery system 108 is configured to facilitate the introduction of a treatment fluid, such as a reductant (e.g., diesel exhaust fluid (DEF), Adblue®, a urea-water solution (UWS), an aqueous urea solution, AUS32, etc.) or a hydrocarbon (e.g., fuel, oil, additive, etc.), into the exhaust gas. When the reductant is introduced into the exhaust gas, reduction of emission of undesirable components in the exhaust gas may be facilitated. When the hydrocarbon is introduced into the exhaust gas, the temperature of the exhaust gas may be increased (e.g., to facilitate regeneration of components of the aftertreatment system 100, etc.). For example, the temperature of the exhaust gas may be increased by combusting the hydrocarbon within the exhaust gas (e.g., using a spark plug, etc.).

The treatment fluid delivery system 108 includes a dosing module 110 (e.g., doser, reductant doser, hydrocarbon doser, etc.). The dosing module 110 is configured to facilitate passage of the treatment fluid through the introduction conduit 107 and into the introduction conduit 107. The dosing module 110 may include an insulator interposed between a portion of the dosing module 110 and the portion of the introduction conduit 107 on which the dosing module 110 is mounted. In various embodiments, the dosing module 110 is coupled to the introduction conduit 107.

The treatment fluid delivery system 108 also includes a treatment fluid source 112 (e.g., reductant tank, hydrocarbon tank, etc.). The treatment fluid source 112 is configured to contain the treatment fluid. The treatment fluid source 112 is fluidly coupled to the dosing module 110 and configured to provide the treatment fluid to the dosing module 110. The treatment fluid source 112 may include multiple treatment fluid sources 112 (e.g., multiple tanks connected in series or in parallel, etc.). The treatment fluid source 112 may be, for example, a diesel exhaust fluid tank containing Adblue® or a fuel tank containing fuel.

The treatment fluid delivery system 108 also includes a treatment fluid pump 114 (e.g., supply unit, etc.). The treatment fluid pump 114 is fluidly coupled to the treatment fluid source 112 and the dosing module 110 and configured to receive the treatment fluid from the treatment fluid source 112 and to provide the treatment fluid to the dosing module 110. The treatment fluid pump 114 is used to pressurize the treatment fluid from the treatment fluid source 112 for delivery to the dosing module 110. In some embodiments, the treatment fluid pump 114 is pressure controlled. In some embodiments, the treatment fluid pump 114 is coupled to a chassis of a vehicle associated with the aftertreatment system 100.

In some embodiments, the treatment fluid delivery system 108 also includes a treatment fluid filter 116. The treatment fluid filter 116 is fluidly coupled to the treatment fluid source 112 and the treatment fluid pump 114 and is configured to receive the treatment fluid from the treatment fluid source 112 and to provide the treatment fluid to the treatment fluid pump 114. The treatment fluid filter 116 filters the treatment fluid prior to the treatment fluid being provided to internal components of the treatment fluid pump 114. For example, the treatment fluid filter 116 may inhibit or prevent the transmission of solids to the internal components of the treatment fluid pump 114. In this way, the treatment fluid filter 116 may facilitate prolonged desirable operation of the treatment fluid pump 114.

The dosing module 110 includes at least one injector 118 (e.g., insertion device, etc.). The injector 118 is fluidly coupled to the treatment fluid pump 114 and configured to receive the treatment fluid from the treatment fluid pump 114. The injector 118 is configured to dose (e.g., inject, insert, etc.) the treatment fluid received by the dosing module 110 into the exhaust gas within the introduction conduit 107 and along an injection axis 119 (e.g., within a spray cone that is centered on the injection axis 119, etc.).

In some embodiments, the treatment fluid delivery system 108 also includes an air pump 120 and an air source 122 (e.g., air intake, etc.). The air pump 120 is fluidly coupled to the air source 122 and is configured to receive air from the air source 122. The air pump 120 is fluidly coupled to the dosing module 110 and is configured to provide the air to the dosing module 110. In some applications, the dosing module 110 is configured to mix the air and the treatment fluid into an air-treatment fluid mixture and to provide the air-treatment fluid mixture to the injector 118 (e.g., for dosing into the exhaust gas within the introduction conduit 107, etc.). The injector 118 is fluidly coupled to the air pump 120 and configured to receive the air from the air pump 120. The injector 118 is configured to dose the air-treatment fluid mixture into the exhaust gas within the introduction conduit 107. In some of these embodiments, the treatment fluid delivery system 108 also includes an air filter 124. The air filter 124 is fluidly coupled to the air source 122 and the air pump 120 and is configured to receive the air from the air source 122 and to provide the air to the air pump 120. The air filter 124 is configured to filter the air prior to the air being provided to the air pump 120. In other embodiments, the treatment fluid delivery system 108 does not include the air pump 120 and/or the treatment fluid delivery system 108 does not include the air source 122. In such embodiments, the dosing module 110 is not configured to mix the treatment fluid with the air.

In various embodiments, the dosing module 110 is configured to receive air and fluid, and doses the air-treatment fluid mixture into the introduction conduit 107. In various embodiments, the dosing module 110 is configured to receive treatment fluid (and does not receive air), and doses the treatment fluid into the introduction conduit 107. In various embodiments, the dosing module 110 is configured to receive treatment fluid, and doses the treatment fluid into the introduction conduit 107. In various embodiments, the dosing module 110 is configured to receive air and treatment fluid, and doses the air-treatment fluid mixture into the introduction conduit 107.

The aftertreatment system 100 also includes a controller 126 (e.g., control circuit, driver, etc.). The dosing module 110, the treatment fluid pump 114, and the air pump 120 are also electrically or communicatively coupled to the controller 126. The controller 126 is configured to control the dosing module 110 to dose the treatment fluid or the air-treatment fluid mixture into the introduction conduit 107. The controller 126 may also be configured to control the treatment fluid pump 114 and/or the air pump 120 in order to control the treatment fluid or the air-treatment fluid mixture that is dosed into the introduction conduit 107.

The controller 126 includes a processing circuit 128. The processing circuit 128 includes a processor 130 and a memory 132. The processor 130 may include a microprocessor, an application-specific integrated circuit (ASIC), a field-programmable gate array (FPGA), etc., or combinations thereof. The memory 132 may include, but is not limited to, electronic, optical, magnetic, or any other storage or transmission device capable of providing a processor, ASIC, FPGA, etc. with program instructions. This memory 132 may include a memory chip, Electrically Erasable Programmable Read-Only Memory (EEPROM), Erasable Programmable Read Only Memory (EPROM), flash memory, or any other suitable memory from which the controller 126 can read instructions. The instructions may include code from any suitable programming language. The memory 132 may include various modules that include instructions which are configured to be implemented by the processor 130.

In various embodiments, the controller 126 is configured to communicate with a central controller 134 (e.g., engine control unit (ECU), engine control module (ECM), etc.) of an internal combustion engine having the aftertreatment system 100. In some embodiments, the central controller 134 and the controller 126 are integrated into a single controller.

In some embodiments, the central controller 134 is communicable with a display device (e.g., screen, monitor, touch screen, heads up display (HUD), indicator light, etc.). The display device may be configured to change state in response to receiving information from the central controller 134. For example, the display device may be configured to change between a static state and an alarm state based on a communication from the central controller 134. By changing state, the display device may provide an indication to a user of a status of the treatment fluid delivery system 108.

The aftertreatment system 100 also includes a mixer 136 (e.g., a swirl generating device, etc.). At least a portion of the mixer 136 is positioned within the introduction conduit 107. In some embodiments, a first portion of the mixer 136 is positioned within the inlet conduit 104 and a second portion of the mixer 136 is positioned within the introduction conduit 107.

The mixer 136 receives the exhaust gas from the inlet conduit 104 (e.g., via the introduction conduit 107, etc.). The mixer 136 also receives the treatment fluid or the air-treatment fluid mixture received from the injector 118. The mixer 136 is configured to mix the treatment fluid or the air-treatment fluid mixture with the exhaust gas. The mixer 136 is also configured to facilitate swirling (e.g., rotation, etc.) of the exhaust gas and mixing (e.g., combination, etc.) of the exhaust gas and the treatment fluid or the air-treatment fluid mixture so as to disperse the treatment fluid within the exhaust gas downstream of the mixer 136 (e.g., to obtain an increased uniformity index, etc.). By dispersing the treatment fluid within the exhaust gas using the mixer 136, reduction of emission of undesirable components in the exhaust gas is enhanced and/or an ability of the aftertreatment system 100 to increase a temperature of the exhaust gas may be enhanced.

The mixer 136 includes a mixer body 138 (e.g., shell, frame, etc.). The mixer body 138 is supported within the inlet conduit 104 and/or the introduction conduit 107. In various embodiments, the mixer body 138 is centered on the conduit center axis 105 (e.g., the conduit center axis 105 extends through a center point of the mixer body 138, etc.). In other embodiments, the mixer body 138 is centered on an axis that is separated from the conduit center axis 105. For example, the mixer body 138 may be centered on an axis that is separated from and approximately (e.g., within 5% of, etc.) parallel to the conduit center axis 105. In another example, the mixer body 138 may be centered on an axis that intersects the conduit center axis 105 and is angled relative to the conduit center axis 105 (e.g., when viewed on a plane along which the axis and the conduit center axis 105 extend, etc.).

The mixer body 138 is defined by a mixer body diameter $d_{mb}$. The mixer body diameter $d_{mb}$ may be selected based on the conduit diameter $d_c$. For example, the mixer body 138 may be configured such that the mixer body diameter $d_{mb}$ is each approximately equal to between 0.30 $d_c$ and 0.90 $d_c$, inclusive (e.g., 0.285 $d_c$, 0.30 $d_c$, 0.40 $d_c$, 0.55 $d_c$, 0.60 $d_c$, 0.70 $d_c$, 0.80 $d_c$, 0.90 $d_c$, 0.99 $d_c$, etc.).

The mixer body 138 includes a mixer inlet 140 (e.g., inlet aperture, inlet opening, etc.). The mixer inlet 140 receives the exhaust gas (e.g., from the inlet conduit 104, etc.). The mixer body 138 defines (e.g., partially encloses, etc.) a mixer cavity 142 (e.g., void, etc.). The mixer cavity 142 receives the exhaust gas from the mixer inlet 140. As is explained in more detail herein, the exhaust gas is caused to swirl within the mixer body 138.

The mixer 136 also includes an upstream vane plate 144 (e.g., upstream mixing element, mixing plate, etc.). The upstream vane plate 144 is coupled to the mixer body 138 and is disposed within the mixer cavity 142. In some embodiments, the upstream vane plate 144 is coupled to the mixer body 138 proximate the mixer inlet 140.

The upstream vane plate 144 includes a plurality of upstream vanes 146 (e.g., plates, fins, etc.). Each of the upstream vanes 146 extends within the mixer cavity 142 so as to cause the exhaust gas to swirl within the mixer cavity 142 (e.g., downstream of the upstream vane plate 144, etc.). At least one of the upstream vanes 146 is coupled to the mixer body 138. For example, an edge of one of the upstream vanes 146 may be coupled to the mixer body 138 (e.g., using spot welds, etc.).

In various embodiments, each of the upstream vanes 146 is coupled to an upstream vane hub 148 (e.g., center post, etc.). For example, the upstream vanes 146 may be coupled to the upstream vane hub 148 such that the upstream vane plate 144 is rotationally symmetric about the upstream vane hub 148. In various embodiments, the upstream vane hub 148 is centered on the conduit center axis 105 (e.g., the conduit center axis 105 extends through a center point of the upstream vane hub 148, etc.).

The upstream vane plate 144 defines a plurality of upstream vane apertures 150 (e.g., windows, holes, etc.). Each of the upstream vane apertures 150 is located between two adjacent upstream vanes 146. For example, where the upstream vane plate 144 includes four upstream vanes 146, the upstream vane plate 144 includes four upstream vane apertures 150 (e.g., a first upstream vane aperture 150 between a first upstream vane 146 and a second upstream vane 146, a second upstream vane aperture 150 between the second upstream vane 146 and a third upstream vane 146, a third upstream vane aperture 150 between the third upstream vane 146 and a fourth upstream vane 146, and a fourth upstream vane aperture 150 between the fourth upstream vane 146 and the first upstream vane 146). In various embodiments, the upstream vane plate 144 includes the same number of upstream vanes 146 and upstream vane apertures 150.

The mixer body 138 also includes a treatment fluid inlet 152 (e.g., aperture, window, hole, etc.). The treatment fluid inlet 152 is aligned with the injector 118 and the mixer body 138 is configured to receive the treatment fluid or the air-treatment fluid mixture through the treatment fluid inlet 152. The treatment fluid inlet 152 is disposed downstream of the upstream vane plate 144. As a result, the treatment fluid or the air-treatment fluid mixture flows from the injector 118, between the mixer body 138 and the introduction conduit 107, through the mixer body 138 via the treatment fluid inlet 152, and into the mixer cavity 142 (e.g., downstream of the upstream vane plate 144, etc.). The injection axis 119 extends through the treatment fluid inlet 152.

In some embodiments, the mixer body 138 also includes an exhaust gas inlet. The exhaust gas inlet is aligned with the treatment fluid inlet 152 and is configured to facilitate flow of the exhaust gas into the mixer body 138. First, the exhaust gas flows between the mixer body 138 and the introduction conduit 107, then the exhaust gas flows though the exhaust gas inlet into the mixer body 138. For example, the exhaust gas flowing through the mixer body 138 may create a vacuum at the exhaust gas inlet and this vacuum may draw the exhaust gas flowing between the mixer body 138 and the introduction conduit 107 into the mixer body 138 via the exhaust gas inlet. The flow of the exhaust gas through the exhaust gas inlet opposes the flow of the exhaust gas and the treatment fluid and/or the air-treatment fluid mixture through the treatment fluid inlet 152. In this way, the exhaust gas inlet may mitigate deposit formation on the mixer body 138.

The mixer 136 also includes a downstream vane plate 154 (e.g., downstream mixing element, mixing plate, etc.). The downstream vane plate 154 is coupled to the mixer body 138 and is disposed within the mixer cavity 142. In various embodiments, the downstream vane plate 154 is coupled to the mixer body 138 downstream of the treatment fluid inlet 152 such that the treatment fluid inlet 152 is located between the upstream vane plate 144 and the downstream vane plate 154.

The downstream vane plate 154 includes a plurality of downstream vanes 156 (e.g., plates, fins, etc.). Each of the downstream vanes 156 extends within the mixer cavity 142 so as to cause the exhaust gas to swirl within the mixer cavity 142 (e.g., downstream of the downstream vane plate 154, etc.). At least one of the downstream vanes 156 is coupled to the mixer body 138. For example, an edge of one of the downstream vanes 156 may be coupled to the mixer body 138 (e.g., using spot welds, etc.).

The downstream vane plate 154 may include more, less, or the same number of downstream vanes 156 as the upstream vane plate 144 includes of the upstream vanes 146. For example, where the upstream vane plate 144 includes five upstream vanes 146, the downstream vane plate 154 may include three, four, five, six, or other numbers of the downstream vanes 156.

In various embodiments, each of the downstream vanes 156 is coupled to a downstream vane hub 158 (e.g., center post, etc.). For example, the downstream vanes 156 may be coupled to the downstream vane hub 158 such that the downstream vane plate 154 is rotationally symmetric about the downstream vane hub 158. In various embodiments, the downstream vane hub 158 is centered on the conduit center axis 105 (e.g., the conduit center axis 105 extends through a center point of the downstream vane hub 158, etc.). In some embodiments, the downstream vane hub 158 is centered on an axis that is different from an axis on which the upstream vane hub 148 is centered. For example, the downstream vane hub 158 may be centered on an axis that is approximately parallel to and separated from an axis on which the upstream vane hub 148 is centered.

The downstream vane plate 154 defines a plurality of downstream vane apertures 160 (e.g., windows, holes, etc.). Each of the downstream vane apertures 160 is located between two adjacent downstream vanes 156. For example, where the downstream vane plate 154 includes four downstream vanes 156, the downstream vane plate 154 includes four downstream vane apertures 160 (e.g., a first downstream vane aperture 160 between a first downstream vane 156 and a second downstream vane 156, a second downstream vane aperture 160 between the second downstream vane 156 and a third downstream vane 156, a third downstream vane aperture 160 between the third downstream vane 156 and a fourth downstream vane 156, and a fourth downstream vane aperture 160 between the fourth downstream vane 156 and the first downstream vane 156). In various embodiments, the downstream vane plate 154 includes the same number of downstream vanes 156 and downstream vane apertures 160.

In various embodiments, the mixer 136 also includes a shroud 162 (e.g., cover, etc.). The shroud 162 is contiguous with the mixer body 138 and extends from the mixer body 138 towards the conduit center axis 105. The shroud 162 functions to funnel (e.g., concentrate, direct, etc.) the exhaust gas and the treatment fluid and/or the air-treatment fluid mixture towards the conduit center axis 105.

The shroud 162 includes a mixer outlet 164 (e.g., outlet aperture, outlet opening, etc.). The mixer outlet 164 provides the exhaust gas and the treatment fluid and/or the air-treatment fluid mixture out of the shroud 162, and therefore out of the mixer body 138. Due to the upstream vane plate 144 and the downstream vane plate 154, the exhaust gas exiting the mixer outlet 164 is caused to swirl.

The mixer outlet 164 is disposed along a mixer outlet plane 165. The conduit center axis 105 extends through the mixer outlet plane 165. In various embodiments, the conduit center axis 105 is orthogonal to the mixer outlet plane 165.

The aftertreatment system 100 also includes an upstream support flange 168 (e.g., panel, coupler, ring, etc.). The upstream support flange 168 is coupled to the mixer body 138 proximate the mixer inlet 140. The upstream support flange 168 is also coupled to the introduction conduit 107. The upstream support flange 168 functions to separate the mixer body 138 from the introduction conduit 107 and support the mixer 136 within the introduction conduit 107.

The upstream support flange 168 includes a plurality of upstream support flange apertures 170 (e.g., windows, holes, etc.). Each of the upstream support flange apertures 170 is configured to facilitate passage of the exhaust gas through the upstream support flange 168. As a result, the exhaust gas may flow between the mixer body 138 and the introduction conduit 107.

In various embodiments, the upstream support flange 168 is configured to prevent flow of the exhaust gas between the mixer body 138 and the introduction conduit 107 (e.g., less than 1% of the exhaust gas flowing between the mixer body 138 and the introduction conduit 107 flows between the upstream support flange 168 and the mixer body 138 and between the upstream support flange 168 and the introduction conduit 107, etc.).

At least a portion of the exhaust gas flowing between the mixer body 138 and the introduction conduit 107 enters the mixer body 138 via the treatment fluid inlet 152. For example, the exhaust gas flowing through the mixer body 138 may create a vacuum at the treatment fluid inlet 152 and this vacuum may draw the exhaust gas flowing between the mixer body 138 and the introduction conduit 107 into the mixer body 138 via the treatment fluid inlet 152. The exhaust gas entering the mixer body via the treatment fluid inlet 152 may assist in propelling the treatment fluid and/or the air-treatment fluid mixture provided by the injector 118 into the mixer cavity 142 (e.g., between the upstream vane plate 144 and the downstream vane plate 154, etc.).

The aftertreatment system 100 also includes a midstream support flange 172 (e.g., panel, coupler, ring, etc.). The midstream support flange 172 is coupled to the mixer body 138 downstream of the treatment fluid inlet 152. The midstream support flange 172 is also coupled to the introduction conduit 107. The midstream support flange 172 functions to separate the mixer body 138 from the introduction conduit 107 and support the mixer 136 within the introduction conduit 107.

In various embodiments, the midstream support flange 172 is configured to prevent flow of the exhaust gas and the treatment fluid and/or the air-treatment fluid mixture between the mixer body 138 and the introduction conduit 107 (e.g., less than 1% of the exhaust gas and the treatment fluid and/or the air-treatment fluid mixture flowing between the mixer body 138 and the introduction conduit 107 flows between the midstream support flange 172 and the mixer body 138 and between the midstream support flange 172 and the introduction conduit 107, etc.). In this way, the midstream support flange 172 functions to direct the exhaust gas and the treatment fluid and/or the air-treatment fluid mixture flowing between the mixer body 138 and the introduction conduit 107 into the mixer body 138 via the treatment fluid inlet 152 (e.g., rather than facilitating bypassing of the mixer body 138 using apertures formed in the midstream support flange 172, etc.).

In various embodiments, the midstream support flange 172 includes a plurality of midstream support flange apertures 173 (e.g., windows, holes, etc.). Each of the midstream support flange apertures 173 is configured to facilitate passage of the exhaust gas through the midstream support flange 172. As a result, the exhaust gas may flow between the mixer body 138 and the introduction conduit 107 downstream of the treatment fluid inlet 152.

The aftertreatment system 100 also includes a downstream support flange 174 (e.g., panel, coupler, ring, etc.). The downstream support flange 174 is coupled to the shroud 162. The downstream support flange 174 is also coupled to the introduction conduit 107. The downstream support flange 174 functions to separate the shroud 162 from the introduction conduit 107 and support the mixer 136 within the introduction conduit 107.

In various embodiments, the downstream support flange 174 is configured to prevent (e.g., less than 1% of the exhaust gas and the treatment fluid and/or the air-treatment fluid mixture flowing between the mixer body 138 and the introduction conduit 107 flows between the downstream support flange 174 and the mixer body 138 and between the downstream support flange 174 and the introduction conduit 107, etc.) flow of the exhaust gas and the treatment fluid and/or the air-treatment fluid mixture between the shroud 162 and the introduction conduit 107. In this way, the downstream support flange 174 functions to prevent flow of the exhaust gas and the treatment fluid and/or the air-treatment fluid mixture exiting the mixer outlet 164 from flowing back upstream towards the mixer inlet 140.

In various embodiments, the downstream support flange 174 includes a plurality of downstream support flange apertures 175 (e.g., windows, holes, etc.). Each of the downstream support flange apertures 175 is configured to facilitate passage of the exhaust gas through the downstream support flange 174. As a result, the exhaust gas may flow between the mixer body 138 and the introduction conduit 107.

The exhaust gas conduit system 102 also includes a transfer conduit 176. The transfer conduit 176 is fluidly coupled to the introduction conduit 107 and is configured to receive the exhaust gas from the introduction conduit 107. In various embodiments, the transfer conduit 176 is coupled to the introduction conduit 107. For example, the transfer conduit 176 may be fastened, welded, riveted, or otherwise attached to the introduction conduit 107. In other embodiments, the transfer conduit 176 is integrally formed with the introduction conduit 107. In some embodiments, the introduction conduit 107 is the transfer conduit 176 (e.g., only the introduction conduit 107 is included in the exhaust gas conduit system 102 and the introduction conduit 107 functions as both the introduction conduit 107 and the transfer conduit 176). The transfer conduit 176 is centered on the conduit center axis 105 (e.g., the conduit center axis 105 extends through a center point of the transfer conduit 176, etc.).

The aftertreatment system 100 also includes a mixing flange 178 (e.g., annular flange, mixing plate, etc.). As is explained in more detail herein, the mixing flange 178 is configured to provide an additional mechanism (e.g., in addition to the mixer 136, etc.) for mixing the exhaust gas and the treatment fluid and/or the air-treatment fluid mixture.

The mixing flange 178 includes a mixing flange body 180 (e.g., frame, etc.). The mixing flange body 180 is coupled to the transfer conduit 176. In various embodiments, the mixing flange body 180 is configured to prevent flow of the exhaust gas and the treatment fluid and/or the air-treatment fluid mixture between the mixing flange body 180 and the transfer conduit 176 (e.g., less than 1% of the exhaust gas and the treatment fluid and/or the air-treatment fluid mixture flowing within the transfer conduit 176 flows between the mixing flange body 180 and the transfer conduit 176, etc.).

The mixing flange 178 includes a mixing flange opening 182 (e.g., window, hole, aperture etc.). The mixing flange opening 182 extends through the mixing flange body 180 and facilitates flow of the exhaust gas and the treatment fluid and/or the air-treatment fluid mixture through the mixing flange 178. In various embodiments, the mixing flange 178 is configured such that the mixing flange opening 182 is centered on the conduit center axis 105. As a result, flow of the exhaust gas and the treatment fluid and/or the air-treatment fluid mixture through the mixing flange opening 182 may be balanced.

The mixing flange opening 182 has a mixing flange opening diameter $d_{mf}$. The mixing flange opening diameter $d_{mf}$ may be selected based on the conduit diameter $d_c$. For example, the mixing flange 178 may be configured such that the mixing flange opening diameter $d_{mf}$ is approximately equal to between 0.30 $d_c$ and 0.95 $d_c$, inclusive (e.g., 0.285 $d_c$, 0.30 $d_c$, 0.35 $d_c$, 0.40 $d_c$, 0.57 $d_c$, 0.60 $d_c$, 0.70 $d_c$, 0.75 $d_c$, 0.80 $d_c$, 0.90 $d_c$, 0.95 $d_c$, $d_c$, etc.).

The mixing flange 178 includes a mixing flange downstream surface 184 (e.g., face, etc.). The mixing flange downstream surface 184 is contiguous with the mixing flange opening 182 and the transfer conduit 176. As the exhaust gas and the treatment fluid and/or the air-treatment fluid mixture flows through the mixing flange opening 182, the exhaust gas and the treatment fluid and/or the air-treatment fluid mixture is gradually caused to flow towards the transfer conduit 176 due to the Coandă effect. Specifically, the mixing flange 178 functions as a nozzle, with the mixing flange opening 182 being an outlet of the nozzle, and the exhaust gas and the treatment fluid and/or the air-treatment fluid mixture is caused to flow towards the transfer conduit 176 after flowing through the mixing flange opening. As a result of the Coandă effect, vortices are formed along the mixing flange downstream surface 184. These vortices cause swirling of the exhaust gas and the treatment fluid and/or the air-treatment fluid mixture downstream of the mixing flange 178. In this way, the mixing flange 178 is configured to provide an additional mechanism (e.g., in addition to the mixer 136, etc.) for mixing the exhaust gas and the treatment fluid and/or the air-treatment fluid mixture. Additionally, the Coandă effect creates a virtual surface due to shear between recirculating flow of the exhaust gas and the treatment fluid and/or the air-treatment fluid mixture (e.g., within the vortices, etc.) and the flow of the exhaust gas and the treatment fluid and/or the air-treatment fluid mixture flowing through the mixing flange opening 182.

The mixing flange downstream surface 184 is separated from the mixer outlet 164 by a mixing flange separation distance $S_{mf}$. The mixing flange separation distance $S_{mf}$ may be selected based on the conduit diameter de. For example, the mixing flange 178 may be configured such that the mixing flange separation distance $S_{mf}$ is approximately equal to between 0.10 $d_c$ and 0.50 $d_c$, inclusive (e.g., 0.09 $d_c$, 0.10 $d_c$, 0.20 $d_c$, 0.30 $d_c$, 0.40 $d_c$, 0.45 $d_c$, 0.50 $d_c$, 0.525 $d_c$, etc.).

Figure 2:
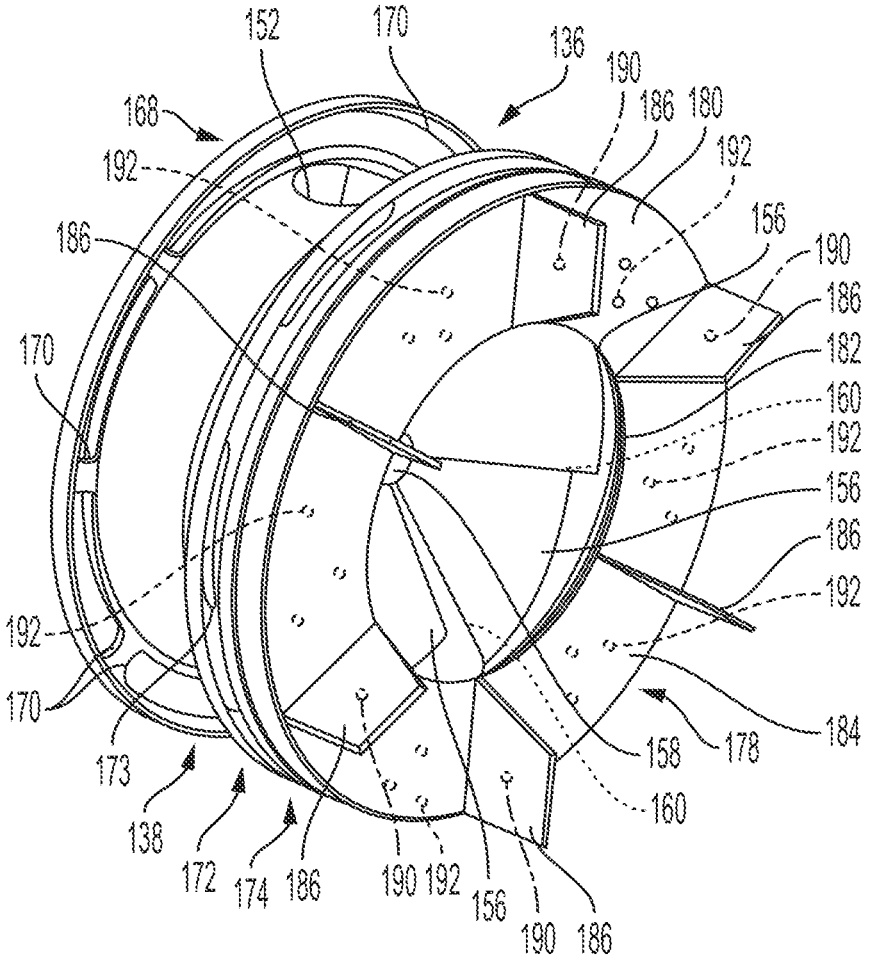
FIG. 2 is a perspective view of a portion of an example aftertreatment system including a mixing flange.

In various embodiments, such as is shown in FIGS. 1 and 2, the mixing flange 178 also includes one or more flow disrupters 186 (e.g., protrusions, projections, protuberances, ribs, fins, guides, etc.). Each of the flow disrupters 186 is coupled to or integrally formed with the mixing flange downstream surface 184. For example, the flow disrupters 186 may be welded or fastened to the mixing flange downstream surface 184. In another example, the flow disrupters 186 are formed in the mixing flange downstream surface 184 via a bending process in which portions of the mixing flange 178 are bent away from the mixer 136.

Each of the flow disrupters 186 extends (e.g., protrudes, projects, etc.) inwardly from an inner surface 188 (e.g., face, etc.) of the transfer conduit 176. As a result, the exhaust gas flowing within the transfer conduit 176 is caused to flow around the flow disrupters 186. By flowing around the flow disrupters 186, the swirl of the exhaust gas that is provided by the mixing flange 178 (e.g., due to the Coandă effect, etc.) is disrupted (e.g., broken up, etc.). This disruption causes the exhaust gas to tumble (e.g., mix, etc.) downstream of the flow disrupters 186. In addition to the swirl provided by the mixer 136 and the swirl provided by the mixing flange 178 (e.g., due to the Coandă effect, etc.), this tumbling provides another mechanism for mixing of the exhaust gas and the treatment fluid and/or the air-treatment fluid mixture. By variously configuring the flow disrupters 186, a target mixing of the exhaust gas and the treatment fluid and/or the air-treatment fluid mixture can be achieved.

As a result, the flow disrupters 186 are capable of increasing a uniformity index (UI) of the treatment fluid in the exhaust gas without substantially increasing a pressure drop produced by the mixer 136, a wall-film of the mixer 136, or deposits formed by the mixer 136, compared to other mixing devices. Additionally, the configurations of each of the flow disrupters 186 may be selected so as to minimize manufacturing requirements and decrease weight of the mixer 136 and low frequency modes when compared to other mixer devices. Furthermore, the mixer 136 may be variously configured while utilizing the flow disrupters 186 (e.g., the flow disrupters 186 do not substantially limit a configuration of the mixer 136, etc.).

FIG. 2 illustrates an example where the flow disrupters 186 are plate-shaped (e.g., shaped as trapezoidal prisms, etc.). However, the flow disrupters 186 may be variously shaped such that the aftertreatment system 100 is tailored for a target application. For example, the flow disrupters 186 may be frustoconical, shaped as rectangular prisms, cylindrical, shaped as a frustum of a pyramid, or otherwise similarly shaped.

Each of the flow disrupters 186 extends at an angle relative to the mixing flange downstream surface 184. In some embodiments, such as shown in FIG. 2, each of the flow disrupters 186 extends orthogonally from the mixing flange downstream surface 184. However, in some embodiments, one or more of the flow disrupters 186 extends at an acute angle relative to the mixing flange downstream surface 184. Such angling of the flow disrupters 186 may generate additional mixing of the exhaust gas and the treatment fluid and/or the air-treatment fluid mixture. Additionally, angles of each of the flow disrupters 186 may be selected based on angles of the other flow disrupters 186 so that all of the flow disrupters 186 cooperatively generate additional mixing of the exhaust gas and the treatment fluid and/or the air-treatment fluid mixture. In an example where there are three of the flow disrupters 186, each of the flow disrupters 186 may be angled relative to the mixing flange downstream surface 184 at an angle of between 30 degrees (°) and 80°, inclusive.

Additionally, as shown in FIG. 2, each of the flow disrupters 186 may have an edge that is contiguous with the mixing flange opening 182. However, in some embodiments, an edge of one or more of the flow disrupters 186 is separated from the mixing flange opening 182.

A downstream edge of each of the flow disrupters 186 is separated from the mixer outlet plane 165 by a separation $S_{fd}$. The separation $S_{fd}$ for each of the flow disrupters 186 may be independently selected such that the aftertreatment system 100 is tailored for a target application.

Additionally, a center point 190 (e.g., apex, etc.) of each of the flow disrupters 186 may be angularly separated from the injection axis 119 by an angular separation $\alpha_{fd}$ when measured along a plane that is orthogonal to the conduit center axis 105. This plane may be approximately parallel to the mixer outlet plane 165 and/or a plane along which the injection axis 119 is disposed. The angular separation $\alpha_{fd}$ for each of the flow disrupters 186 may be selected independent of the angular separation $\alpha_{fd}$ for others of the flow disrupters 186 such that the aftertreatment system 100 is tailored for a target application. In various embodiments, the angular separation $\alpha_{fd}$ for each of the flow disrupters 186 is approximately equal to between 0° and 270°, inclusive (e.g., 0°, 45°, 55°, 65°, 75°, 90°, 120°, 150°, 180°, 220°, 270°, 283.5°, etc.).

Furthermore, each of the flow disrupters 186 is also defined by a radial height $h_{rfd}$. The radial height $h_{rfd}$ is measured from each center point 190 to the transfer conduit 176 along an axis that is orthogonal to the conduit center axis 105, and intersects the conduit center axis 105, the center point 190, and the transfer conduit 176.

The radial height $h_{rfd}$ influences how far each of the flow disrupters 186 projects into the transfer conduit 176, and therefore how much each of the flow disrupters 186 impacts the exhaust gas and the treatment fluid and/or the air-treatment fluid mixture. For example, the greater the radial height $h_{rfd}$, the more disruption that the flow disrupter 186 causes to the exhaust gas and the treatment fluid and/or the air-treatment fluid mixture. The radial height $h_{rfd}$ for each of the flow disrupters 186 may be independently selected such that the aftertreatment system 100 is tailored for a target application. In this way, for example, an ability of each of the flow disrupter 186 to cause mixing of the exhaust gas and the treatment fluid and/or the air-treatment fluid mixture may be selected so as to tailor the aftertreatment system 100 for a target application.

The radial height $h_{rfd}$ may be selected based on the conduit diameter $d_c$. For example, the flow disrupters 186 may be configured such that the radial height $h_{rfd}$ are each approximately equal to between 0.05 $d_c$ and 0.30 $d_c$, inclusive (e.g., 0.0475 $d_c$, 0.05 $d_c$, 0.08 $d_c$, 0.12 $d_c$, 0.15 $d_c$, 0.20 $d_c$, 0.25 $d_c$, 0.30 $d_c$, 0.315 $d_c$, etc.). In some applications, the flow disrupters 186 may be configured such that the radial height $h_{rfd}$ are each approximately equal to between 0.08 $d_c$ and 0.25 $d_c$, inclusive (e.g., 0.076 $d_c$, 0.08 $d_c$, 0.15 $d_c$, 0.20 $d_c$, 0.25 $d_c$, 0.2625 $d_c$, etc.).

In some applications, the radial height $h_{rfd}$ for all of the flow disrupters 186 are equal. In other embodiments, the radial height $h_{rfd}$ for each of the flow disrupters 186 is different from the radial height $h_{rfd}$ for the others of the flow disrupters 186. For example, where four of the flow disrupters 186 are included, the first flow disrupter 186 may have a first radial height $h_{rfd}$, the second flow disrupter 186 may have a second radial height 1.05 $h_{rfd}$, the third flow disrupter 186 may have a third radial height 1.1 $h_{rfd}$, and the fourth flow disrupter 186 may have a fourth radial height 1.15 $h_{rfd}$.

Each of the flow disrupters 186 is also defined by an angular height $h_{afd}$. The angular height $h_{afd}$ is measured from each center point 190 to the transfer conduit 176 along an axis that extends along at least a portion of the flow disrupter 186 and intersects the conduit center axis 105, the center point 190, and the transfer conduit 176.

The angular height $h_{afd}$ influences how gradual the flow disrupters 186 transitions from the transfer conduit 176 to the center point 190, and therefore how much each of the flow disrupters 186 impacts the exhaust gas and the treatment fluid and/or the air-treatment fluid mixture. For example, the lower the angular height ha, the more intense the transition (e.g., the greater the slope of the flow disrupter 186, etc.) from the transfer conduit 176 to the center point 190 for the same radial height $h_{rfd}$. The angular height $h_{afd}$ for each of the flow disrupters 186 may be independently selected such that the aftertreatment system 100 is tailored for a target application. In this way, for example, an ability of each of the flow disrupter 186 to cause mixing of the exhaust gas and the treatment fluid and/or the air-treatment fluid mixture may be selected so as to tailor the aftertreatment system 100 for a target application.

In various embodiments, the angular height $h_{afd}$ for each of the flow disrupters 186 is approximately equal to between 15° and 70°, inclusive (e.g., 14.25°, 15°, 20°, 30°, 48.5°, 50°, 55°, 60°, 70°, 73.5°, etc.). In some embodiments, the angular height $h_{afd}$ for each of the flow disrupters 186 is approximately equal to between 30° and 60°, inclusive (e.g., 28.5°, 30°, 45°, 48.5°, 55°, 60°, 63°, etc.).

In some applications, the angular heights $h_{afd}$ for all of the flow disrupters 186 are equal. In other embodiments, the angular height $h_{afd}$ for each of the flow disrupters 186 is different from the angular heights $h_{afd}$ for the others of the flow disrupters 186. For example, where four of the flow disrupters 186 are included, the first flow disrupter 186 may have a first angular height $h_{afd}$, the second flow disrupter 186 may have a second angular height 1.05 $h_{afd}$, the third flow disrupter 186 may have a third angular height 1.1 $h_{afd}$, and the fourth flow disrupter 186 may have a fourth angular height 1.15 $h_{afd}$.

Additionally, each of the flow disrupters 186 is also defined by a width $w_{fd}$. The width $w_{fd}$ is measured between opposite ends of the downstream edge of each flow disrupter 186. The width $w_{fd}$ influences how far each of the flow disrupters 186 projects into the transfer conduit 176, and therefore how much each of the flow disrupters 186 impacts the exhaust gas and the treatment fluid and/or the air-treatment fluid mixture. For example, the greater the width $w_{fd}$, the more disruption that the flow disrupter 186 causes to the exhaust gas and the treatment fluid and/or the air-treatment fluid mixture. The width $w_{fd}$ for each of the flow disrupters 186 may be independently selected such that the aftertreatment system 100 is tailored for a target application. In this way, for example, an ability of each of the flow disrupter 186 to cause mixing of the exhaust gas and the treatment fluid and/or the air-treatment fluid mixture may be selected so as to tailor the aftertreatment system 100 for a target application.

The width $w_{fd}$ may be selected based on the conduit diameter $d_c$. For example, the flow disrupters 186 may be configured such that the widths $w_{fd}$ are each approximately equal to between 0.10 $d_c$ and 0.70 $d_c$, inclusive (e.g., 0.095 $d_c$, 0.10 $d_c$, 0.15 $d_c$, 0.33 $d_c$, 0.50 $d_c$, 0.60 $d_c$, 0.70 $d_c$, 0.735 $d_c$, etc.). In some applications, the flow disrupters 186 may be configured such that the widths $w_{fd}$ are each approximately equal to between 0.15 $d_c$ and 0.60 $d_c$, inclusive (e.g., 0.1425 $d_c$, 0.15 $d_c$, 0.33 $d_c$, 0.60 $d_c$, 0.63 $d_c$, etc.).

In some applications, the widths $w_{fd}$ for all of the flow disrupters 186 are equal. In other embodiments, the $w_{fd}$ for each of the flow disrupters 186 is different from the $w_{fd}$ for the others of the flow disrupters 186. For example, where four of the flow disrupters 186 are included, the first flow disrupter 186 may have a first width $w_{fd}$, the second flow disrupter 186 may have a second width 1.05 $w_{fd}$, the third flow disrupter 186 may have a third width 1.1 $w_{fd}$, and the fourth flow disrupter 186 may have a fourth width 1.15 $w_{fd}$.

In some embodiments, the flow disrupters 186 include perforations (e.g., apertures, holes, etc.). The perforations are configured to facilitate flow of the exhaust gas through the flow disrupters 186. The perforations may enable flow of the exhaust gas to targeted locations downstream of the mixing flange 178 and/or may decrease a backpressure of the aftertreatment system 100.

Figure 3:
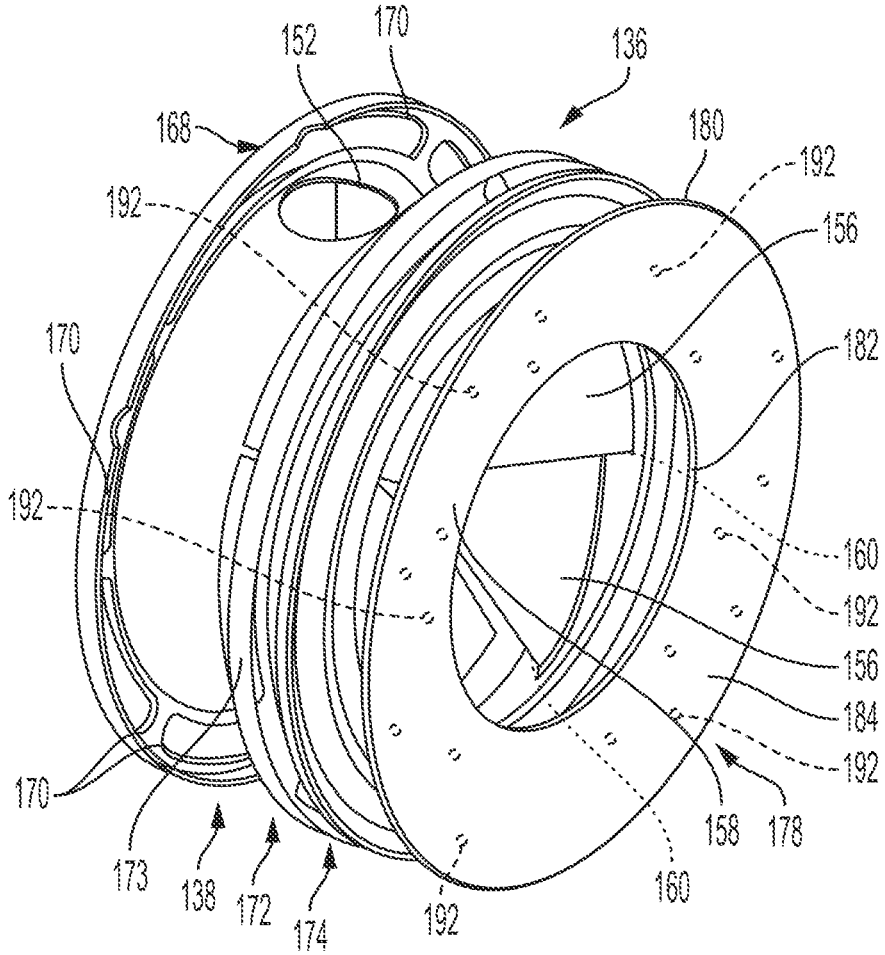
FIG. 3 is a perspective view of a portion of an example aftertreatment system including a mixing flange.
Figure 4:
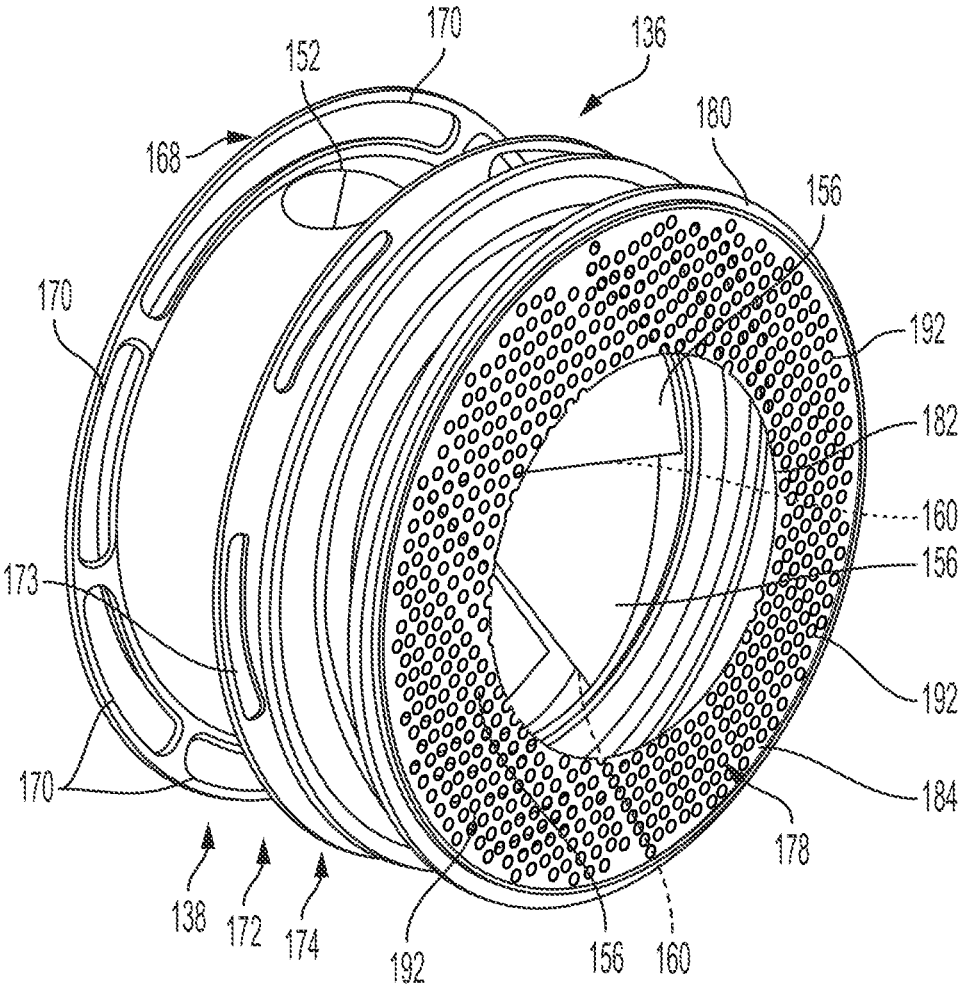
FIG. 4 is a perspective view of a portion of an example aftertreatment system including a mixing flange.

In some embodiments, such as is shown in FIGS. 3 and 4, the mixing flange 178 does not include any of the flow disrupters 186. Such embodiments may be beneficial in applications where mixing generated by the mixing flange opening 182 (e.g., due to the Coandă effect, etc.) is sufficient and/or where minimizing cost associated with manufacturing of the mixing flange 178 is desired.

In various embodiments, such as is shown in FIGS. 1-4, the mixing flange 178 also includes one or more mixing flange perforations 192 (e.g., holes, windows, etc.). Each of the mixing flange perforations 192 extends through the mixing flange body 180 and facilitates flow of the exhaust gas and the treatment fluid and/or the air-treatment fluid mixture through the mixing flange 178. In this way, the exhaust gas and the treatment fluid and/or the air-treatment fluid mixture may flow through the mixing flange 178 via the mixing flange opening 182 or one of the mixing flange perforations 192. The mixing flange perforations 192 may enable flow of the exhaust gas to targeted locations downstream of the mixing flange 178 and/or may decrease a backpressure of the aftertreatment system 100.

In some embodiments, the aftertreatment system 100 includes a plurality of the mixing flanges 178. Each of the mixing flanges 178 may be configured independently of the other mixing flanges 178 such that the aftertreatment system 100 is tailored for a target application. In an example where the aftertreatment system 100 includes two mixing flanges 178, the upstream mixing flange 178 may not include the mixing flange perforations 192 and the downstream mixing flange 178 may include the mixing flange perforations 192. In another example where the aftertreatment system 100 includes two mixing flanges 178, the upstream mixing flange 178 may not include the flow disrupters 186 and the downstream mixing flange 178 may include the flow disrupters 186.

Figure 5:
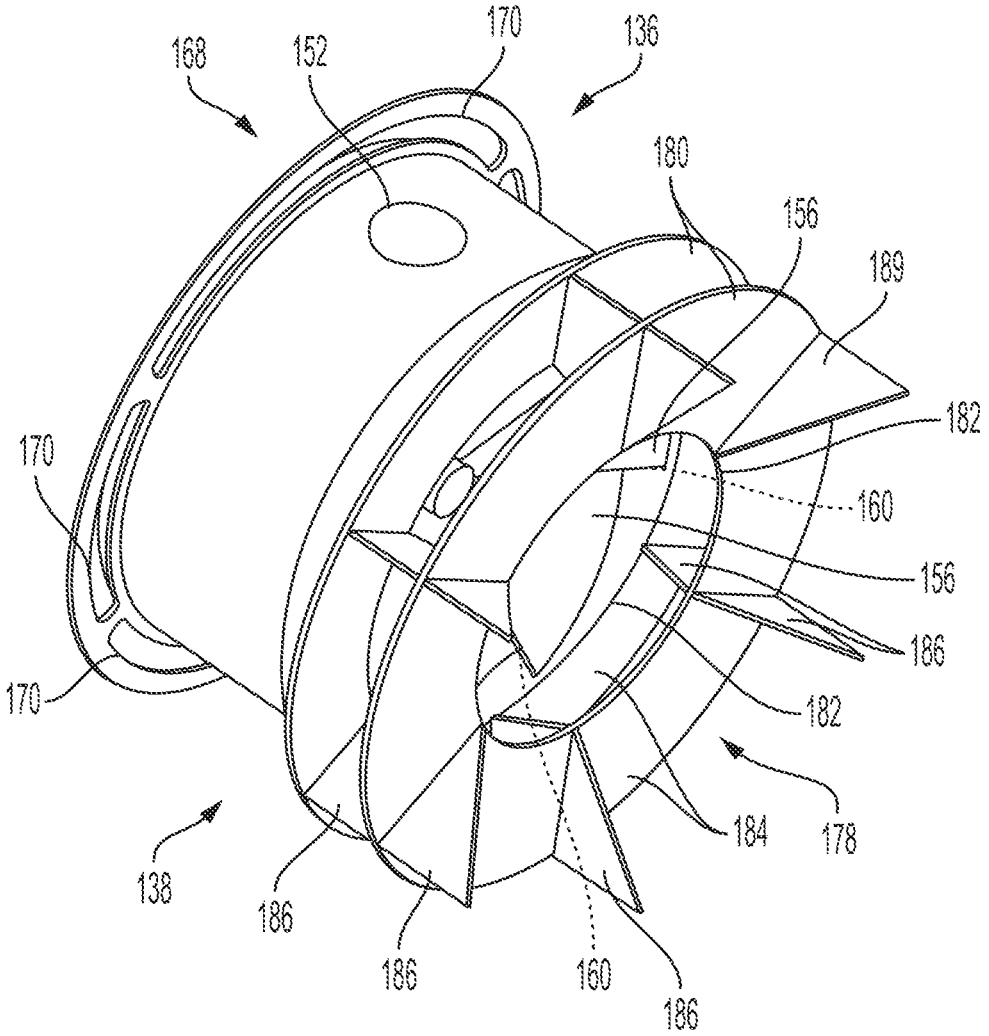
FIG. 5 is a perspective view of a portion of an example aftertreatment system including a mixing flange.

FIG. 5 illustrates an embodiment where the aftertreatment system 100 includes two of the mixing flanges 178. As shown in FIG. 5, both of the mixing flanges 178 include the flow disrupters 186, and the flow disrupters 186 on the first mixing flange 178 extend between the first mixing flange 178 and the second mixing flange 178. In some applications, the flow disrupters 186 on the first mixing flange 178 are coupled to the second mixing flange 178. In some applications, the flow disrupters 186 that extend towards the first mixing flange 178 are coupled to the second mixing flange 178, rather than being coupled to the first mixing flange 178. In some applications, the flow disrupters 186 on the first mixing flange 178 are aligned with the flow disrupters 186 on the second mixing flange 178. In other applications, the flow disrupters 186 on the first mixing flange 178 are offset relative to the flow disrupters 186 on the second mixing flange 178.

In various embodiments, the aftertreatment system 100 also includes a perforated plate 194 (e.g., straightening plate, flow straightener, etc.). The perforated plate 194 is coupled to the transfer conduit 176 downstream of the mixing flange 178. The perforated plate 194 extends across the transfer conduit 176. In various embodiments, the perforated plate 194 extends along a plane that is approximately parallel to a plane that the upstream support flange 168 extends along, a plane that the midstream support flange 172 extends along, and/or a plane that the downstream support flange 174 extends along.

The perforated plate 194 includes a plurality of perforations 196 (e.g., holes, apertures, windows, etc.). Each of the perforations 196 facilitates passage of the exhaust gas and the treatment fluid and/or the air-treatment fluid mixture through the perforated plate 194. The perforated plate 194 is configured such that flow of the exhaust gas and the treatment fluid and/or the air-treatment fluid mixture between the perforated plate 194 and the transfer conduit 176 is substantially prevented (e.g., less than 1% of the exhaust gas and the treatment fluid and/or the air-treatment fluid mixture flows between the perforated plate 194 and the transfer conduit 176, etc.).

The perforations 196 function to straighten flow of the exhaust gas and the treatment fluid and/or the air-treatment fluid mixture downstream of the perforated plate 194. For example, the exhaust gas and the treatment fluid and/or the air-treatment fluid mixture may be tumbling upstream of the perforated plate 194 (e.g., due to the Coandă effect provided by the mixing flange 178, due to the flow disrupters 186, etc.), may flow through the perforated plate 194 via the perforations 196, and then may flow along relatively straight flow paths downstream of the perforated plate 194.

The perforated plate 194 may be variously configured so as to be tailored for a target application. For example, a number of the perforations 196, locations of each of the perforations 196, and/or sizes (e.g., diameters, etc.) of each of the perforations 196 may be individually selected such that the perforated plate 194 is tailored for a target application. By variously locating the perforations 196, the exhaust gas and the treatment fluid and/or the air-treatment fluid mixture can be directed to target locations downstream of the perforated plate 194 because of the straight flow paths.

In some embodiments where the mixing flange 178 includes the mixing flange perforations 192, the aftertreatment system 100 does not include the perforated plate 194.

The aftertreatment system 100 also includes a catalyst member 198 (e.g., conversion catalyst member, selective catalytic reduction (SCR) catalyst member, catalyst metals, etc.). The catalyst member 198 is coupled to the transfer conduit 176. For example, the catalyst member 198 may be disposed within a shell (e.g., housing, sleeve, etc.) which is press-fit within the transfer conduit 176.

In various embodiments, the catalyst member 198 is configured to cause decomposition of components of the exhaust gas using reductant (e.g., via catalytic reactions, etc.). In these embodiments, the treatment fluid provided by the dosing module 110 is reductant. Specifically, the reductant that has been provided into the exhaust gas by the injector 118 undergoes the processes of evaporation, thermolysis, and hydrolysis to form non-$NO_x$ emissions within the transfer conduit 176 and/or the catalyst member 198. In this way, the catalyst member 198 is configured to assist in the reduction of $NO_x$ emissions by accelerating a $NO_x$ reduction process between the reductant and the $NO_x$ of the exhaust gas into diatomic nitrogen, water, and/or carbon dioxide. The catalyst member 198 may include, for example, platinum, rhodium, palladium, or other similar materials. In some embodiments, the catalyst member 198 is a ceramic conversion catalyst member.

In various embodiments, the catalyst member 198 is configured to oxidize a hydrocarbon and/or carbon monoxide in the exhaust gas and the treatment fluid and/or the air-treatment fluid mixture. In these embodiments, the catalyst member 198 includes an oxidation catalyst member (e.g., a diesel oxidation catalyst (DOC), etc.). For example, the catalyst member 198 may be an oxidation catalyst member that is configured to facilitate conversion of carbon monoxide in the exhaust gas and the treatment fluid and/or the air-treatment fluid mixture into carbon dioxide.

In various embodiments, the catalyst member 198 may include multiple portions. For example, the catalyst member 198 may include a first portion that includes platinum and a second portion that includes rhodium. By including multiple portions, an ability of the catalyst member 198 to facilitate treatment of the exhaust gas may be tailored for a target application.

The exhaust gas conduit system 102 also includes an outlet conduit 200. The outlet conduit 200 is fluidly coupled to the transfer conduit 176 and is configured to receive the exhaust gas from the transfer conduit 176. In various embodiments, the outlet conduit 200 is coupled to the transfer conduit 176. For example, the outlet conduit 200 may be fastened, welded, riveted, or otherwise attached to the transfer conduit 176. In other embodiments, the outlet conduit 200 is integrally formed with the transfer conduit 176. In some embodiments, the transfer conduit 176 is the outlet conduit 200 (e.g., only the transfer conduit 176 is included in the exhaust gas conduit system 102 and the transfer conduit 176 functions as both the transfer conduit 176 and the outlet conduit 200). The outlet conduit 200 is centered on the conduit center axis 105 (e.g., the conduit center axis 105 extends through a center point of the outlet conduit 200, etc.).

In various embodiments, the exhaust gas conduit system 102 only includes a single conduit which functions as the inlet conduit 104, the introduction conduit 107, the transfer conduit 176, and the outlet conduit 200.

In various embodiments, the aftertreatment system 100 also includes a sensor 202 (e.g., sensing unit, detector, flow rate sensor, mass flow rate sensor, volumetric flow rate sensor, velocity sensor, pressure sensor, temperature sensor, thermocouple, hydrocarbon sensor, $NO_x$ sensor, CO sensor, $CO_2$ sensor, $O_2$ sensor, particulate sensor, nitrogen sensor, etc.). The sensor 202 is coupled to the transfer conduit 176 and is configured to measure (e.g., sense, detect, etc.) a parameter (e.g., flow rate, mass flow rate, volumetric flow rate, velocity, pressure, temperature, hydrocarbon concentration, $NO_x$ concentration, CO concentration, $CO_2$ concentration, $O_2$ concentration, particulate concentration, nitrogen concentration, etc.) of the exhaust gas and the treatment fluid and/or the air-treatment fluid mixture within the transfer conduit 176. In various embodiments, the sensor 202 is located adjacent the mixing flange downstream surface 184. In this way, the sensor 202 may be located within or proximate to a vortex formed by the mixing flange 178.

The sensor 202 is electrically or communicatively coupled to the controller 126 and is configured to provide a signal associated with the parameter to the controller 126. The controller 126 (e.g., via the processing circuit 128, etc.) is configured to determine the parameter based on the signal. The controller 126 may be configured to control the dosing module 110, the treatment fluid pump 114, and/or the air pump 120 based on the signal. Furthermore, the controller 126 may be configured to communicate the signal to the central controller 134.

While the aftertreatment system 100 has been shown and described in the context of use with a diesel internal combustion engine, the aftertreatment system 100 may be used with other internal combustion engines, such as gasoline internal combustion engines, hybrid internal combustion engines, propane internal combustion engines, dual-fuel internal combustion engines, and other similar internal combustion engines.

III. Overview of Second Example Aftertreatment Systems

Figure 6:
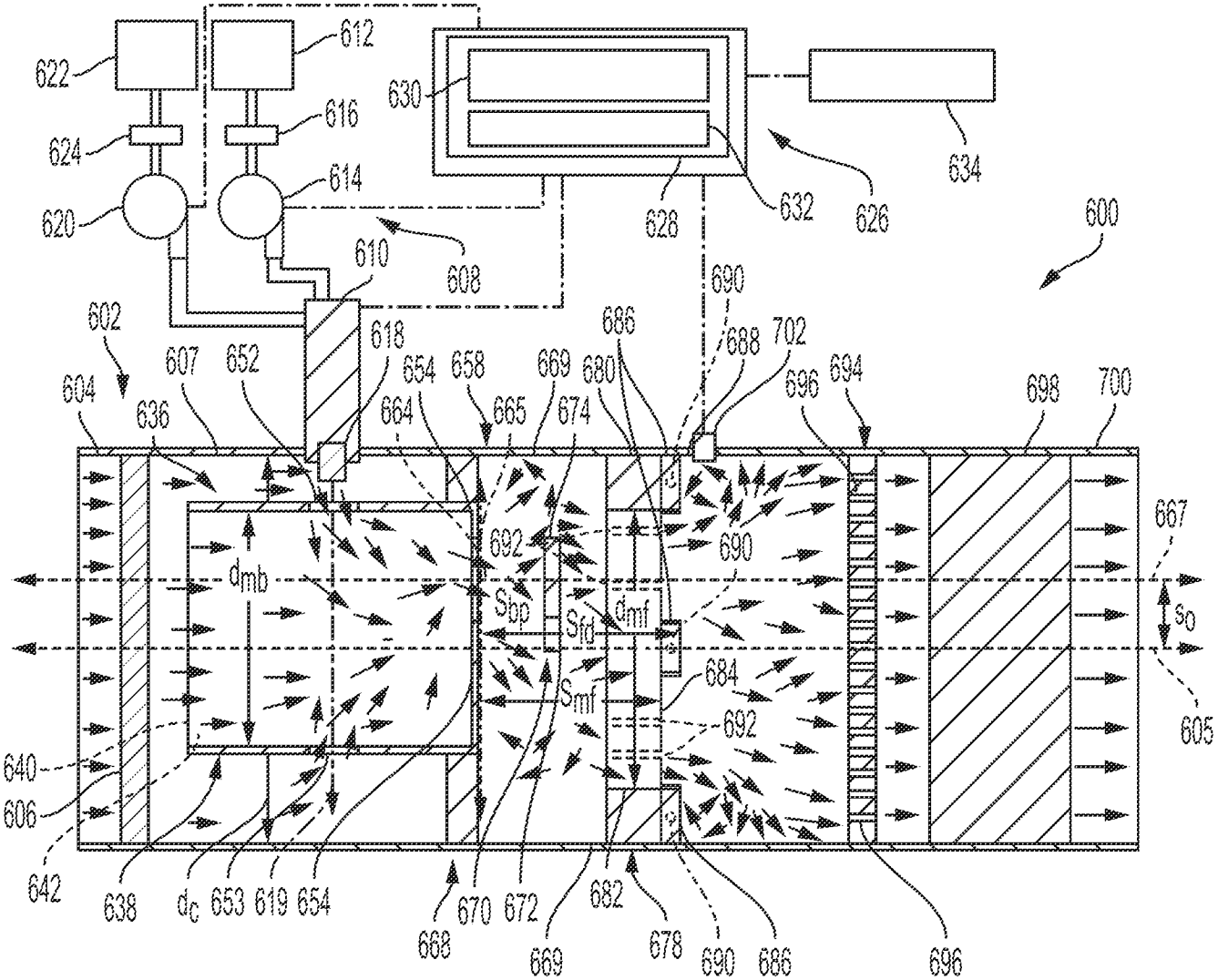
FIG. 6 is a cross-sectional view of a portion of an example aftertreatment system including a mixing flange.

FIG. 6 depicts an aftertreatment system 600 (e.g., treatment system, etc.) for treating exhaust gas produced by an internal combustion engine. As is explained in more detail herein, the aftertreatment system 600 is configured to facilitate treatment of the exhaust gas. This treatment may facilitate reduction of emission of undesirable components in the exhaust gas. This treatment may also or instead facilitate conversion of various oxidation components of the exhaust gas into other components. This treatment may also or instead facilitate removal of particulates from the exhaust gas.

The aftertreatment system 600 includes an exhaust gas conduit system 602 (e.g., line system, pipe system, etc.). The exhaust gas conduit system 602 is configured to facilitate routing of the exhaust gas produced by the internal combustion engine throughout the aftertreatment system 600 and to atmosphere.

The exhaust gas conduit system 602 includes an inlet conduit 604 (e.g., line, pipe, etc.). The inlet conduit 604 is fluidly coupled to an upstream component and is configured to receive exhaust gas from the upstream component. In some embodiments, the inlet conduit 604 is coupled to the upstream component. In other embodiments, the inlet conduit 604 is integrally formed with the upstream component. The inlet conduit 604 is centered on a conduit center axis 605 (e.g., the conduit center axis 605 extends through a center point of the inlet conduit 604, etc.).

The aftertreatment system 600 also includes a filter 606 (e.g., DPF, filtration member, etc.). The filter 606 is disposed within the inlet conduit 604 and is configured to remove particulates from the exhaust gas. For example, the filter 606 may receive exhaust gas (e.g., from the inlet conduit 604, etc.) having a first concentration of the particulates and may provide the exhaust gas (e.g., to the inlet conduit 604, etc.) having a second concentration of the particulates, where the second concentration is lower than the first concentration. In some embodiments, the aftertreatment system 600 does not include the filter 606.

The exhaust gas conduit system 602 also includes an introduction conduit 607 (e.g., decomposition housing, decomposition reactor, decomposition chamber, reactor pipe, decomposition tube, reactor tube, hydrocarbon introduction housing, etc.). The introduction conduit 607 is fluidly coupled to the inlet conduit 604 and is configured to receive exhaust gas from the inlet conduit 604 (e.g., after flowing through the filter 606). In various embodiments, the introduction conduit 607 is coupled to the inlet conduit 604. For example, the introduction conduit 607 may be fastened, welded, riveted, or otherwise attached to the inlet conduit 604. In other embodiments, the introduction conduit 607 is integrally formed with the inlet conduit 604. In some embodiments, the inlet conduit 604 is the introduction conduit 607 (e.g., only the inlet conduit 604 is included in the exhaust gas conduit system 602 and the inlet conduit 604 functions as both the inlet conduit 604 and the introduction conduit 607). The introduction conduit 607 is centered on the conduit center axis 605 (e.g., the conduit center axis 605 extends through a center point of the introduction conduit 607, etc.). The introduction conduit 607 has a conduit diameter $d_c$. The conduit diameter de may be selected so as to tailor the aftertreatment system 600 for a target application.

The aftertreatment system 600 also includes a treatment fluid delivery system 608. As is explained in more detail herein, the treatment fluid delivery system 608 is configured to facilitate the introduction of a treatment fluid, such as a reductant or a hydrocarbon, into the exhaust gas. When the reductant is introduced into the exhaust gas, reduction of emission of undesirable components in the exhaust gas may be facilitated. When the hydrocarbon is introduced into the exhaust gas, the temperature of the exhaust gas may be increased (e.g., to facilitate regeneration of components of the aftertreatment system 600, etc.). For example, the temperature of the exhaust gas may be increased by combusting the hydrocarbon within the exhaust gas (e.g., using a spark plug, etc.).

The treatment fluid delivery system 608 includes a dosing module 610 (e.g., doser, reductant doser, hydrocarbon doser, etc.). The dosing module 610 is configured to facilitate passage of the treatment fluid through the introduction conduit 607 and into the introduction conduit 607. The dosing module 610 may include an insulator interposed between a portion of the dosing module 610 and the portion of the introduction conduit 607 on which the dosing module 610 is mounted. In various embodiments, the dosing module 610 is coupled to the introduction conduit 607.

The treatment fluid delivery system 608 also includes a treatment fluid source 612 (e.g., reductant tank, hydrocarbon tank, etc.). The treatment fluid source 612 is configured to contain the treatment fluid. The treatment fluid source 612 is fluidly coupled to the dosing module 610 and configured to provide the treatment fluid to the dosing module 610. The treatment fluid source 612 may include multiple treatment fluid sources 612 (e.g., multiple tanks connected in series or in parallel, etc.). The treatment fluid source 612 may be, for example, a diesel exhaust fluid tank containing Adblue® or a fuel tank containing fuel.

The treatment fluid delivery system 608 also includes a treatment fluid pump 614 (e.g., supply unit, etc.). The treatment fluid pump 614 is fluidly coupled to the treatment fluid source 612 and the dosing module 610 and configured to receive the treatment fluid from the treatment fluid source 612 and to provide the treatment fluid to the dosing module 610. The treatment fluid pump 614 is used to pressurize the treatment fluid from the treatment fluid source 612 for delivery to the dosing module 610. In some embodiments, the treatment fluid pump 614 is pressure controlled. In some embodiments, the treatment fluid pump 614 is coupled to a chassis of a vehicle associated with the aftertreatment system 600.

In some embodiments, the treatment fluid delivery system 608 also includes a treatment fluid filter 616. The treatment fluid filter 616 is fluidly coupled to the treatment fluid source 612 and the treatment fluid pump 614 and is configured to receive the treatment fluid from the treatment fluid source 612 and to provide the treatment fluid to the treatment fluid pump 614. The treatment fluid filter 616 filters the treatment fluid prior to the treatment fluid being provided to internal components of the treatment fluid pump 614. For example, the treatment fluid filter 616 may inhibit or prevent the transmission of solids to the internal components of the treatment fluid pump 614. In this way, the treatment fluid filter 616 may facilitate prolonged desirable operation of the treatment fluid pump 614.

The dosing module 610 includes at least one injector 618 (e.g., insertion device, etc.). The injector 618 is fluidly coupled to the treatment fluid pump 614 and configured to receive the treatment fluid from the treatment fluid pump 614. The injector 618 is configured to dose the treatment fluid received by the dosing module 610 into the exhaust gas within the introduction conduit 607 and along an injection axis 619 (e.g., within a spray cone that is centered on the injection axis 619, etc.).

In some embodiments, the treatment fluid delivery system 608 also includes an air pump 620 and an air source 622 (e.g., air intake, etc.). The air pump 620 is fluidly coupled to the air source 622 and is configured to receive air from the air source 622. The air pump 620 is fluidly coupled to the dosing module 610 and is configured to provide the air to the dosing module 610. In some applications, the dosing module 610 is configured to mix the air and the treatment fluid into an air-treatment fluid mixture and to provide the air-treatment fluid mixture to the injector 618 (e.g., for dosing into the exhaust gas within the introduction conduit 607, etc.). The injector 618 is fluidly coupled to the air pump 620 and configured to receive the air from the air pump 620. The injector 618 is configured to dose the air-treatment fluid mixture into the exhaust gas within the introduction conduit 607. In some of these embodiments, the treatment fluid delivery system 608 also includes an air filter 624. The air filter 624 is fluidly coupled to the air source 622 and the air pump 620 and is configured to receive the air from the air source 622 and to provide the air to the air pump 620. The air filter 624 is configured to filter the air prior to the air being provided to the air pump 620. In other embodiments, the treatment fluid delivery system 608 does not include the air pump 620 and/or the treatment fluid delivery system 608 does not include the air source 622. In such embodiments, the dosing module 610 is not configured to mix the treatment fluid with the air.

In various embodiments, the dosing module 610 is configured to receive air and fluid, and doses the air-treatment fluid mixture into the introduction conduit 607. In various embodiments, the dosing module 610 is configured to receive treatment fluid (and does not receive air), and doses the treatment fluid into the introduction conduit 607. In various embodiments, the dosing module 610 is configured to receive treatment fluid, and doses the treatment fluid into the introduction conduit 607. In various embodiments, the dosing module 610 is configured to receive air and treatment fluid, and doses the air-treatment fluid mixture into the introduction conduit 607.

The aftertreatment system 600 also includes a controller 626 (e.g., control circuit, driver, etc.). The dosing module 610, the treatment fluid pump 614, and the air pump 620 are also electrically or communicatively coupled to the controller 626. The controller 626 is configured to control the dosing module 610 to dose the treatment fluid or the air-treatment fluid mixture into the introduction conduit 607. The controller 626 may also be configured to control the treatment fluid pump 614 and/or the air pump 620 in order to control the treatment fluid or the air-treatment fluid mixture that is dosed into the introduction conduit 607.

The controller 626 includes a processing circuit 628. The processing circuit 628 includes a processor 630 and a memory 632. The processor 630 may include a microprocessor, an ASIC, a FPGA, etc., or combinations thereof. The memory 632 may include, but is not limited to, electronic, optical, magnetic, or any other storage or transmission device capable of providing a processor, ASIC, FPGA, etc. with program instructions. This memory 632 may include a memory chip, EEPROM, EPROM, flash memory, or any other suitable memory from which the controller 626 can read instructions. The instructions may include code from any suitable programming language. The memory 632 may include various modules that include instructions which are configured to be implemented by the processor 630.

In various embodiments, the controller 626 is configured to communicate with a central controller 634 (e.g., ECU, ECM, etc.) of an internal combustion engine having the aftertreatment system 600. In some embodiments, the central controller 634 and the controller 626 are integrated into a single controller.

In some embodiments, the central controller 634 is communicable with a display device. The display device may be configured to change state in response to receiving information from the central controller 634. For example, the display device may be configured to change between a static state and an alarm state based on a communication from the central controller 634. By changing state, the display device may provide an indication to a user of a status of the treatment fluid delivery system 608.

The aftertreatment system 600 also includes a mixer 636 (e.g., a swirl generating device, etc.). At least a portion of the mixer 636 is positioned within the introduction conduit 607. In some embodiments, a first portion of the mixer 636 is positioned within the inlet conduit 604 and a second portion of the mixer 636 is positioned within the introduction conduit 607.

The mixer 636 receives the exhaust gas from the inlet conduit 604 (e.g., via the introduction conduit 607, etc.). The mixer 636 also receives the treatment fluid or the air-treatment fluid mixture received from the injector 618. The mixer 636 is configured to mix the treatment fluid or the air-treatment fluid mixture with the exhaust gas. The mixer 636 is also configured to facilitate swirling (e.g., rotation, etc.) of the exhaust gas and mixing (e.g., combination, etc.) of the exhaust gas and the treatment fluid or the air-treatment fluid mixture so as to disperse the treatment fluid within the exhaust gas downstream of the mixer 636 (e.g., to obtain an increased uniformity index, etc.). By dispersing the treatment fluid within the exhaust gas using the mixer 636, reduction of emission of undesirable components in the exhaust gas is enhanced and/or an ability of the aftertreatment system 600 to increase a temperature of the exhaust gas may be enhanced.

The mixer 636 includes a mixer body 638 (e.g., shell, frame, etc.). The mixer body 638 is supported within the inlet conduit 604 and/or the introduction conduit 607. In various embodiments, the mixer body 638 is centered on the conduit center axis 605 (e.g., the conduit center axis 605 extends through a center point of the mixer body 638, etc.). In other embodiments, the mixer body 638 is centered on an axis that is separated from the conduit center axis 605. For example, the mixer body 638 may be centered on an axis that is separated from and approximately parallel to the conduit center axis 605. In another example, the mixer body 638 may be centered on an axis that intersects the conduit center axis 605 and is angled relative to the conduit center axis 605 (e.g., when viewed on a plane along which the axis and the conduit center axis 605 extend, etc.).

The mixer body 638 is defined by a mixer body diameter $d_{mb}$. The mixer body diameter $d_{mb}$ may be selected based on the conduit diameter $d_c$. For example, the mixer body 638 may be configured such that the mixer body diameter $d_{mb}$ is each approximately equal to between 0.30 $d_c$ and 0.90 $d_c$, inclusive (e.g., 0.285 $d_c$, 0.30 $d_c$, 0.40 $d_c$, 0.55 $d_c$, 0.60 $d_c$, 0.70 $d_c$, 0.80c, 0.90 $d_c$, 0.99 $d_c$, etc.).

The mixer body 638 includes a mixer inlet 640 (e.g., inlet aperture, inlet opening, etc.). The mixer inlet 640 receives the exhaust gas (e.g., from the inlet conduit 604, etc.). The mixer body 638 defines (e.g., partially encloses, etc.) a mixer cavity 642 (e.g., void, etc.). The mixer cavity 642 receives the exhaust gas from the mixer inlet 640. As is explained in more detail herein, the exhaust gas is caused to swirl within the mixer body 638.

In various embodiments, the mixer 636 does not include vane plates (e.g., vane plates similar to the upstream vane plate 144, vane plates similar to the downstream vane plate 154, etc.). As a result, costs associated with manufacturing the mixer 636 may be lower than costs associated with manufacturing other mixing devices that include vane plates.

The mixer body 638 also includes a treatment fluid inlet 652 (e.g., aperture, window, hole, etc.). The treatment fluid inlet 652 is aligned with the injector 618 and the mixer body 638 is configured to receive the treatment fluid or the air-treatment fluid mixture through the treatment fluid inlet 652. The injection axis 619 extends through the treatment fluid inlet 652.

The mixer body 638 also includes an exhaust gas inlet 653. The exhaust gas inlet 653 is aligned with the treatment fluid inlet 652 and is configured to facilitate flow of the exhaust gas into the mixer body 638. First, the exhaust gas flows between the mixer body 638 and the introduction conduit 607, then the exhaust gas flows though the exhaust gas inlet 653 into the mixer body 638. For example, the exhaust gas flowing through the mixer body 638 may create a vacuum at the exhaust gas inlet 653 and this vacuum may draw the exhaust gas flowing between the mixer body 638 and the introduction conduit 607 into the mixer body 638 via the exhaust gas inlet 653. The flow of the exhaust gas through the exhaust gas inlet 653 opposes the flow of the exhaust gas and the treatment fluid and/or the air-treatment fluid mixture through the treatment fluid inlet 652. In this way, the exhaust gas inlet 653 may mitigate deposit formation on the mixer body 638.

The mixer body 638 also includes an endcap 654 (e.g., endplate, etc.). The endcap 654 extends across a downstream end of the mixer body 638 opposite the mixer inlet 540. The endcap 654 prevents flow of the exhaust gas and the treatment fluid and/or the air-treatment fluid mixture out of the mixer body 638.

The mixer body 638 further includes a mixer outlet 664 (e.g., outlet aperture, outlet opening, etc.). The mixer outlet 664 extends through the endcap 654 and facilitates flow of the exhaust gas and the treatment fluid and/or the air-treatment fluid mixture out of the mixer body 638. In various embodiments, the mixer body 638 does not include any openings extending through the endcap 654 other than the mixer outlet 664 (e.g., the endcap 654 only facilitates flow of the exhaust gas and the treatment fluid and/or the air-treatment fluid mixture out of the mixer body 638 through the mixer outlet 664, etc.).

The mixer outlet 664 is defined by a mixer outlet diameter $d_{mo}$. The mixer outlet diameter $d_{mo}$ may be selected based on the conduit diameter $d_c$. For example, the mixer outlet 664 may be configured such that the mixer outlet diameter $d_{mo}$ is each approximately equal to between 0.10 $d_c$ and 0.40 $d_c$, inclusive (e.g., 0.095 $d_c$, 0.10 $d_c$, 0.20 $d_c$, 0.30 $d_c$, 0.35 $d_c$, 0.37 $d_c$, 0.40 $d_c$, 0.44 $d_c$, etc.).

The mixer outlet 664 is disposed along a mixer outlet plane 665. The conduit center axis 605 extends through the mixer outlet plane 665. In various embodiments, the conduit center axis 605 is orthogonal to the mixer outlet plane 665. The mixer outlet 664 is centered on an outlet center axis 667 (e.g., the conduit center axis 605 extends through a center point of the inlet conduit 604, etc.). In various embodiments, such as is shown in FIG. 6, the outlet center axis 667 is offset from the conduit center axis 605 by an offset distance $S_o$. In other embodiments, the outlet center axis 667 is disposed along the conduit center axis 605 (e.g., the conduit center axis 605 is the outlet center axis 667, etc.).

The offset distance $S_o$ may be selected based on the conduit diameter $d_c$. For example, the mixer body 638 may be configured such that the offset distance $S_o$ is each approximately equal to between 0.10 $d_c$ and 0.35 $d_c$, inclusive (e.g., 0.095 $d_c$, 0.10 $d_c$, 0.20 $d_c$, 0.25 $d_c$, 0.30 $d_c$, 0.32 $d_c$, 0.34 $d_c$, 0.35 $d_c$, 0.385 $d_c$, etc.).

The aftertreatment system 600 also includes a support flange 668 (e.g., panel, coupler, ring, etc.). The support flange 668 is coupled to the mixer body 638 proximate the mixer outlet 664. The support flange 668 is also coupled to the introduction conduit 607. The support flange 668 functions to separate the mixer body 638 from the introduction conduit 607 and support the mixer 636 within the introduction conduit 607.

In various embodiments, the support flange 668 is configured to prevent flow of the exhaust gas and the treatment fluid and/or the air-treatment fluid mixture between the mixer body 638 and the introduction conduit 607 (e.g., less than 1% of the exhaust gas and the treatment fluid and/or the air-treatment fluid mixture flowing between the mixer body 638 and the introduction conduit 607 flows between the support flange 668 and the mixer body 638 and between the support flange 668 and the introduction conduit 607, etc.). In this way, the support flange 668 functions to direct the exhaust gas and the treatment fluid and/or the air-treatment fluid mixture flowing between the mixer body 638 and the introduction conduit 607 into the mixer body 638 via the treatment fluid inlet 652 and/or the exhaust gas inlet 653 (e.g., rather than facilitating bypassing of the mixer body 638 using apertures formed in the support flange 668, etc.).

In some embodiments, the support flange 668 includes a plurality of flange apertures (e.g., windows, holes, etc.). Each of the flange apertures is configured to facilitate passage of the exhaust gas through the support flange 668.

At least a portion of the exhaust gas flowing between the mixer body 638 and the introduction conduit 607 enters the mixer body 638 via the treatment fluid inlet 652 and at least a portion of the exhaust gas flowing between the mixer body 638 and the introduction conduit 607 enters the mixer body 638 via the exhaust gas inlet 653. For example, the exhaust gas flowing through the mixer body 638 may create a vacuum at the treatment fluid inlet 652 and this vacuum may draw the exhaust gas flowing between the mixer body 638 and the introduction conduit 607 into the mixer body 638 via the treatment fluid inlet 652. The exhaust gas entering the mixer body via the treatment fluid inlet 652 may assist in propelling the treatment fluid and/or the air-treatment fluid mixture provided by the injector 618 into the mixer cavity 642.

The exhaust gas conduit system 602 also includes a transfer conduit 669. The transfer conduit 669 is fluidly coupled to the introduction conduit 607 and is configured to receive the exhaust gas from the introduction conduit 607. In various embodiments, the transfer conduit 669 is coupled to the introduction conduit 607. For example, the transfer conduit 669 may be fastened, welded, riveted, or otherwise attached to the introduction conduit 607. In other embodiments, the transfer conduit 669 is integrally formed with the introduction conduit 607. In some embodiments, the introduction conduit 607 is the transfer conduit 669 (e.g., only the introduction conduit 607 is included in the exhaust gas conduit system 602 and the introduction conduit 607 functions as both the introduction conduit 607 and the transfer conduit 669). The transfer conduit 669 is centered on the conduit center axis 605 (e.g., the conduit center axis 605 extends through a center point of the transfer conduit 669, etc.).

In various embodiments, the aftertreatment system 600 also includes a baffle plate assembly 670 (e.g., baffle panel assembly, etc.). As is explained in more detail herein, the baffle plate assembly 670 is configured to facilitate redirection of the exhaust gas and the treatment fluid and/or the air-treatment fluid mixture flowing from the mixer outlet 664. The baffle plate assembly 670 includes one or more baffle plate supports 672 (e.g., arms, posts, ribs, etc.). Each of the baffle plate supports 672 is coupled to the transfer conduit 669. The baffle plate assembly 670 also includes a baffle plate 674 (e.g., panel, etc.). The baffle plate 674 is coupled to the baffle plate supports 672 and is separated from the transfer conduit 669. The baffle plate supports 672 are configured to support the baffle plate 674 within the transfer conduit 669.

The baffle plate assembly 670 is configured such that the baffle plate 674 is separated from the mixer outlet 664 by a baffle plate separation distance $S_{bp}$. The baffle plate separation distance $S_{bp}$ may be selected based on the conduit diameter $d_c$. For example, the baffle plate assembly 670 may be configured such that baffle plate separation distance $S_{bp}$ is approximately equal to between 0.05 $d_c$ and 0.35 $d_c$, inclusive (e.g., 0.0475 $d_c$, 0.05 $d_c$, 0.10 $d_c$, 0.20 $d_c$, 0.25 $d_c$, 0.30 $d_c$, 0.35 $d_c$, 0.385 $d_c$, etc.).

The baffle plate assembly 670 is also configured such that the outlet center axis 667 extends through the baffle plate 674. As a result, the exhaust gas and the treatment fluid and/or the air-treatment fluid mixture flowing from the mixer outlet 664 is caused to flow around the baffle plate 674. In this way, the baffle plate 674 causes swirling of the exhaust gas and the treatment fluid and/or the air-treatment fluid mixture downstream of the baffle plate 674. In some embodiments, the baffle plate assembly 670 is configured such that the conduit center axis 605 extends through the baffle plate 674.

The aftertreatment system 600 also includes a mixing flange 678 (e.g., annular flange, mixing plate, etc.). As is explained in more detail herein, the mixing flange 678 is configured to provide an additional mechanism (e.g., in addition to the mixer 636, etc.) for mixing the exhaust gas and the treatment fluid and/or the air-treatment fluid mixture.

The mixing flange 678 includes a mixing flange body 680 (e.g., frame, etc.). The mixing flange body 680 is coupled to the transfer conduit 669. In various embodiments, the mixing flange body 680 is configured to prevent flow of the exhaust gas and the treatment fluid and/or the air-treatment fluid mixture between the mixing flange body 680 and the transfer conduit 669 (e.g., less than 1% of the exhaust gas and the treatment fluid and/or the air-treatment fluid mixture flowing within the transfer conduit 669 flows between the mixing flange body 680 and the transfer conduit 669, etc.).

The mixing flange 678 includes a mixing flange opening 682 (e.g., window, hole, aperture etc.). The mixing flange opening 682 extends through the mixing flange body 680 and facilitates flow of the exhaust gas and the treatment fluid and/or the air-treatment fluid mixture through the mixing flange 678. In various embodiments, the mixing flange 678 is configured such that the mixing flange opening 682 is centered on the conduit center axis 605. As a result, flow of the exhaust gas and the treatment fluid and/or the air-treatment fluid mixture through the mixing flange opening 682 may be balanced. The mixer 636 and the mixing flange 678 are configured such that the conduit center axis 605 and the outlet center axis 667 extend through the mixing flange opening 682.

The mixing flange opening 682 has a mixing flange opening diameter $d_{mf}$. The mixing flange opening diameter $d_{mf}$ may be selected based on the conduit diameter $d_c$. For example, the mixing flange 678 may be configured such that the mixing flange opening diameter $d_{mf}$ is approximately equal to between 0.30 $d_c$ and 0.95 $d_c$, inclusive (e.g., 0.285 $d_c$, 0.30 $d_c$, 0.35 $d_c$, 0.40 $d_c$, 0.57 $d_c$, 0.60 $d_c$, 0.70 $d_c$, 0.75 $d_c$, 0.80 $d_c$, 0.90 $d_c$, 0.95 $d_c$, $d_c$, etc.).

The mixing flange 678 includes a mixing flange downstream surface 684 (e.g., face, etc.). The mixing flange downstream surface 684 is contiguous with the mixing flange opening 682 and the transfer conduit 669. As the exhaust gas and the treatment fluid and/or the air-treatment fluid mixture flows through the mixing flange opening 682, the exhaust gas and the treatment fluid and/or the air-treatment fluid mixture is gradually caused to flow towards the transfer conduit 669 due to the Coandă effect. Specifically, the mixing flange 678 functions as a nozzle, with the mixing flange opening 682 being an outlet of the nozzle, and the exhaust gas and the treatment fluid and/or the air-treatment fluid mixture is caused to flow towards the transfer conduit 669 after flowing through the mixing flange opening. As a result of the Coandă effect, vortices are formed along the mixing flange downstream surface 684. These vortices cause swirling of the exhaust gas and the treatment fluid and/or the air-treatment fluid mixture downstream of the mixing flange 678. In this way, the mixing flange 678 is configured to provide an additional mechanism (e.g., in addition to the mixer 636, etc.) for mixing the exhaust gas and the treatment fluid and/or the air-treatment fluid mixture. Additionally, the Coandă effect creates a virtual surface due to shear between recirculating flow of the exhaust gas and the treatment fluid and/or the air-treatment fluid mixture (e.g., within the vortices, etc.) and the flow of the exhaust gas and the treatment fluid and/or the air-treatment fluid mixture flowing through the mixing flange opening 682.

The mixing flange downstream surface 684 is separated from the mixer outlet 664 by a mixing flange separation distance $S_{mf}$. The mixing flange separation distance $S_{mf}$ may be selected based on the conduit diameter $d_c$. For example, the mixing flange 678 may be configured such that the mixing flange separation distance $S_{mf}$ is approximately equal to between 0.10 $d_c$ and 0.50 $d_c$, inclusive (e.g., 0.09 $d_c$, 0.10 $d_c$, 0.20 $d_c$, 0.30 $d_c$, 0.40 $d_c$, 0.45 $d_c$, 0.50 $d_c$, 0.525 $d_c$, etc.).

In various embodiments, such as is shown in FIG. 6, the mixing flange 678 also includes one or more flow disrupters 686 (e.g., protrusions, projections, protuberances, ribs, fins, guides, etc.). Each of the flow disrupters 686 is coupled to or integrally formed with the mixing flange downstream surface 684. For example, the flow disrupters 686 may be welded or fastened to the mixing flange downstream surface 684. In another example, the flow disrupters 686 are formed in the mixing flange downstream surface 684 via a bending process in which portions of the mixing flange 678 are bent away from the mixer 636.

Each of the flow disrupters 686 extends (e.g., protrudes, projects, etc.) inwardly from an inner surface 688 (e.g., face, etc.) of the transfer conduit 669. As a result, the exhaust gas flowing within the transfer conduit 669 is caused to flow around the flow disrupters 686. By flowing around the flow disrupters 686, the swirl of the exhaust gas that is provided by the mixing flange 678 (e.g., due to the Coanda effect, etc.) is disrupted. This disruption causes the exhaust gas to tumble downstream of the flow disrupters 686. In addition to the swirl provided by the mixer 636 and the swirl provided by the mixing flange 678 (e.g., due to the Coandă effect, etc.), this tumbling provides another mechanism for mixing of the exhaust gas and the treatment fluid and/or the air-treatment fluid mixture. By variously configuring the flow disrupters 686, a target mixing of the exhaust gas and the treatment fluid and/or the air-treatment fluid mixture can be achieved.

As a result, the flow disrupters 686 are capable of increasing a UI of the treatment fluid in the exhaust gas without substantially increasing a pressure drop produced by the mixer 636, a wall-film of the mixer 636, or deposits formed by the mixer 636, compared to other mixing devices. Additionally, the configurations of each of the flow disrupters 686 may be selected so as to minimize manufacturing requirements and decrease weight of the mixer 636 and low frequency modes when compared to other mixer devices. Furthermore, the mixer 636 may be variously configured while utilizing the flow disrupters 686 (e.g., the flow disrupters 686 do not substantially limit a configuration of the mixer 636, etc.).

In some embodiments, the flow disrupters 686 are plate-shaped (e.g., shaped as trapezoidal prisms, etc.). However, the flow disrupters 686 may be variously shaped such that the aftertreatment system 600 is tailored for a target application. For example, the flow disrupters 686 may be frustoconical, shaped as rectangular prisms, cylindrical, shaped as a frustum of a pyramid, or otherwise similarly shaped.

Each of the flow disrupters 686 extends at an angle relative to the mixing flange downstream surface 684. In some embodiments, each of the flow disrupters 686 extends orthogonally from the mixing flange downstream surface 684. However, in some embodiments, one or more of the flow disrupters 686 extends at an acute angle relative to the mixing flange downstream surface 684. Such angling of the flow disrupters 686 may generate additional mixing of the exhaust gas and the treatment fluid and/or the air-treatment fluid mixture. Additionally, angles of each of the flow disrupters 686 may be selected based on angles of the other flow disrupters 686 so that all of the flow disrupters 686 cooperatively generate additional mixing of the exhaust gas and the treatment fluid and/or the air-treatment fluid mixture. In an example where there are three of the flow disrupters 686, each of the flow disrupters 686 may be angled relative to the mixing flange downstream surface 684 at an angle of between 30° and 80°, inclusive.

Additionally, each of the flow disrupters 686 may have an edge that is contiguous with the mixing flange opening 682. However, in some embodiments, an edge of one or more of the flow disrupters 686 is separated from the mixing flange opening 682.

A downstream edge of each of the flow disrupters 686 is separated from the mixer outlet plane 665 by a separation $S_{fd}$. The separation $S_{fd}$ for each of the flow disrupters 686 may be independently selected such that the aftertreatment system 600 is tailored for a target application.

Additionally, a center point 690 (e.g., apex, etc.) of each of the flow disrupters 686 may be angularly separated from the injection axis 619 by an angular separation $\alpha_{fd}$ when measured along a plane that is orthogonal to the conduit center axis 605. This plane may be approximately parallel to the mixer outlet plane 665 and/or a plane along which the injection axis 619 is disposed. The angular separation $\alpha_{fd}$ for each of the flow disrupters 686 may be selected independent of the angular separation $\alpha_{fd}$ for others of the flow disrupters 686 such that the aftertreatment system 600 is tailored for a target application. In various embodiments, the angular separation $\alpha_{fd}$ for each of the flow disrupters 686 is approximately equal to between 0° and 270°, inclusive (e.g., 0°, 45°, 55°, 65°, 75°, 90°, 120°, 150°, 180°, 220°, 270°, 283.5°, etc.).

Furthermore, each of the flow disrupters 686 is also defined by a radial height $h_{rfd}$. The radial height $h_{rfd}$ is measured from each center point 690 to the transfer conduit 669 along an axis that is orthogonal to the conduit center axis 605, and intersects the conduit center axis 605, the center point 690, and the transfer conduit 669.

The radial height $h_{rfd}$ influences how far each of the flow disrupters 686 projects into the transfer conduit 669, and therefore how much each of the flow disrupters 686 impacts the exhaust gas and the treatment fluid and/or the air-treatment fluid mixture. For example, the greater the radial height $h_{rfd}$, the more disruption that the flow disrupter 686 causes to the exhaust gas and the treatment fluid and/or the air-treatment fluid mixture. The radial height $h_{rfd}$ for each of the flow disrupters 686 may be independently selected such that the aftertreatment system 600 is tailored for a target application. In this way, for example, an ability of each of the flow disrupter 686 to cause mixing of the exhaust gas and the treatment fluid and/or the air-treatment fluid mixture may be selected so as to tailor the aftertreatment system 600 for a target application.

The radial height $h_{rfd}$ may be selected based on the conduit diameter $d_c$. For example, the flow disrupters 686 may be configured such that the radial height $h_{rfd}$ are each approximately equal to between 0.05 $d_c$ and 0.30 $d_c$, inclusive (e.g., 0.0475 $d_c$, 0.05 $d_c$, 0.08 $d_c$, 0.12 $d_c$, 0.15 $d_c$, 0.20 $d_c$, 0.25 $d_c$, 0.30 $d_c$, 0.315 $d_c$, etc.). In some applications, the flow disrupters 686 may be configured such that the radial height $h_{rfd}$ are each approximately equal to between 0.08 $d_c$ and 0.25 $d_c$, inclusive (e.g., 0.076 $d_c$, 0.08 $d_c$, 0.15 $d_c$, 0.20 $d_c$, 0.25 $d_c$, 0.2625 $d_c$, etc.).

In some applications, the radial height $h_{rfd}$ for all of the flow disrupters 686 are equal. In other embodiments, the radial height $h_{rfd}$ for each of the flow disrupters 686 is different from the radial height $h_{rfd}$ for the others of the flow disrupters 686. For example, where four of the flow disrupters 686 are included, the first flow disrupter 686 may have a first radial height $h_{rfd}$, the second flow disrupter 686 may have a second radial height 1.05 $h_{rfd}$, the third flow disrupter 686 may have a third radial height 1.1 $h_{rfd}$, and the fourth flow disrupter 686 may have a fourth radial height 1.15 $h_{rfd}$.

Each of the flow disrupters 686 is also defined by an angular height $h_{afd}$. The angular height $h_{afd}$ is measured from each center point 690 to the transfer conduit 669 along an axis that extends along at least a portion of the flow disrupter 686 and intersects the conduit center axis 605, the center point 690, and the transfer conduit 669.

The angular height $h_{afd}$ influences how gradual the flow disrupters 686 transitions from the transfer conduit 669 to the center point 690, and therefore how much each of the flow disrupters 686 impacts the exhaust gas and the treatment fluid and/or the air-treatment fluid mixture. For example, the lower the angular height ha, the more intense the transition (e.g., the greater the slope of the flow disrupter 686, etc.) from the transfer conduit 669 to the center point 690 for the same radial height $h_{rfd}$. The angular height $h_{afd}$ for each of the flow disrupters 686 may be independently selected such that the aftertreatment system 600 is tailored for a target application. In this way, for example, an ability of each of the flow disrupter 686 to cause mixing of the exhaust gas and the treatment fluid and/or the air-treatment fluid mixture may be selected so as to tailor the aftertreatment system 600 for a target application.

In various embodiments, the angular height $h_{afd}$ for each of the flow disrupters 686 is approximately equal to between 15° and 70°, inclusive (e.g., 14.25°, 15°, 20°, 30°, 48.5°, 50°, 55°, 60°, 70°, 73.5°, etc.). In some embodiments, the angular height $h_{afd}$ for each of the flow disrupters 686 is approximately equal to between 30° and 60°, inclusive (e.g., 28.5°, 30°, 45°, 48.5°, 55°, 60°, 63°, etc.).

In some applications, the angular heights $h_{afd}$ for all of the flow disrupters 686 are equal. In other embodiments, the angular height $h_{afd}$ for each of the flow disrupters 686 is different from the angular heights $h_{afd}$ for the others of the flow disrupters 686. For example, where four of the flow disrupters 686 are included, the first flow disrupter 686 may have a first angular height $h_{afd}$, the second flow disrupter 686 may have a second angular height 1.05 $h_{afd}$, the third flow disrupter 686 may have a third angular height 1.1 $h_{afd}$, and the fourth flow disrupter 686 may have a fourth angular height 1.15 $h_{afd}$.

Additionally, each of the flow disrupters 686 is also defined by a width $w_{fd}$. The width $w_{fd}$ is measured between opposite ends of the downstream edge of each flow disrupter 686. The width $w_{fd}$ influences how far each of the flow disrupters 686 projects into the transfer conduit 669, and therefore how much each of the flow disrupters 686 impacts the exhaust gas and the treatment fluid and/or the air-treatment fluid mixture. For example, the greater the width $w_{fd}$, the more disruption that the flow disrupter 686 causes to the exhaust gas and the treatment fluid and/or the air-treatment fluid mixture. The width $w_{fd}$ for each of the flow disrupters 686 may be independently selected such that the aftertreatment system 600 is tailored for a target application. In this way, for example, an ability of each of the flow disrupter 686 to cause mixing of the exhaust gas and the treatment fluid and/or the air-treatment fluid mixture may be selected so as to tailor the aftertreatment system 600 for a target application.

The width $w_{fd}$ may be selected based on the conduit diameter $d_c$. For example, the flow disrupters 686 may be configured such that the widths $w_{fd}$ are each approximately equal to between 0.10 $d_c$ and 0.70 $d_c$, inclusive (e.g., 0.095 $d_c$, 0.10 $d_c$, 0.15 $d_c$, 0.33 $d_c$, 0.50 $d_c$, 0.60 $d_c$, 0.70 $d_c$, 0.735 $d_c$, etc.). In some applications, the flow disrupters 686 may be configured such that the widths $w_{fd}$ are each approximately equal to between 0.15 $d_c$ and 0.60 $d_c$, inclusive (e.g., 0.6425 $d_c$, 0.15 $d_c$, 0.33 $d_c$, 0.60 $d_c$, 0.63 $d_c$, etc.).

In some applications, the widths $w_{fd}$ for all of the flow disrupters 686 are equal. In other embodiments, the $w_{fd}$ for each of the flow disrupters 686 is different from the $w_{fd}$ for the others of the flow disrupters 686. For example, where four of the flow disrupters 686 are included, the first flow disrupter 686 may have a first width $w_{fd}$, the second flow disrupter 686 may have a second width 1.05 $w_{fd}$, the third flow disrupter 686 may have a third width 1.1 $w_{fd}$, and the fourth flow disrupter 686 may have a fourth width 1.15 $w_{fd}$.

In some embodiments, the flow disrupters 686 include perforations (e.g., apertures, holes, etc.). The perforations are configured to facilitate flow of the exhaust gas through the flow disrupters 686. The perforations may enable flow of the exhaust gas to targeted locations downstream of the mixing flange 678 and/or may decrease a backpressure of the aftertreatment system 600.

Figure 7:
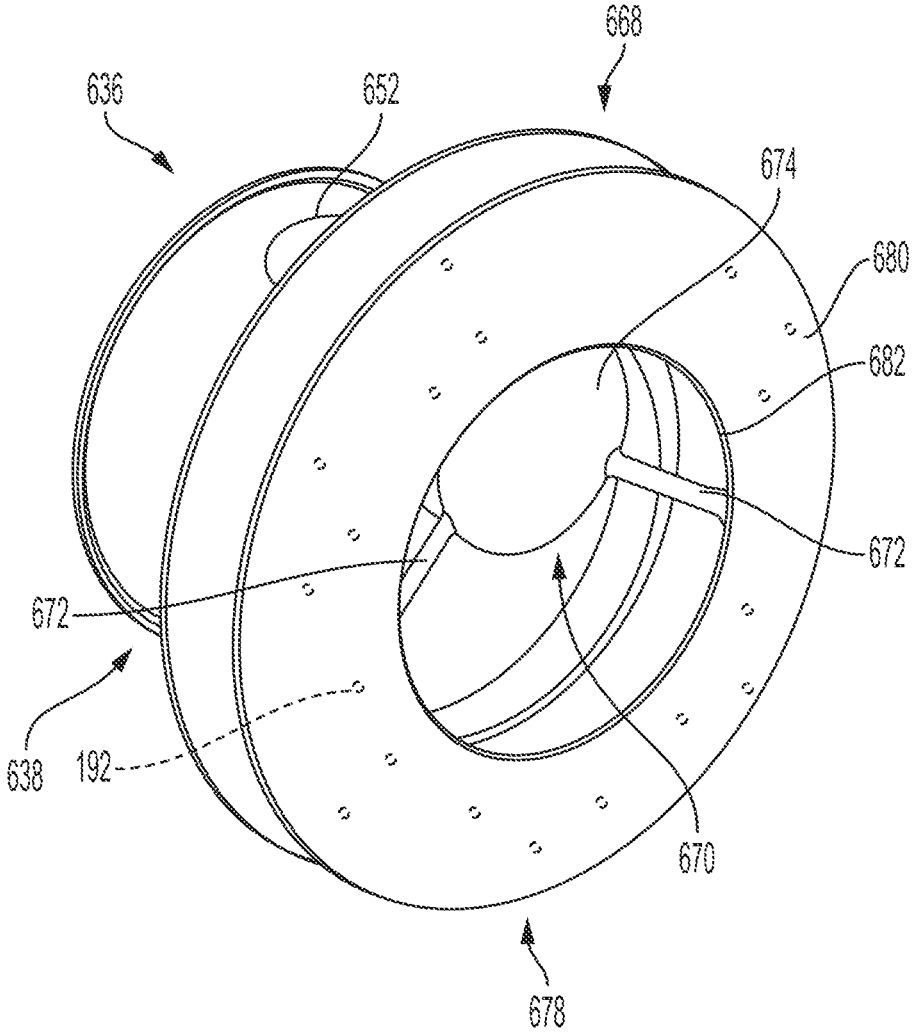
FIG. 7 is a perspective view of a portion of an example aftertreatment system including a mixing flange.

In some embodiments, such as is shown in FIG. 7, the mixing flange 678 does not include any of the flow disrupters 686. Such embodiments may be beneficial in applications where mixing generated by the mixing flange opening 682 (e.g., due to the Coandă effect, etc.) is sufficient and/or where minimizing cost associated with manufacturing of the mixing flange 678 is desired.

In various embodiments, such as is shown in FIG. 6, the mixing flange 678 also includes one or more mixing flange perforations 692 (e.g., holes, windows, etc.). Each of the mixing flange perforations 692 extends through the mixing flange body 680 and facilitates flow of the exhaust gas and the treatment fluid and/or the air-treatment fluid mixture through the mixing flange 678. In this way, the exhaust gas and the treatment fluid and/or the air-treatment fluid mixture may flow through the mixing flange 678 via the mixing flange opening 682 or one of the mixing flange perforations 692. The mixing flange perforations 692 may enable flow of the exhaust gas to targeted locations downstream of the mixing flange 678 and/or may decrease a backpressure of the aftertreatment system 600.

In some embodiments, the aftertreatment system 600 includes a plurality of the mixing flanges 678. Each of the mixing flanges 678 may be configured independently of the other mixing flanges 678 such that the aftertreatment system 600 is tailored for a target application. In an example where the aftertreatment system 600 includes two mixing flanges 678, the upstream mixing flange 678 may not include the mixing flange perforations 692 and the downstream mixing flange 678 may include the mixing flange perforations 692. In another example where the aftertreatment system 600 includes two mixing flanges 678, the upstream mixing flange 678 may not include the flow disrupters 686 and the downstream mixing flange 678 may include the flow disrupters 686.

In some embodiments, the aftertreatment system 600 includes two of the mixing flanges 678. For example, both of the mixing flanges 678 may include the flow disrupters 686, and the flow disrupters 686 on the first mixing flange 678 extend between the first mixing flange 678 and the second mixing flange 678. In some applications, the flow disrupters 686 on the first mixing flange 678 are coupled to the second mixing flange 678. In some applications, the flow disrupters 686 that extend towards the first mixing flange 678 are coupled to the second mixing flange 678, rather than being coupled to the first mixing flange 678. In some applications, the flow disrupters 686 on the first mixing flange 678 are aligned with the flow disrupters 686 on the second mixing flange 678. In other applications, the flow disrupters 686 on the first mixing flange 678 are offset relative to the flow disrupters 686 on the second mixing flange 678.

In various embodiments, the aftertreatment system 600 also includes a perforated plate 694 (e.g., straightening plate, flow straightener, etc.). The perforated plate 694 is coupled to the transfer conduit 669 downstream of the mixing flange 678. The perforated plate 694 extends across the transfer conduit 669. In various embodiments, the perforated plate 694 extends along a plane that is approximately parallel to a plane that the support flange 668 extends along.

The perforated plate 694 includes a plurality of perforations 696 (e.g., holes, apertures, windows, etc.). Each of the perforations 696 facilitates passage of the exhaust gas and the treatment fluid and/or the air-treatment fluid mixture through the perforated plate 694. The perforated plate 694 is configured such that flow of the exhaust gas and the treatment fluid and/or the air-treatment fluid mixture between the perforated plate 694 and the transfer conduit 669 is substantially prevented (e.g., less than 1% of the exhaust gas and the treatment fluid and/or the air-treatment fluid mixture flows between the perforated plate 694 and the transfer conduit 669, etc.).

The perforations 696 function to straighten flow of the exhaust gas and the treatment fluid and/or the air-treatment fluid mixture downstream of the perforated plate 694. For example, the exhaust gas and the treatment fluid and/or the air-treatment fluid mixture may be tumbling upstream of the perforated plate 694 (e.g., due to the Coandă effect provided by the mixing flange 678, due to the flow disrupters 686, etc.), may flow through the perforated plate 694 via the perforations 696, and then may flow along relatively straight flow paths downstream of the perforated plate 694.

The perforated plate 694 may be variously configured so as to be tailored for a target application. For example, a number of the perforations 696, locations of each of the perforations 696, and/or sizes (e.g., diameters, etc.) of each of the perforations 696 may be individually selected such that the perforated plate 694 is tailored for a target application. By variously locating the perforations 696, the exhaust gas and the treatment fluid and/or the air-treatment fluid mixture can be directed to target locations downstream of the perforated plate 694 because of the straight flow paths.

In some embodiments where the mixing flange 678 includes the mixing flange perforations 692, the aftertreatment system 600 does not include the perforated plate 694.

The aftertreatment system 600 also includes a catalyst member 698 (e.g., conversion catalyst member, SCR catalyst member, catalyst metals, etc.). The catalyst member 698 is coupled to the transfer conduit 669. For example, the catalyst member 698 may be disposed within a shell (e.g., housing, sleeve, etc.) which is press-fit within the transfer conduit 669.

In various embodiments, the catalyst member 698 is configured to cause decomposition of components of the exhaust gas using reductant (e.g., via catalytic reactions, etc.). In these embodiments, the treatment fluid provided by the dosing module 610 is reductant. Specifically, the reductant that has been provided into the exhaust gas by the injector 618 undergoes the processes of evaporation, thermolysis, and hydrolysis to form non-$NO_x$ emissions within the transfer conduit 669 and/or the catalyst member 698. In this way, the catalyst member 698 is configured to assist in the reduction of $NO_x$ emissions by accelerating a $NO_x$ reduction process between the reductant and the $NO_x$ of the exhaust gas into diatomic nitrogen, water, and/or carbon dioxide. The catalyst member 698 may include, for example, platinum, rhodium, palladium, or other similar materials. In some embodiments, the catalyst member 698 is a ceramic conversion catalyst member.

In various embodiments, the catalyst member 698 is configured to oxidize a hydrocarbon and/or carbon monoxide in the exhaust gas and the treatment fluid and/or the air-treatment fluid mixture. In these embodiments, the catalyst member 698 includes an oxidation catalyst member (e.g., a DOC, etc.). For example, the catalyst member 698 may be an oxidation catalyst member that is configured to facilitate conversion of carbon monoxide in the exhaust gas and the treatment fluid and/or the air-treatment fluid mixture into carbon dioxide.

In various embodiments, the catalyst member 698 may include multiple portions. For example, the catalyst member 698 may include a first portion that includes platinum and a second portion that includes rhodium. By including multiple portions, an ability of the catalyst member 698 to facilitate treatment of the exhaust gas may be tailored for a target application.

The exhaust gas conduit system 602 also includes an outlet conduit 700. The outlet conduit 700 is fluidly coupled to the transfer conduit 669 and is configured to receive the exhaust gas from the transfer conduit 669. In various embodiments, the outlet conduit 700 is coupled to the transfer conduit 669. For example, the outlet conduit 700 may be fastened, welded, riveted, or otherwise attached to the transfer conduit 669. In other embodiments, the outlet conduit 700 is integrally formed with the transfer conduit 669. In some embodiments, the transfer conduit 669 is the outlet conduit 700 (e.g., only the transfer conduit 669 is included in the exhaust gas conduit system 602 and the transfer conduit 669 functions as both the transfer conduit 669 and the outlet conduit 700). The outlet conduit 700 is centered on the conduit center axis 605 (e.g., the conduit center axis 605 extends through a center point of the outlet conduit 700, etc.).

In various embodiments, the exhaust gas conduit system 602 only includes a single conduit which functions as the inlet conduit 604, the introduction conduit 607, the transfer conduit 669, and the outlet conduit 700.

In various embodiments, the aftertreatment system 600 also includes a sensor 702 (e.g., sensing unit, detector, flow rate sensor, mass flow rate sensor, volumetric flow rate sensor, velocity sensor, pressure sensor, temperature sensor, thermocouple, hydrocarbon sensor, $NO_x$ sensor, CO sensor, $CO_2$ sensor, $O_2$ sensor, particulate sensor, nitrogen sensor, etc.). The sensor 702 is coupled to the transfer conduit 669 and is configured to measure (e.g., sense, detect, etc.) a parameter (e.g., flow rate, mass flow rate, volumetric flow rate, velocity, pressure, temperature, hydrocarbon concentration, $NO_x$ concentration, CO concentration, $CO_2$ concentration, $O_2$ concentration, particulate concentration, nitrogen concentration, etc.) of the exhaust gas and the treatment fluid and/or the air-treatment fluid mixture within the transfer conduit 669. In various embodiments, the sensor 702 is located adjacent the mixing flange downstream surface 684. In this way, the sensor 702 may be located within or proximate to a vortex formed by the mixing flange 678.

The sensor 702 is electrically or communicatively coupled to the controller 626 and is configured to provide a signal associated with the parameter to the controller 626. The controller 626 (e.g., via the processing circuit 628, etc.) is configured to determine the parameter based on the signal. The controller 626 may be configured to control the dosing module 610, the treatment fluid pump 614, and/or the air pump 620 based on the signal. Furthermore, the controller 626 may be configured to communicate the signal to the central controller 634.

While the aftertreatment system 600 has been shown and described in the context of use with a diesel internal combustion engine, the aftertreatment system 600 may be used with other internal combustion engines, such as gasoline internal combustion engines, hybrid internal combustion engines, propane internal combustion engines, dual-fuel internal combustion engines, and other similar internal combustion engines.

IV. Overview of Third Example Aftertreatment Systems

Figure 8:
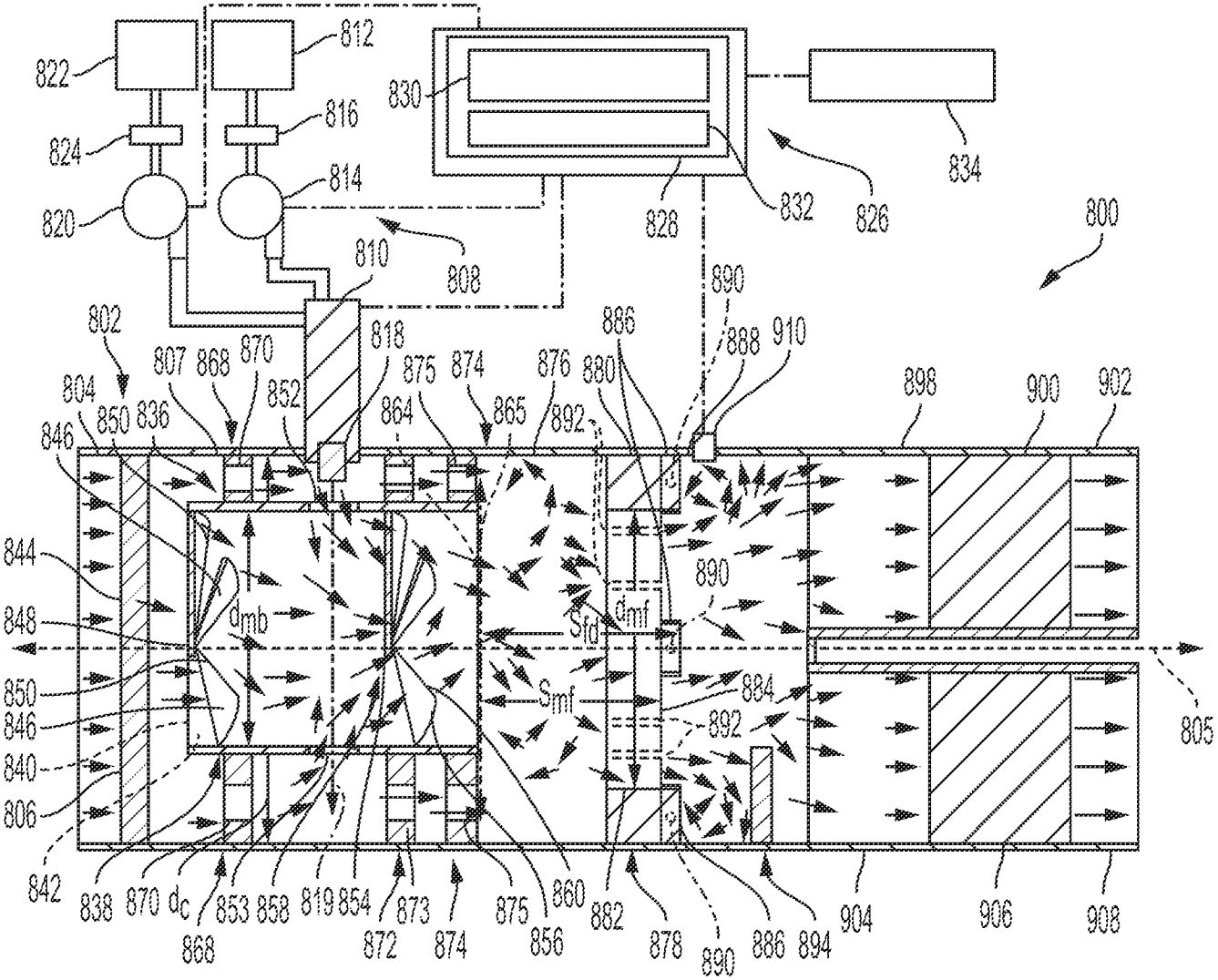
FIG. 8 is a cross-sectional view of a portion of an example aftertreatment system including a mixing flange.
Figure 9:
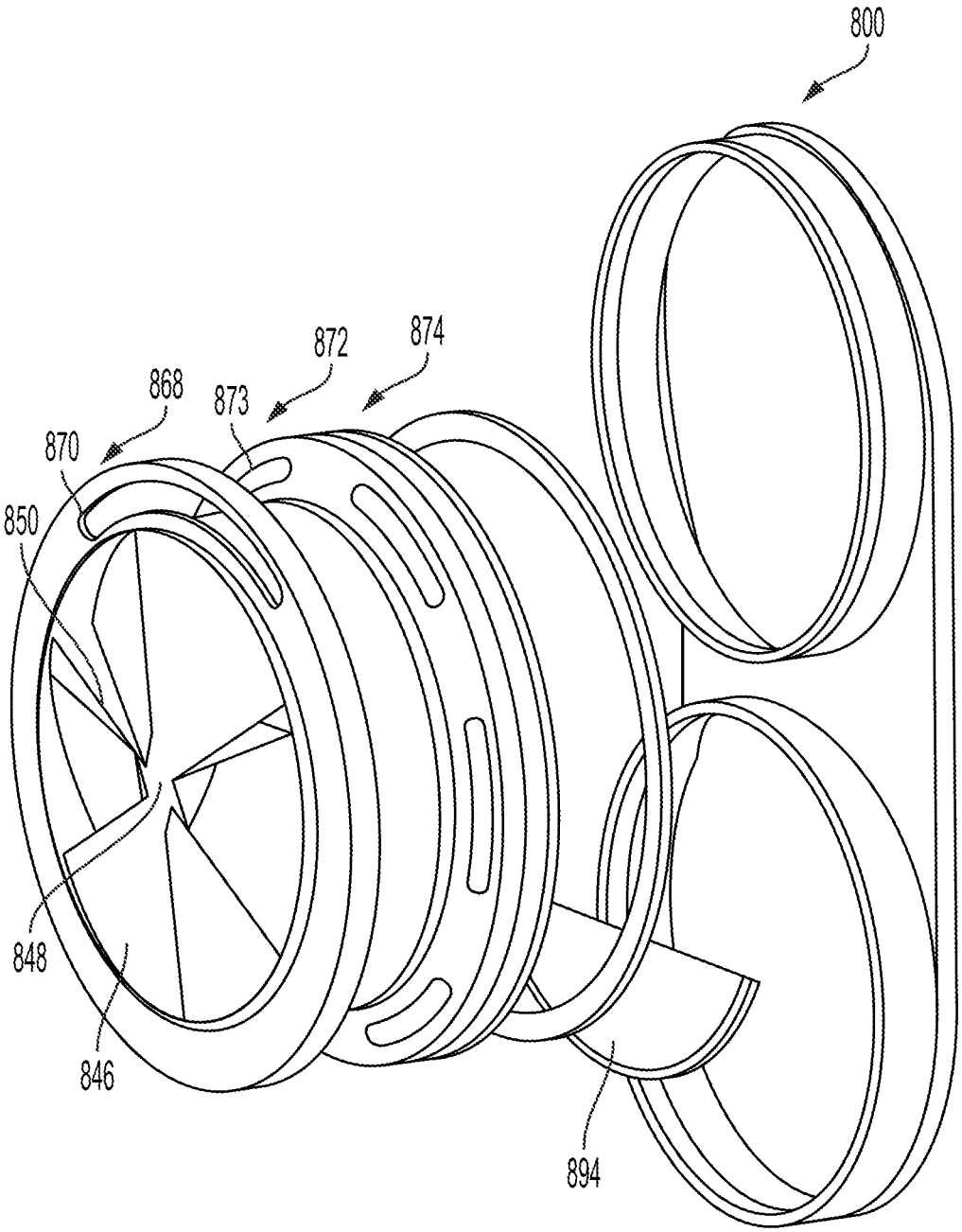
FIG. 9 is a perspective view of a portion of an example aftertreatment system including a mixing flange.

FIG. 8 depicts an aftertreatment system 800 (e.g., treatment system, etc.) for treating exhaust gas produced by an internal combustion engine. As is explained in more detail herein, the aftertreatment system 800 is configured to facilitate treatment of the exhaust gas using parallel catalyst members and, in various embodiments, without a perforated plate. This treatment may facilitate reduction of emission of undesirable components in the exhaust gas. This treatment may also or instead facilitate conversion of various oxidation components of the exhaust gas into other components. This treatment may also or instead facilitate removal of particulates from the exhaust gas.

The aftertreatment system 800 includes an exhaust gas conduit system 802 (e.g., line system, pipe system, etc.). The exhaust gas conduit system 802 is configured to facilitate routing of the exhaust gas produced by the internal combustion engine throughout the aftertreatment system 800 and to atmosphere.

The exhaust gas conduit system 802 includes an inlet conduit 804 (e.g., line, pipe, etc.). The inlet conduit 804 is fluidly coupled to an upstream component and is configured to receive exhaust gas from the upstream component. In some embodiments, the inlet conduit 804 is coupled to the upstream component. In other embodiments, the inlet conduit 804 is integrally formed with the upstream component. The inlet conduit 804 is centered on a conduit center axis 805 (e.g., the conduit center axis 805 extends through a center point of the inlet conduit 804, etc.).

The aftertreatment system 800 also includes a filter 806 (e.g., DPF, filtration member, etc.). The filter 806 is disposed within the inlet conduit 804 and is configured to remove particulates from the exhaust gas. For example, the filter 806 may receive exhaust gas (e.g., from the inlet conduit 804, etc.) having a first concentration of the particulates and may provide the exhaust gas (e.g., to the inlet conduit 804, etc.)

having a second concentration of the particulates, where the second concentration is lower than the first concentration. In some embodiments, the aftertreatment system 800 does not include the filter 806.

The exhaust gas conduit system 802 also includes an introduction conduit 807 (e.g., decomposition housing, decomposition reactor, decomposition chamber, reactor pipe, decomposition tube, reactor tube, hydrocarbon introduction housing, etc.). The introduction conduit 807 is fluidly coupled to the inlet conduit 804 and is configured to receive exhaust gas from the inlet conduit 804 (e.g., after flowing through the filter 806). In various embodiments, the introduction conduit 807 is coupled to the inlet conduit 804. For example, the introduction conduit 807 may be fastened, welded, riveted, or otherwise attached to the inlet conduit 804. In other embodiments, the introduction conduit 807 is integrally formed with the inlet conduit 804. In some embodiments, the inlet conduit 804 is the introduction conduit 807 (e.g., only the inlet conduit 804 is included in the exhaust gas conduit system 802 and the inlet conduit 804 functions as both the inlet conduit 804 and the introduction conduit 807). The introduction conduit 807 is centered on the conduit center axis 805 (e.g., the conduit center axis 805 extends through a center point of the introduction conduit 807, etc.). The introduction conduit 807 has a conduit diameter $d_c$. The conduit diameter de may be selected so as to tailor the aftertreatment system 800 for a target application.

The aftertreatment system 800 also includes a treatment fluid delivery system 808. As is explained in more detail herein, the treatment fluid delivery system 808 is configured to facilitate the introduction of a treatment fluid, such as a reductant or a hydrocarbon, into the exhaust gas. When the reductant is introduced into the exhaust gas, reduction of emission of undesirable components in the exhaust gas may be facilitated. When the hydrocarbon is introduced into the exhaust gas, the temperature of the exhaust gas may be increased (e.g., to facilitate regeneration of components of the aftertreatment system 800, etc.). For example, the temperature of the exhaust gas may be increased by combusting the hydrocarbon within the exhaust gas (e.g., using a spark plug, etc.).

The treatment fluid delivery system 808 includes a dosing module 810 (e.g., doser, reductant doser, hydrocarbon doser, etc.). The dosing module 810 is configured to facilitate passage of the treatment fluid through the introduction conduit 807 and into the introduction conduit 807. The dosing module 810 may include an insulator interposed between a portion of the dosing module 810 and the portion of the introduction conduit 807 on which the dosing module 810 is mounted. In various embodiments, the dosing module 810 is coupled to the introduction conduit 807.

The treatment fluid delivery system 808 also includes a treatment fluid source 812 (e.g., reductant tank, hydrocarbon tank, etc.). The treatment fluid source 812 is configured to contain the treatment fluid. The treatment fluid source 812 is fluidly coupled to the dosing module 810 and configured to provide the treatment fluid to the dosing module 810. The treatment fluid source 812 may include multiple treatment fluid sources 812 (e.g., multiple tanks connected in series or in parallel, etc.). The treatment fluid source 812 may be, for example, a diesel exhaust fluid tank containing Adblue® or a fuel tank containing fuel.

The treatment fluid delivery system 808 also includes a treatment fluid pump 814 (e.g., supply unit, etc.). The treatment fluid pump 814 is fluidly coupled to the treatment fluid source 812 and the dosing module 810 and configured to receive the treatment fluid from the treatment fluid source 812 and to provide the treatment fluid to the dosing module 810. The treatment fluid pump 814 is used to pressurize the treatment fluid from the treatment fluid source 812 for delivery to the dosing module 810. In some embodiments, the treatment fluid pump 814 is pressure controlled. In some embodiments, the treatment fluid pump 814 is coupled to a chassis of a vehicle associated with the aftertreatment system 800.

In some embodiments, the treatment fluid delivery system 808 also includes a treatment fluid filter 816. The treatment fluid filter 816 is fluidly coupled to the treatment fluid source 812 and the treatment fluid pump 814 and is configured to receive the treatment fluid from the treatment fluid source 812 and to provide the treatment fluid to the treatment fluid pump 814. The treatment fluid filter 816 filters the treatment fluid prior to the treatment fluid being provided to internal components of the treatment fluid pump 814. For example, the treatment fluid filter 816 may inhibit or prevent the transmission of solids to the internal components of the treatment fluid pump 814. In this way, the treatment fluid filter 816 may facilitate prolonged desirable operation of the treatment fluid pump 814.

The dosing module 810 includes at least one injector 818 (e.g., insertion device, etc.). The injector 818 is fluidly coupled to the treatment fluid pump 814 and configured to receive the treatment fluid from the treatment fluid pump 814. The injector 818 is configured to dose the treatment fluid received by the dosing module 810 into the exhaust gas within the introduction conduit 807 and along an injection axis 819 (e.g., within a spray cone that is centered on the injection axis 819, etc.).

In some embodiments, the treatment fluid delivery system 808 also includes an air pump 820 and an air source 822 (e.g., air intake, etc.). The air pump 820 is fluidly coupled to the air source 822 and is configured to receive air from the air source 822. The air pump 820 is fluidly coupled to the dosing module 810 and is configured to provide the air to the dosing module 810. In some applications, the dosing module 810 is configured to mix the air and the treatment fluid into an air-treatment fluid mixture and to provide the air-treatment fluid mixture to the injector 818 (e.g., for dosing into the exhaust gas within the introduction conduit 807, etc.). The injector 818 is fluidly coupled to the air pump 820 and configured to receive the air from the air pump 820. The injector 818 is configured to dose the air-treatment fluid mixture into the exhaust gas within the introduction conduit 807. In some of these embodiments, the treatment fluid delivery system 808 also includes an air filter 824. The air filter 824 is fluidly coupled to the air source 822 and the air pump 820 and is configured to receive the air from the air source 822 and to provide the air to the air pump 820. The air filter 824 is configured to filter the air prior to the air being provided to the air pump 820. In other embodiments, the treatment fluid delivery system 808 does not include the air pump 820 and/or the treatment fluid delivery system 808 does not include the air source 822. In such embodiments, the dosing module 810 is not configured to mix the treatment fluid with the air.

In various embodiments, the dosing module 810 is configured to receive air and fluid, and doses the air-treatment fluid mixture into the introduction conduit 807. In various embodiments, the dosing module 810 is configured to receive treatment fluid (and does not receive air), and doses the treatment fluid into the introduction conduit 807. In various embodiments, the dosing module 810 is configured to receive treatment fluid, and doses the treatment fluid into the introduction conduit 807. In various embodiments, the dosing module 810 is configured to receive air and treatment fluid, and doses the air-treatment fluid mixture into the introduction conduit 807.

The aftertreatment system 800 also includes a controller 826 (e.g., control circuit, driver, etc.). The dosing module 810, the treatment fluid pump 814, and the air pump 820 are also electrically or communicatively coupled to the controller 826. The controller 826 is configured to control the dosing module 810 to dose the treatment fluid or the air-treatment fluid mixture into the introduction conduit 807. The controller 826 may also be configured to control the treatment fluid pump 814 and/or the air pump 820 in order to control the treatment fluid or the air-treatment fluid mixture that is dosed into the introduction conduit 807.

The controller 826 includes a processing circuit 828. The processing circuit 828 includes a processor 830 and a memory 832. The processor 830 may include a microprocessor, an ASIC, a FPGA, etc., or combinations thereof. The memory 832 may include, but is not limited to, electronic, optical, magnetic, or any other storage or transmission device capable of providing a processor, ASIC, FPGA, etc. with program instructions. This memory 832 may include a memory chip, EEPROM, EPROM, flash memory, or any other suitable memory from which the controller 826 can read instructions. The instructions may include code from any suitable programming language. The memory 832 may include various modules that include instructions which are configured to be implemented by the processor 830.

In various embodiments, the controller 826 is configured to communicate with a central controller 834 (e.g., ECU, ECM, etc.) of an internal combustion engine having the aftertreatment system 800. In some embodiments, the central controller 834 and the controller 826 are integrated into a single controller.

In some embodiments, the central controller 834 is communicable with a display device. The display device may be configured to change state in response to receiving information from the central controller 834. For example, the display device may be configured to change between a static state and an alarm state based on a communication from the central controller 834. By changing state, the display device may provide an indication to a user of a status of the treatment fluid delivery system 808.

The aftertreatment system 800 also includes a mixer 836 (e.g., a swirl generating device, etc.). At least a portion of the mixer 836 is positioned within the introduction conduit 807. In some embodiments, a first portion of the mixer 836 is positioned within the inlet conduit 804 and a second portion of the mixer 836 is positioned within the introduction conduit 807.

The mixer 836 receives the exhaust gas from the inlet conduit 804 (e.g., via the introduction conduit 807, etc.). The mixer 836 also receives the treatment fluid or the air-treatment fluid mixture received from the injector 818. The mixer 836 is configured to mix the treatment fluid or the air-treatment fluid mixture with the exhaust gas. The mixer 836 is also configured to facilitate swirling (e.g., rotation, etc.) of the exhaust gas and mixing (e.g., combination, etc.) of the exhaust gas and the treatment fluid or the air-treatment fluid mixture so as to disperse the treatment fluid within the exhaust gas downstream of the mixer 836 (e.g., to obtain an increased uniformity index, etc.). By dispersing the treatment fluid within the exhaust gas using the mixer 836, reduction of emission of undesirable components in the exhaust gas is enhanced and/or an ability of the aftertreatment system 800 to increase a temperature of the exhaust gas may be enhanced.

The mixer 836 includes a mixer body 838 (e.g., shell, frame, etc.). The mixer body 838 is supported within the inlet conduit 804 and/or the introduction conduit 807. In various embodiments, the mixer body 838 is centered on the conduit center axis 805 (e.g., the conduit center axis 805 extends through a center point of the mixer body 838, etc.). In other embodiments, the mixer body 838 is centered on an axis that is separated from the conduit center axis 805. For example, the mixer body 838 may be centered on an axis that is separated from and approximately parallel to the conduit center axis 805. In another example, the mixer body 838 may be centered on an axis that intersects the conduit center axis 805 and is angled relative to the conduit center axis 805 (e.g., when viewed on a plane along which the axis and the conduit center axis 805 extend, etc.).

The mixer body 838 is defined by a mixer body diameter $d_{mb}$. The mixer body diameter $d_{mb}$ may be selected based on the conduit diameter $d_c$. For example, the mixer body 838 may be configured such that the mixer body diameter $d_{mb}$ is each approximately equal to between 0.30 $d_c$ and 0.90 $d_c$, inclusive (e.g., 0.285 $d_c$, 0.30 $d_c$, 0.40 $d_c$, 0.55 $d_c$, 0.60 $d_c$, 0.70 $d_c$, 0.80c, 0.90 $d_c$, 0.99 $d_c$, etc.).

The mixer body 838 includes a mixer inlet 840 (e.g., inlet aperture, inlet opening, etc.). The mixer inlet 840 receives the exhaust gas (e.g., from the inlet conduit 804, etc.). The mixer body 838 defines (e.g., partially encloses, etc.) a mixer cavity 842 (e.g., void, etc.). The mixer cavity 842 receives the exhaust gas from the mixer inlet 840. As is explained in more detail herein, the exhaust gas is caused to swirl within the mixer body 838.

The mixer 836 also includes an upstream vane plate 844 (e.g., upstream mixing element, mixing plate, etc.). The upstream vane plate 844 is coupled to the mixer body 838 and is disposed within the mixer cavity 842. In some embodiments, the upstream vane plate 844 is coupled to the mixer body 838 proximate the mixer inlet 840.

The upstream vane plate 844 includes a plurality of upstream vanes 846 (e.g., plates, fins, etc.). Each of the upstream vanes 846 extends within the mixer cavity 842 so as to cause the exhaust gas to swirl within the mixer cavity 842 (e.g., downstream of the upstream vane plate 844, etc.). At least one of the upstream vanes 846 is coupled to the mixer body 838. For example, an edge of one of the upstream vanes 846 may be coupled to the mixer body 838 (e.g., using spot welds, etc.).

In various embodiments, each of the upstream vanes 846 is coupled to an upstream vane hub 848 (e.g., center post, etc.). For example, the upstream vanes 846 may be coupled to the upstream vane hub 848 such that the upstream vane plate 844 is rotationally symmetric about the upstream vane hub 848. In various embodiments, the upstream vane hub 848 is centered on the conduit center axis 105 (e.g., the conduit center axis 105 extends through a center point of the upstream vane hub 848, etc.).

The upstream vane plate 844 defines a plurality of upstream vane apertures 850 (e.g., windows, holes, etc.). Each of the upstream vane apertures 850 is located between two adjacent upstream vanes 846. For example, where the upstream vane plate 844 includes four upstream vanes 846, the upstream vane plate 844 includes four upstream vane apertures 850 (e.g., a first upstream vane aperture 850 between a first upstream vane 846 and a second upstream vane 846, a second upstream vane aperture 850 between the second upstream vane 846 and a third upstream vane 846, a third upstream vane aperture 850 between the third upstream vane 846 and a fourth upstream vane 846, and a fourth upstream vane aperture 850 between the fourth upstream vane 846 and the first upstream vane 846). In various embodiments, the upstream vane plate 844 includes the same number of upstream vanes 846 and upstream vane apertures 850.

The mixer body 838 also includes a treatment fluid inlet 852 (e.g., aperture, window, hole, etc.). The treatment fluid inlet 852 is aligned with the injector 818 and the mixer body 838 is configured to receive the treatment fluid or the air-treatment fluid mixture through the treatment fluid inlet 852. The treatment fluid inlet 852 is disposed downstream of the upstream vane plate 844. As a result, the treatment fluid or the air-treatment fluid mixture flows from the injector 818, between the mixer body 838 and the introduction conduit 807, through the mixer body 838 via the treatment fluid inlet 852, and into the mixer cavity 842 (e.g., downstream of the upstream vane plate 844, etc.). The injection axis 819 extends through the treatment fluid inlet 852.

In various embodiments, the mixer body 838 also includes an exhaust gas inlet 853. The exhaust gas inlet 853 is aligned with the treatment fluid inlet 852 and is configured to facilitate flow of the exhaust gas into the mixer body 838. First, the exhaust gas flows between the mixer body 838 and the introduction conduit 807, then the exhaust gas flows though the exhaust gas inlet 853 into the mixer body 838. For example, the exhaust gas flowing through the mixer body 838 may create a vacuum at the exhaust gas inlet 853 and this vacuum may draw the exhaust gas flowing between the mixer body 838 and the introduction conduit 807 into the mixer body 838 via the exhaust gas inlet 853. The flow of the exhaust gas through the exhaust gas inlet 853 opposes the flow of the exhaust gas and the treatment fluid and/or the air-treatment fluid mixture through the treatment fluid inlet 852. In this way, the exhaust gas inlet 853 may mitigate deposit formation on the mixer body 838.

The mixer 836 also includes a downstream vane plate 854 (e.g., downstream mixing element, mixing plate, etc.). The downstream vane plate 854 is coupled to the mixer body 838 and is disposed within the mixer cavity 842. In various embodiments, the downstream vane plate 854 is coupled to the mixer body 838 downstream of the treatment fluid inlet 152 such that the treatment fluid inlet 152 is located between the upstream vane plate 844 and the downstream vane plate 854.

The downstream vane plate 854 includes a plurality of downstream vanes 856 (e.g., plates, fins, etc.). Each of the downstream vanes 856 extends within the mixer cavity 842 so as to cause the exhaust gas to swirl within the mixer cavity 842 (e.g., downstream of the downstream vane plate 854, etc.). At least one of the downstream vanes 856 is coupled to the mixer body 838. For example, an edge of one of the downstream vanes 856 may be coupled to the mixer body 838 (e.g., using spot welds, etc.).

The downstream vane plate 854 may include more, less, or the same number of downstream vanes 856 as the upstream vane plate 844 includes of the upstream vanes 146. For example, where the upstream vane plate 844 includes five upstream vanes 146, the downstream vane plate 854 may include three, four, five, six, or other numbers of the downstream vanes 856.

In various embodiments, each of the downstream vanes 856 is coupled to a downstream vane hub 858 (e.g., center post, etc.). For example, the downstream vanes 856 may be coupled to the downstream vane hub 858 such that the downstream vane plate 854 is rotationally symmetric about the downstream vane hub 858. In various embodiments, the downstream vane hub 858 is centered on the conduit center axis 105 (e.g., the conduit center axis 105 extends through a center point of the downstream vane hub 858, etc.). In some embodiments, the downstream vane hub 858 is centered on an axis that is different from an axis on which the upstream vane hub 148 is centered. For example, the downstream vane hub 858 may be centered on an axis that is approximately parallel to and separated from an axis on which the upstream vane hub 148 is centered.

The downstream vane plate 854 defines a plurality of downstream vane apertures 860 (e.g., windows, holes, etc.). Each of the downstream vane apertures 860 is located between two adjacent downstream vanes 856. For example, where the downstream vane plate 854 includes four downstream vanes 856, the downstream vane plate 854 includes four downstream vane apertures 860 (e.g., a first downstream vane aperture 860 between a first downstream vane 856 and a second downstream vane 856, a second downstream vane aperture 860 between the second downstream vane 856 and a third downstream vane 856, a third downstream vane aperture 860 between the third downstream vane 856 and a fourth downstream vane 856, and a fourth downstream vane aperture 860 between the fourth downstream vane 856 and the first downstream vane 856). In various embodiments, the downstream vane plate 854 includes the same number of downstream vanes 856 and downstream vane apertures 860.

The mixer body 838 further includes a mixer outlet 864 (e.g., outlet aperture, outlet opening, etc.). The mixer outlet 864 provides the exhaust gas and the treatment fluid and/or the air-treatment fluid mixture out of the mixer body 838. Due to the upstream vane plate 844 and the downstream vane plate 854, the exhaust gas exiting the mixer outlet 864 is caused to swirl.

The mixer outlet 864 is defined by a mixer outlet diameter $d_{mo}$. The mixer outlet diameter $d_{mo}$ may be selected based on the conduit diameter $d_c$. For example, the mixer outlet 864 may be configured such that the mixer outlet diameter $d_{mo}$ is each approximately equal to between 0.10 $d_c$ and 0.40 $d_c$, inclusive (e.g., 0.095 $d_c$, 0.10 $d_c$, 0.20 $d_c$, 0.30 $d_c$, 0.35 $d_c$, 0.37 $d_c$, 0.40 $d_c$, 0.44 $d_c$, etc.).

The mixer outlet 864 is disposed along a mixer outlet plane 865. The conduit center axis 805 extends through the mixer outlet plane 865. In various embodiments, the conduit center axis 805 is orthogonal to the mixer outlet plane 865. In various embodiments, the mixer outlet 864 is centered on the same axis as the mixer inlet 840. For example, the mixer inlet 840 and the mixer outlet 864 may be centered on the conduit center axis 805. In other embodiments, the mixer inlet 840 and the mixer outlet 864 are centered on different axes.

The aftertreatment system 800 also includes an upstream support flange 868 (e.g., panel, coupler, ring, etc.). The upstream support flange 868 is coupled to the mixer body 838 proximate the mixer inlet 840. The upstream support flange 868 is also coupled to the introduction conduit 807. The upstream support flange 868 functions to separate the mixer body 838 from the introduction conduit 807 and support the mixer 136 within the introduction conduit 807.

The upstream support flange 868 includes a plurality of upstream support flange apertures 870 (e.g., windows, holes, etc.). Each of the upstream support flange apertures 870 is configured to facilitate passage of the exhaust gas through the upstream support flange 868. As a result, the exhaust gas may flow between the mixer body 838 and the introduction conduit 807.

In various embodiments, the upstream support flange 868 is configured to prevent flow of the exhaust gas between the mixer body 838 and the introduction conduit 807 (e.g., less than 1% of the exhaust gas flowing between the mixer body 838 and the introduction conduit 807 flows between the upstream support flange 868 and the mixer body 838 and between the upstream support flange 868 and the introduction conduit 807, etc.).

At least a portion of the exhaust gas flowing between the mixer body 838 and the introduction conduit 807 enters the mixer body 838 via the treatment fluid inlet 852 and at least a portion of the exhaust gas flowing between the mixer body 838 and the introduction conduit 807 enters the mixer body 838 via the exhaust gas inlet 853. For example, the exhaust gas flowing through the mixer body 838 may create a vacuum at the treatment fluid inlet 852 and this vacuum may draw the exhaust gas flowing between the mixer body 838 and the introduction conduit 807 into the mixer body 838 via the treatment fluid inlet 852. The exhaust gas entering the mixer body via the treatment fluid inlet 852 may assist in propelling the treatment fluid and/or the air-treatment fluid mixture provided by the injector 818 into the mixer cavity 842.

The aftertreatment system 800 also includes a midstream support flange 872 (e.g., panel, coupler, ring, etc.). The midstream support flange 872 is coupled to the mixer body 838 downstream of the treatment fluid inlet 852. The midstream support flange 872 is also coupled to the introduction conduit 807. The midstream support flange 872 functions to separate the mixer body 838 from the introduction conduit 807 and support the mixer 836 within the introduction conduit 807.

In various embodiments, the midstream support flange 872 is configured to prevent flow of the exhaust gas and the treatment fluid and/or the air-treatment fluid mixture between the mixer body 838 and the introduction conduit 807 (e.g., less than 1% of the exhaust gas and the treatment fluid and/or the air-treatment fluid mixture flowing between the mixer body 838 and the introduction conduit 807 flows between the midstream support flange 872 and the mixer body 838 and between the midstream support flange 872 and the introduction conduit 807, etc.). In this way, the midstream support flange 872 functions to direct the exhaust gas and the treatment fluid and/or the air-treatment fluid mixture flowing between the mixer body 838 and the introduction conduit 807 into the mixer body 838 via the treatment fluid inlet 852 (e.g., rather than facilitating bypassing of the mixer body 838 using apertures formed in the midstream support flange 872, etc.).

In various embodiments, the midstream support flange 872 includes a plurality of midstream support flange apertures 873 (e.g., windows, holes, etc.). Each of the midstream support flange apertures 873 is configured to facilitate passage of the exhaust gas through the midstream support flange 872. As a result, the exhaust gas may flow between the mixer body 838 and the introduction conduit 807 downstream of the treatment fluid inlet 852.

The aftertreatment system 800 also includes a downstream support flange 874 (e.g., panel, coupler, ring, etc.). The downstream support flange 874 is coupled to the mixer body 838 downstream of the midstream support flange 872. The downstream support flange 874 is also coupled to the introduction conduit 807. The downstream support flange 874 functions to separate the mixer body 838 from the introduction conduit 807 and support the mixer 836 within the introduction conduit 807.

In various embodiments, the downstream support flange 874 is configured to prevent (e.g., less than 1% of the exhaust gas and the treatment fluid and/or the air-treatment fluid mixture flowing between the mixer body 838 and the introduction conduit 807 flows between the downstream support flange 874 and the mixer body 838 and between the downstream support flange 874 and the introduction conduit 807, etc.) flow of the exhaust gas and the treatment fluid and/or the air-treatment fluid mixture between the mixer body 838 and the introduction conduit 807. In this way, the downstream support flange 874 functions to prevent flow of the exhaust gas and the treatment fluid and/or the air-treatment fluid mixture exiting the mixer outlet 864 from flowing back upstream towards the mixer inlet 840.

In various embodiments, the downstream support flange 874 includes a plurality of downstream support flange apertures 875 (e.g., windows, holes, etc.). Each of the downstream support flange apertures 875 is configured to facilitate passage of the exhaust gas through the downstream support flange 874. As a result, the exhaust gas may flow between the mixer body 838 and the introduction conduit 807.

The exhaust gas conduit system 802 also includes a transfer conduit 876. The transfer conduit 876 is fluidly coupled to the introduction conduit 807 and is configured to receive the exhaust gas from the introduction conduit 807. In various embodiments, the transfer conduit 876 is coupled to the introduction conduit 807. For example, the transfer conduit 876 may be fastened, welded, riveted, or otherwise attached to the introduction conduit 807. In other embodiments, the transfer conduit 876 is integrally formed with the introduction conduit 807. In some embodiments, the introduction conduit 807 is the transfer conduit 876 (e.g., only the introduction conduit 807 is included in the exhaust gas conduit system 802 and the introduction conduit 807 functions as both the introduction conduit 807 and the transfer conduit 876). The transfer conduit 876 is centered on the conduit center axis 805 (e.g., the conduit center axis 805 extends through a center point of the transfer conduit 876, etc.).

The aftertreatment system 800 also includes a mixing flange 878 (e.g., annular flange, mixing plate, etc.). As is explained in more detail herein, the mixing flange 878 is configured to provide an additional mechanism (e.g., in addition to the mixer 836, etc.) for mixing the exhaust gas and the treatment fluid and/or the air-treatment fluid mixture.

The mixing flange 878 includes a mixing flange body 880 (e.g., frame, etc.). The mixing flange body 880 is coupled to the transfer conduit 876. In various embodiments, the mixing flange body 880 is configured to prevent flow of the exhaust gas and the treatment fluid and/or the air-treatment fluid mixture between the mixing flange body 880 and the transfer conduit 876 (e.g., less than 1% of the exhaust gas and the treatment fluid and/or the air-treatment fluid mixture flowing within the transfer conduit 876 flows between the mixing flange body 880 and the transfer conduit 876, etc.).

The mixing flange 878 includes a mixing flange opening 882 (e.g., window, hole, aperture etc.). The mixing flange opening 882 extends through the mixing flange body 880 and facilitates flow of the exhaust gas and the treatment fluid and/or the air-treatment fluid mixture through the mixing flange 878. In various embodiments, the mixing flange 878 is configured such that the mixing flange opening 882 is centered on the conduit center axis 805. As a result, flow of the exhaust gas and the treatment fluid and/or the air-treatment fluid mixture through the mixing flange opening 882 may be balanced. The mixer 836 and the mixing flange 878 are configured such that the conduit center axis 805 and the outlet center axis 867 extend through the mixing flange opening 882.

The mixing flange opening 882 has a mixing flange opening diameter $d_{mf}$. The mixing flange opening diameter $d_{mf}$ may be selected based on the conduit diameter $d_c$. For example, the mixing flange 878 may be configured such that the mixing flange opening diameter $d_{mf}$ is approximately equal to between 0.30 $d_c$ and 0.95 $d_c$, inclusive (e.g., 0.285 $d_c$, 0.30 $d_c$, 0.35 $d_c$, 0.40 $d_c$, 0.57 $d_c$, 0.60 $d_c$, 0.70 $d_c$, 0.75 $d_c$, 0.80 $d_c$, 0.90 $d_c$, 0.95 $d_c$, $d_c$, etc.).

The mixing flange 878 includes a mixing flange downstream surface 884 (e.g., face, etc.). The mixing flange downstream surface 884 is contiguous with the mixing flange opening 882 and the transfer conduit 876. As the exhaust gas and the treatment fluid and/or the air-treatment fluid mixture flows through the mixing flange opening 882, the exhaust gas and the treatment fluid and/or the air-treatment fluid mixture is gradually caused to flow towards the transfer conduit 876 due to the Coandă effect. Specifically, the mixing flange 878 functions as a nozzle, with the mixing flange opening 882 being an outlet of the nozzle, and the exhaust gas and the treatment fluid and/or the air-treatment fluid mixture is caused to flow towards the transfer conduit 876 after flowing through the mixing flange opening. As a result of the Coandă effect, vortices are formed along the mixing flange downstream surface 884. These vortices cause swirling of the exhaust gas and the treatment fluid and/or the air-treatment fluid mixture downstream of the mixing flange 878. In this way, the mixing flange 878 is configured to provide an additional mechanism (e.g., in addition to the mixer 836, etc.) for mixing the exhaust gas and the treatment fluid and/or the air-treatment fluid mixture. Additionally, the Coandă effect creates a virtual surface due to shear between recirculating flow of the exhaust gas and the treatment fluid and/or the air-treatment fluid mixture (e.g., within the vortices, etc.) and the flow of the exhaust gas and the treatment fluid and/or the air-treatment fluid mixture flowing through the mixing flange opening 882.

The mixing flange downstream surface 884 is separated from the mixer outlet 864 by a mixing flange separation distance $S_{mf}$. The mixing flange separation distance $S_{mf}$ may be selected based on the conduit diameter de. For example, the mixing flange 878 may be configured such that the mixing flange separation distance $S_{mf}$ is approximately equal to between 0.10 $d_c$ and 0.50 $d_c$, inclusive (e.g., 0.09 $d_c$, 0.10 $d_c$, 0.20 $d_c$, 0.30 $d_c$, 0.40 $d_c$, 0.45 $d_c$, 0.50 $d_c$, 0.525 $d_c$, etc.).

In various embodiments, such as is shown in FIG. 8, the mixing flange 878 also includes one or more flow disrupters 886 (e.g., protrusions, projections, protuberances, ribs, fins, guides, etc.). Each of the flow disrupters 886 is coupled to or integrally formed with the mixing flange downstream surface 884. For example, the flow disrupters 886 may be welded or fastened to the mixing flange downstream surface 884. In another example, the flow disrupters 886 are formed in the mixing flange downstream surface 884 via a bending process in which portions of the mixing flange 878 are bent away from the mixer 836.

Each of the flow disrupters 886 extends (e.g., protrudes, projects, etc.) inwardly from an inner surface 888 (e.g., face, etc.) of the transfer conduit 876. As a result, the exhaust gas flowing within the transfer conduit 876 is caused to flow around the flow disrupters 886. By flowing around the flow disrupters 886, the swirl of the exhaust gas that is provided by the mixing flange 878 (e.g., due to the Coandă effect, etc.) is disrupted (e.g., broken up, etc.). This disruption causes the exhaust gas to tumble downstream of the flow disrupters 886. In addition to the swirl provided by the mixer 836 and the swirl provided by the mixing flange 878 (e.g., due to the Coandă effect, etc.), this tumbling provides another mechanism for mixing of the exhaust gas and the treatment fluid and/or the air-treatment fluid mixture. By variously configuring the flow disrupters 886, a target mixing of the exhaust gas and the treatment fluid and/or the air-treatment fluid mixture can be achieved.

As a result, the flow disrupters 886 are capable of increasing a UI of the treatment fluid in the exhaust gas without substantially increasing a pressure drop produced by the mixer 836, a wall-film of the mixer 836, or deposits formed by the mixer 836, compared to other mixing devices. Additionally, the configurations of each of the flow disrupters 886 may be selected so as to minimize manufacturing requirements and decrease weight of the mixer 836 and low frequency modes when compared to other mixer devices. Furthermore, the mixer 836 may be variously configured while utilizing the flow disrupters 886 (e.g., the flow disrupters 886 do not substantially limit a configuration of the mixer 836, etc.).

In some embodiments, the flow disrupters 886 are plate-shaped (e.g., shaped as trapezoidal prisms, etc.). However, the flow disrupters 886 may be variously shaped such that the aftertreatment system 800 is tailored for a target application. For example, the flow disrupters 886 may be frustoconical, shaped as rectangular prisms, cylindrical, shaped as a frustum of a pyramid, or otherwise similarly shaped.

Each of the flow disrupters 886 extends at an angle relative to the mixing flange downstream surface 884. In some embodiments, each of the flow disrupters 886 extends orthogonally from the mixing flange downstream surface 884. However, in some embodiments, one or more of the flow disrupters 886 extends at an acute angle relative to the mixing flange downstream surface 884. Such angling of the flow disrupters 886 may generate additional mixing of the exhaust gas and the treatment fluid and/or the air-treatment fluid mixture. Additionally, angles of each of the flow disrupters 886 may be selected based on angles of the other flow disrupters 886 so that all of the flow disrupters 886 cooperatively generate additional mixing of the exhaust gas and the treatment fluid and/or the air-treatment fluid mixture. In an example where there are three of the flow disrupters 886, each of the flow disrupters 886 may be angled relative to the mixing flange downstream surface 884 at an angle of between 30° and 80°, inclusive.

Additionally, each of the flow disrupters 886 may have an edge that is contiguous with the mixing flange opening 882. However, in some embodiments, an edge of one or more of the flow disrupters 886 is separated from the mixing flange opening 882.

A downstream edge of each of the flow disrupters 886 is separated from the mixer outlet plane 865 by a separation $S_{fd}$. The separation $S_{fd}$ for each of the flow disrupters 886 may be independently selected such that the aftertreatment system 800 is tailored for a target application.

Additionally, a center point 890 (e.g., apex, etc.) of each of the flow disrupters 886 may be angularly separated from the injection axis 819 by an angular separation $\alpha_{fd}$ when measured along a plane that is orthogonal to the conduit center axis 805. This plane may be approximately parallel to the mixer outlet plane 865 and/or a plane along which the injection axis 819 is disposed. The angular separation $\alpha_{fd}$ for each of the flow disrupters 886 may be selected independent of the angular separation $\alpha_{fd}$ for others of the flow disrupters 886 such that the aftertreatment system 800 is tailored for a target application. In various embodiments, the angular separation $\alpha_{fd}$ for each of the flow disrupters 886 is approximately equal to between 0° and 270°, inclusive (e.g., 0°, 45°, 55°, 65°, 75°, 90°, 120°, 150°, 180°, 220°, 270°, 283.5°, etc.).

Furthermore, each of the flow disrupters 886 is also defined by a radial height $h_{rfd}$. The radial height $h_{rfd}$ is measured from each center point 890 to the transfer conduit 876 along an axis that is orthogonal to the conduit center axis 805, and intersects the conduit center axis 805, the center point 890, and the transfer conduit 876.

The radial height $h_{rfd}$ influences how far each of the flow disrupters 886 projects into the transfer conduit 876, and therefore how much each of the flow disrupters 886 impacts the exhaust gas and the treatment fluid and/or the air-treatment fluid mixture. For example, the greater the radial height $h_{rfd}$, the more disruption that the flow disrupter 886 causes to the exhaust gas and the treatment fluid and/or the air-treatment fluid mixture. The radial height $h_{rfd}$ for each of the flow disrupters 886 may be independently selected such that the aftertreatment system 800 is tailored for a target application. In this way, for example, an ability of each of the flow disrupter 886 to cause mixing of the exhaust gas and the treatment fluid and/or the air-treatment fluid mixture may be selected so as to tailor the aftertreatment system 800 for a target application.

The radial height $h_{rfd}$ may be selected based on the conduit diameter $d_c$. For example, the flow disrupters 886 may be configured such that the radial height $h_{rfd}$ are each approximately equal to between 0.05 $d_c$ and 0.30 $d_c$, inclusive (e.g., 0.0475 $d_c$, 0.05 $d_c$, 0.08 $d_c$, 0.12 $d_c$, 0.15 $d_c$, 0.20 $d_c$, 0.25 $d_c$, 0.30 $d_c$, 0.315 $d_c$, etc.). In some applications, the flow disrupters 886 may be configured such that the radial height $h_{rfd}$ are each approximately equal to between 0.08 $d_c$ and 0.25 $d_c$, inclusive (e.g., 0.076 $d_c$, 0.08 $d_c$, 0.15 $d_c$, 0.20 $d_c$, 0.25 $d_c$, 0.2625 $d_c$, etc.).

In some applications, the radial height $h_{rfd}$ for all of the flow disrupters 886 are equal. In other embodiments, the radial height $h_{rfd}$ for each of the flow disrupters 886 is different from the radial height $h_{rfd}$ for the others of the flow disrupters 886. For example, where four of the flow disrupters 886 are included, the first flow disrupter 886 may have a first radial height $h_{rfd}$, the second flow disrupter 886 may have a second radial height 1.05 $h_{rfd}$, the third flow disrupter 886 may have a third radial height 1.1 $h_{rfd}$, and the fourth flow disrupter 886 may have a fourth radial height 1.15 $h_{rfd}$.

Each of the flow disrupters 886 is also defined by an angular height $h_{afd}$. The angular height $h_{afd}$ is measured from each center point 890 to the transfer conduit 876 along an axis that extends along at least a portion of the flow disrupter 886 and intersects the conduit center axis 805, the center point 890, and the transfer conduit 876.

The angular height $h_{afd}$ influences how gradual the flow disrupters 886 transitions from the transfer conduit 876 to the center point 890, and therefore how much each of the flow disrupters 886 impacts the exhaust gas and the treatment fluid and/or the air-treatment fluid mixture. For example, the lower the angular height ha, the more intense the transition (e.g., the greater the slope of the flow disrupter 886, etc.) from the transfer conduit 876 to the center point 890 for the same radial height $h_{rfd}$. The angular height $h_{afd}$ for each of the flow disrupters 886 may be independently selected such that the aftertreatment system 800 is tailored for a target application. In this way, for example, an ability of each of the flow disrupter 886 to cause mixing of the exhaust gas and the treatment fluid and/or the air-treatment fluid mixture may be selected so as to tailor the aftertreatment system 800 for a target application.

In various embodiments, the angular height $h_{afd}$ for each of the flow disrupters 886 is approximately equal to between 15° and 70°, inclusive (e.g., 14.25°, 15°, 20°, 30°, 48.5°, 50°, 55°, 60°, 70°, 73.5°, etc.). In some embodiments, the angular height $h_{afd}$ for each of the flow disrupters 886 is approximately equal to between 30° and 60°, inclusive (e.g., 28.5°, 30°, 45°, 48.5°, 55°, 60°, 63°, etc.).

In some applications, the angular heights $h_{afd}$ for all of the flow disrupters 886 are equal. In other embodiments, the angular height $h_{afd}$ for each of the flow disrupters 886 is different from the angular heights $h_{afd}$ for the others of the flow disrupters 886. For example, where four of the flow disrupters 886 are included, the first flow disrupter 886 may have a first angular height $h_{afd}$, the second flow disrupter 886 may have a second angular height 1.05 $h_{afd}$, the third flow disrupter 886 may have a third angular height 1.1 $h_{afd}$, and the fourth flow disrupter 886 may have a fourth angular height 1.15 $h_{afd}$.

Additionally, each of the flow disrupters 886 is also defined by a width $w_{fd}$. The width $w_{fd}$ is measured between opposite ends of the downstream edge of each flow disrupter 886. The width $w_{fd}$ influences how far each of the flow disrupters 886 projects into the transfer conduit 876, and therefore how much each of the flow disrupters 886 impacts the exhaust gas and the treatment fluid and/or the air-treatment fluid mixture. For example, the greater the width $w_{fd}$, the more disruption that the flow disrupter 886 causes to the exhaust gas and the treatment fluid and/or the air-treatment fluid mixture. The width $w_{fd}$ for each of the flow disrupters 886 may be independently selected such that the aftertreatment system 800 is tailored for a target application. In this way, for example, an ability of each of the flow disrupter 886 to cause mixing of the exhaust gas and the treatment fluid and/or the air-treatment fluid mixture may be selected so as to tailor the aftertreatment system 800 for a target application.

The width $w_{fd}$ may be selected based on the conduit diameter $d_c$. For example, the flow disrupters 886 may be configured such that the widths $w_{fd}$ are each approximately equal to between 0.10 $d_c$ and 0.70 $d_c$, inclusive (e.g., 0.095 $d_c$, 0.10 $d_c$, 0.15 $d_c$, 0.33 $d_c$, 0.50 $d_c$, 0.60 $d_c$, 0.70 $d_c$, 0.735 $d_c$, etc.). In some applications, the flow disrupters 886 may be configured such that the widths $w_{fd}$ are each approximately equal to between 0.15 $d_c$ and 0.60 $d_c$, inclusive (e.g., 0.8425 $d_c$, 0.15 $d_c$, 0.33 $d_c$, 0.60 $d_c$, 0.63 $d_c$, etc.).

In some applications, the widths $w_{fd}$ for all of the flow disrupters 886 are equal. In other embodiments, the $w_{fd}$ for each of the flow disrupters 886 is different from the $w_{fd}$ for the others of the flow disrupters 886. For example, where four of the flow disrupters 886 are included, the first flow disrupter 886 may have a first width $w_{fd}$, the second flow disrupter 886 may have a second width 1.05 $w_{fd}$, the third flow disrupter 886 may have a third width 1.1 $w_{fd}$, and the fourth flow disrupter 886 may have a fourth width 1.15 $w_{fd}$.

In some embodiments, the flow disrupters 886 include perforations (e.g., apertures, holes, etc.). The perforations are configured to facilitate flow of the exhaust gas through the flow disrupters 886. The perforations may enable flow of the exhaust gas to targeted locations downstream of the mixing flange 878 and/or may decrease a backpressure of the aftertreatment system 800.

In some embodiments, the mixing flange 878 does not include any of the flow disrupters 886. Such embodiments may be beneficial in applications where mixing generated by the mixing flange opening 882 (e.g., due to the Coandă effect, etc.) is sufficient and/or where minimizing cost associated with manufacturing of the mixing flange 878 is desired.

In various embodiments, such as is shown in FIG. 8, the mixing flange 878 also includes one or more mixing flange perforations 892 (e.g., holes, windows, etc.). Each of the mixing flange perforations 892 extends through the mixing flange body 880 and facilitates flow of the exhaust gas and the treatment fluid and/or the air-treatment fluid mixture through the mixing flange 878. In this way, the exhaust gas and the treatment fluid and/or the air-treatment fluid mixture may flow through the mixing flange 878 via the mixing flange opening 882 or one of the mixing flange perforations 892. The mixing flange perforations 892 may enable flow of the exhaust gas to targeted locations downstream of the mixing flange 878 and/or may decrease a backpressure of the aftertreatment system 800.

In some embodiments, the aftertreatment system 800 includes a plurality of the mixing flanges 878. Each of the mixing flanges 878 may be configured independently of the other mixing flanges 878 such that the aftertreatment system 800 is tailored for a target application. In an example where the aftertreatment system 800 includes two mixing flanges 878, the upstream mixing flange 878 may not include the mixing flange perforations 892 and the downstream mixing flange 878 may include the mixing flange perforations 892. In another example where the aftertreatment system 800 includes two mixing flanges 878, the upstream mixing flange 878 may not include the flow disrupters 886 and the downstream mixing flange 878 may include the flow disrupters 886.

In some embodiments, the aftertreatment system 800 includes two of the mixing flanges 878. For example, both of the mixing flanges 878 may include the flow disrupters 886, and the flow disrupters 886 on the first mixing flange 878 extend between the first mixing flange 878 and the second mixing flange 878. In some applications, the flow disrupters 886 on the first mixing flange 878 are coupled to the second mixing flange 878. In some applications, the flow disrupters 886 that extend towards the first mixing flange 878 are coupled to the second mixing flange 878, rather than being coupled to the first mixing flange 878. In some applications, the flow disrupters 886 on the first mixing flange 878 are aligned with the flow disrupters 886 on the second mixing flange 878. In other applications, the flow disrupters 886 on the first mixing flange 878 are offset relative to the flow disrupters 886 on the second mixing flange 878.

In various embodiments, the aftertreatment system 800 also includes a wall plate 894 (e.g., panel, etc.). The wall plate 894 is coupled to the transfer conduit 876 downstream of the mixing flange 878. The wall plate 894 extends from the transfer conduit towards the conduit center axis 805. The wall plate 894 is not annular, and extends across only a portion of a circumference of the transfer conduit 876. In various embodiments, the wall plate 894 extends along a plane that is approximately parallel to a plane that the upstream support flange 868, the midstream support flange 872, and/or the downstream support flange 874 extends along.

The wall plate 894 functions to inhibit flow of the exhaust gas so as to increase the UI of the exhaust gas by enhancing recirculation of the exhaust gas in a manner similar to that of the mixing flange 878. The wall plate 894 may be included in the aftertreatment system 800 where there is an imbalance in distribution of the reductant due to the configuration of the mixer 836. By selectively locating and configuring the wall plate 894 (e.g., using modeling and analysis software, etc.), the UI can be desirably increased.

The wall plate 894 may be disposed opposite the injector 818. In other words, the wall plate 894 and the injector 818 may be aligned along the injection axis 819 and coupled to opposite portions of the introduction conduit 807 and the transfer conduit 876. As a result of this orientation, the wall plate 894 may enhance recirculation along the transfer conduit 876 at locations farthest from the injector 818, which may decrease deposit formation on the transfer conduit 876.

The wall plate 894 may include one or more apertures and/or one or more tabs (e.g., louvers, etc.). The apertures and/or tabs can be included to tailor an impact the wall plate 894 has on the UI.

In various embodiments, the aftertreatment system 800 does not include a perforated plate (e.g., similar to the perforated plate 194 or the perforated plate 694). Specifically, the aftertreatment system 800 does not include a perforated plate downstream of the mixer 836 or downstream of the mixing flange 878. By eliminating the perforated plate, a pressure drop associated with the aftertreatment system 800 may be decreased, which enhances a desirability of the aftertreatment system 800.

The exhaust gas conduit system 802 also includes a first catalyst member conduit 898. The first catalyst member conduit 898 is fluidly coupled to the transfer conduit 876 and is configured to receive the exhaust gas from the transfer conduit 876. In various embodiments, the first catalyst member conduit 898 coupled to the transfer conduit 876. For example, the first catalyst member conduit 898 may be fastened, welded, riveted, or otherwise attached to the transfer conduit 876. In other embodiments, the first catalyst member conduit 898 is integrally formed with the transfer conduit 876. In some embodiments, the transfer conduit 876 is the first catalyst member conduit 898 (e.g., only the transfer conduit 876 is included in the exhaust gas conduit system 802 and the transfer conduit 876 functions as both the transfer conduit 876 and the first catalyst member conduit 898). In various embodiments, the first catalyst member conduit 898 is centered on an axis that is offset from the conduit center axis 805.

The aftertreatment system 800 includes a first catalyst member 900 (e.g., conversion catalyst member, SCR catalyst member, catalyst metals, etc.). The first catalyst member 900 is coupled to the first catalyst member conduit 898. For example, the first catalyst member 900 may be disposed within a shell (e.g., housing, sleeve, etc.) which is press-fit within the first catalyst member conduit 898.

In various embodiments, the first catalyst member 900 is configured to cause decomposition of components of the exhaust gas using reductant (e.g., via catalytic reactions, etc.). In these embodiments, the treatment fluid provided by the dosing module 810 is reductant. Specifically, the reductant that has been provided into the exhaust gas by the injector 818 undergoes the processes of evaporation, thermolysis, and hydrolysis to form non-$NO_x$ emissions within the first catalyst member conduit 898, the transfer conduit 876 and/or the first catalyst member 900. In this way, the first catalyst member 900 is configured to assist in the reduction of $NO_x$ emissions by accelerating a $NO_x$ reduction process between the reductant and the $NO_x$ of the exhaust gas into diatomic nitrogen, water, and/or carbon dioxide. The first catalyst member 900 may include, for example, platinum, rhodium, palladium, or other similar materials. In some embodiments, the first catalyst member 900 is a ceramic conversion catalyst member.

In various embodiments, the first catalyst member 900 is configured to oxidize a hydrocarbon and/or carbon monoxide in the exhaust gas and the treatment fluid and/or the air-treatment fluid mixture. In these embodiments, the first catalyst member 900 includes an oxidation catalyst member (e.g., a DOC, etc.). For example, the first catalyst member 900 may be an oxidation catalyst member that is configured to facilitate conversion of carbon monoxide in the exhaust gas and the treatment fluid and/or the air-treatment fluid mixture into carbon dioxide.

In various embodiments, the first catalyst member 900 may include multiple portions. For example, the first catalyst member 900 may include a first portion that includes platinum and a second portion that includes rhodium. By including multiple portions, an ability of the first catalyst member 900 to facilitate treatment of the exhaust gas may be tailored for a target application.

The exhaust gas conduit system 802 also includes a first outlet conduit 902. The first outlet conduit 902 is fluidly coupled to the first catalyst member conduit 898 and is configured to receive the exhaust gas from the first catalyst member conduit 898. In various embodiments, the first outlet conduit 902 is coupled to the first catalyst member conduit 898. For example, the first outlet conduit 902 may be fastened, welded, riveted, or otherwise attached to the first catalyst member conduit 898. In other embodiments, the first outlet conduit 902 is integrally formed with the first catalyst member conduit 898. In some embodiments, the first catalyst member conduit 898 is the first outlet conduit 902 (e.g., only the first catalyst member conduit 898 is included in the exhaust gas conduit system 802 and the first catalyst member conduit 898 functions as both the first catalyst member conduit 898 and the first outlet conduit 902).

The exhaust gas conduit system 802 also includes a second catalyst member conduit 904. The second catalyst member conduit 904 is fluidly coupled to the transfer conduit 876 and is configured to receive the exhaust gas from the transfer conduit 876. In various embodiments, the second catalyst member conduit 904 coupled to the transfer conduit 876. For example, the second catalyst member conduit 904 may be fastened, welded, riveted, or otherwise attached to the transfer conduit 876. In other embodiments, the second catalyst member conduit 904 is integrally formed with the transfer conduit 876. In some embodiments, the transfer conduit 876 is the second catalyst member conduit 904 (e.g., only the transfer conduit 876 is included in the exhaust gas conduit system 802 and the transfer conduit 876 functions as both the transfer conduit 876 and the second catalyst member conduit 904). In various embodiments, the second catalyst member conduit 904 is centered on an axis that is offset from the conduit center axis 805.

The aftertreatment system 800 includes a second catalyst member 906 (e.g., conversion catalyst member, SCR catalyst member, catalyst metals, etc.). The second catalyst member 906 is coupled to the second catalyst member conduit 904. For example, the second catalyst member 906 may be disposed within a shell (e.g., housing, sleeve, etc.) which is press-fit within the second catalyst member conduit 904.

In various embodiments, the second catalyst member 906 is configured to cause decomposition of components of the exhaust gas using reductant (e.g., via catalytic reactions, etc.). In these embodiments, the treatment fluid provided by the dosing module 810 is reductant. Specifically, the reductant that has been provided into the exhaust gas by the injector 818 undergoes the processes of evaporation, thermolysis, and hydrolysis to form non-$NO_x$ emissions within the second catalyst member conduit 904, the transfer conduit 876 and/or the second catalyst member 906. In this way, the second catalyst member 906 is configured to assist in the reduction of $NO_x$ emissions by accelerating a $NO_x$ reduction process between the reductant and the $NO_x$ of the exhaust gas into diatomic nitrogen, water, and/or carbon dioxide. The second catalyst member 906 may include, for example, platinum, rhodium, palladium, or other similar materials. In some embodiments, the second catalyst member 906 is a ceramic conversion catalyst member.

In various embodiments, the second catalyst member 906 is configured to oxidize a hydrocarbon and/or carbon monoxide in the exhaust gas and the treatment fluid and/or the air-treatment fluid mixture. In these embodiments, the second catalyst member 906 includes an oxidation catalyst member (e.g., a DOC, etc.). For example, the second catalyst member 906 may be an oxidation catalyst member that is configured to facilitate conversion of carbon monoxide in the exhaust gas and the treatment fluid and/or the air-treatment fluid mixture into carbon dioxide.

In various embodiments, the second catalyst member 906 may include multiple portions. For example, the second catalyst member 906 may include a first portion that includes platinum and a second portion that includes rhodium. By including multiple portions, an ability of the second catalyst member 906 to facilitate treatment of the exhaust gas may be tailored for a target application.

The exhaust gas conduit system 802 also includes a second outlet conduit 908. The second outlet conduit 908 is fluidly coupled to the second catalyst member conduit 904 and is configured to receive the exhaust gas from the second catalyst member conduit 904. In various embodiments, the second outlet conduit 908 is coupled to the second catalyst member conduit 904. For example, the second outlet conduit 908 may be fastened, welded, riveted, or otherwise attached to the second catalyst member conduit 904. In other embodiments, the second outlet conduit 908 is integrally formed with the second catalyst member conduit 904. In some embodiments, the second catalyst member conduit 904 is the second outlet conduit 908 (e.g., only the second catalyst member conduit 904 is included in the exhaust gas conduit system 802 and the second catalyst member conduit 904 functions as both the second catalyst member conduit 904 and the second outlet conduit 908).

The aftertreatment system 800 is configured to treat the exhaust gas using the first catalyst member 900 and the second catalyst member 906 in parallel. In this way, a capacity of the aftertreatment system 800 to treat the exhaust gas may be higher than another system which does not include two parallel catalyst members. The wall plate 894 is used to ensure that the UI of the exhaust gas provided to the first catalyst member 900 and the second catalyst member 906 is desirable. For example, the wall plate 894 may be configured such that the UI of the exhaust gas provided to the first catalyst member 900 is approximately equal to the UI of the exhaust gas provided to the second catalyst member 906. The wall plate 894 may, for example, counteract an imbalance in flow rates to the first catalyst member 900 and the second catalyst member 906.

In some embodiments, the aftertreatment system 800 is configured to implement three, four, or other numbers of catalyst members. In these embodiments, the above-mentioned configurations are multiplied such that the aftertreatment system 800 is tailored for a target application.

In various embodiments, the aftertreatment system 800 also includes a sensor 910 (e.g., sensing unit, detector, flow rate sensor, mass flow rate sensor, volumetric flow rate sensor, velocity sensor, pressure sensor, temperature sensor, thermocouple, hydrocarbon sensor, $NO_x$ sensor, CO sensor, $CO_2$ sensor, $O_2$ sensor, particulate sensor, nitrogen sensor, etc.). The sensor 910 is coupled to the transfer conduit 876 and is configured to measure (e.g., sense, detect, etc.) a parameter (e.g., flow rate, mass flow rate, volumetric flow rate, velocity, pressure, temperature, hydrocarbon concentration, $NO_x$ concentration, CO concentration, $CO_2$ concentration, $O_2$ concentration, particulate concentration, nitrogen concentration, etc.) of the exhaust gas and the treatment fluid and/or the air-treatment fluid mixture within the transfer conduit 876. In various embodiments, the sensor 910 is located adjacent the mixing flange downstream surface 884. In this way, the sensor 910 may be located within or proximate to a vortex formed by the mixing flange 878.

The sensor 910 is electrically or communicatively coupled to the controller 826 and is configured to provide a signal associated with the parameter to the controller 826. The controller 826 (e.g., via the processing circuit 828, etc.) is configured to determine the parameter based on the signal. The controller 826 may be configured to control the dosing module 810, the treatment fluid pump 814, and/or the air pump 820 based on the signal. Furthermore, the controller 826 may be configured to communicate the signal to the central controller 834.

While the aftertreatment system 800 has been shown and described in the context of use with a diesel internal combustion engine, the aftertreatment system 800 may be used with other internal combustion engines, such as gasoline internal combustion engines, hybrid internal combustion engines, propane internal combustion engines, dual-fuel internal combustion engines, and other similar internal combustion engines.

V. Configuration of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially," "generally," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The terms "fluidly coupled to" and the like, as used herein, mean the two components or objects have a pathway formed between the two components or objects in which a fluid, such as air, reductant, an air-reductant mixture, exhaust gas, hydrocarbon, an air-hydrocarbon mixture, may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W1 to W2, etc.) herein are inclusive of their maximum values and minimum values (e.g., W1 to W2 includes W1 and includes W2, etc.), unless otherwise indicated. Furthermore, a range of values (e.g., W1 to W2, etc.) does not necessarily require the inclusion of intermediate values within the range of values (e.g., W1 to W2 can include only W1 and W2, etc.), unless otherwise indicated.

What is claimed is:

1. An exhaust gas aftertreatment system comprising:

an exhaust gas conduit comprising an inner surface, the exhaust gas conduit having a conduit diameter $d_c$;

a mixer comprising:

a mixer body, and an upstream vane plate having a plurality of upstream vanes, at least one of the plurality of upstream vanes being coupled to the mixer body; and a mixing flange coupled to the exhaust gas conduit and disposed downstream of the mixer, the mixing flange comprising a mixing flange opening having a mixing flange opening diameter $d_{mf}$, the mixing flange having a mixing flange downstream surface that is separated from the mixer outlet by a mixing flange separation distance $S_{mf}$, wherein $0.30*d_c \leq d_{mf} \leq 0.95*d_c$; and wherein $0.10*d_c \leq S_{mf} \leq 0.50*d_c$.

2. The exhaust gas aftertreatment system of claim 1, further comprising a catalyst member disposed downstream of the mixing flange.

3. The exhaust gas aftertreatment system of claim 2, further comprising a perforated plate disposed downstream of the mixing flange and upstream of the catalyst member, the perforated plate comprising a plurality of perforations.

4. The exhaust gas aftertreatment system of claim 1, wherein the mixing flange further comprises:

a plurality of flow disrupters, each of the plurality of flow disrupters projecting from the mixing flange downstream surface, the plurality of flow disrupters being arranged around the mixing flange opening.

5. The exhaust gas aftertreatment system of claim 4, wherein the mixing flange further comprises a plurality of mixing flange perforations, each of the plurality of mixing flange perforations extending through the mixing flange body.

6. The exhaust gas aftertreatment system of claim 4, wherein at least one of the plurality of flow disrupters is plate-shaped.

7. The exhaust gas aftertreatment system of claim 4, wherein at least one of the plurality of flow disrupters is angled relative to the mixing flange downstream surface at an angle of between 30° and 80°, inclusive.

8. The exhaust gas aftertreatment system of claim 4, wherein one of the plurality of flow disrupters comprises an edge that is contiguous with the mixing flange opening.

9. The exhaust gas aftertreatment system of claim 1, wherein:

the exhaust gas conduit is centered on a conduit center axis; and the mixing flange opening is centered on the conduit center axis.

10. The exhaust gas aftertreatment system of claim 1, wherein the mixer further comprises a treatment fluid inlet disposed downstream of the upstream vane plate and configured to receive at least one of a treatment fluid or an air-treatment fluid mixture.

11. The exhaust gas aftertreatment system of claim 1, further comprising a dosing module coupled to the exhaust gas conduit and configured to provide a treatment fluid into the mixer body.

12. An exhaust gas aftertreatment system comprising:

an exhaust gas conduit centered on a conduit center axis;

a mixer disposed within the exhaust gas conduit, the mixer comprising:

a mixer body having a mixer inlet configured to receive an exhaust gas and a downstream end opposite the mixer inlet, an endcap extending across the downstream end, and a single mixer outlet aperture extending through the endcap, the single mixer outlet aperture configured to provide the exhaust gas, the single mixer outlet aperture centered on an outlet center axis that is offset from the conduit center axis, the single mixer outlet aperture being the only aperture extending through the endcap; and a mixing flange disposed downstream of the mixer, the mixing flange comprising a mixing flange opening;

wherein the conduit center axis and the outlet center axis extend through the mixing flange opening.

13. The exhaust gas aftertreatment system of claim 12, further comprising a baffle plate assembly comprising:

a baffle plate support coupled to the exhaust gas conduit downstream of the mixer and upstream of the mixing flange, and a baffle plate coupled to the baffle plate support and supported within the exhaust gas conduit by the baffle plate support;

wherein the outlet center axis extends through the baffle plate.

14. The exhaust gas aftertreatment system of claim 12, wherein:

the exhaust gas conduit has a conduit diameter $d_c$;

the mixing flange opening has a mixing flange opening diameter $d_{mf}$, and $0.30*d_c \leq d_{mf} \leq 0.95*d_c$.

15. The exhaust gas aftertreatment system of claim 12, wherein the mixer further comprises a treatment fluid inlet disposed upstream of the endcap and configured to receive at least one of a treatment fluid or an air-treatment fluid mixture.

16. The exhaust gas aftertreatment system of claim 15, wherein the mixer further comprises an exhaust gas inlet disposed upstream of the endcap and configured to receive the exhaust gas from between the mixer and the exhaust gas conduit, the exhaust gas inlet being aligned with the treatment fluid inlet.

17. The exhaust gas aftertreatment system of claim 12, wherein the mixing flange further comprises:

a mixing flange body having a mixing flange downstream surface; and a plurality of flow disrupters, each of the plurality of flow disrupters projecting from the mixing flange downstream surface, the plurality of flow disrupters being arranged around the mixing flange opening.

18. The exhaust gas aftertreatment system of claim 17, wherein the mixing flange further comprises a plurality of mixing flange perforations, each of the plurality of mixing flange perforations extending through the mixing flange body.

19. The exhaust gas aftertreatment system of claim 17, wherein at least one of the plurality of flow disrupters is plate-shaped.

20. The exhaust gas aftertreatment system of claim 17, wherein at least one of the plurality of flow disrupters is angled relative to the mixing flange downstream surface at an angle of between 30° and 80°, inclusive.

21. The exhaust gas aftertreatment system of claim 17, wherein one of the plurality of flow disrupters comprises an edge that is contiguous with the mixing flange opening.

* * * * *